US007121954B2

(12) United States Patent
Charron et al.

(10) Patent No.: US 7,121,954 B2
(45) Date of Patent: Oct. 17, 2006

(54) PUTTING METHOD AND PUTTER

(75) Inventors: Jack E. Charron, Irvine, CA (US); Blaine Warner, Irvine, CA (US)

(73) Assignee: Jack Charron, Carlsbad, CA (US)

( * ) Notice: Subject to any disclaimer, the term of this patent is extended or adjusted under 35 U.S.C. 154(b) by 0 days.

(21) Appl. No.: 10/491,970

(22) PCT Filed: Oct. 10, 2002

(86) PCT No.: PCT/US02/32484

§ 371 (c)(1),
(2), (4) Date: Apr. 7, 2004

(87) PCT Pub. No.: WO03/030998

PCT Pub. Date: Apr. 17, 2003

(65) Prior Publication Data

US 2004/0209702 A1 Oct. 21, 2004

Related U.S. Application Data

(60) Provisional application No. 60/328,672, filed on Oct. 11, 2001.

(51) Int. Cl.
*A63B 53/00* (2006.01)
*A63B 57/00* (2006.01)

(52) U.S. Cl. ..... 473/293; 473/409

(58) Field of Classification Search ..... 473/293–294, 473/409
See application file for complete search history.

(56) References Cited

U.S. PATENT DOCUMENTS

| | | | | |
|---|---|---|---|---|
| 3,679,207 | A * | 7/1972 | Florian | 473/292 |
| 4,426,083 | A * | 1/1984 | Dishner, Jr. | 473/252 |
| 6,039,657 | A * | 3/2000 | Gidney | 473/252 |
| 6,152,832 | A * | 11/2000 | Chandler, III | 473/293 |
| 6,595,867 | B1 * | 7/2003 | Sosin | 473/290 |

* cited by examiner

*Primary Examiner*—Stephen Blau
(74) *Attorney, Agent, or Firm*—John J. Connors; Connors & Assoc Inc.

(57) ABSTRACT

A method of putting a ball calls for a golfer to use only one hand (29') or both hands to grasp a putter (10'). The golfer grasps a grip (12') of the putter (10) with one hand so that the proximal end of the grip extends above his wrist (25') in one embodiment, and to or above his elbow (29'*c*) in another embodiment. In both embodiments the proximal bears against the arm associated with this one hand (29'). The golfer stands upright to one side of a target line (14'*a*), with his body facing in the same general direction as the target line and both his feet (35', 36') on the side of the target line and pointing in the same general direction as the target line (14'*a*) and positioned nearby the ball (15'). Most of his body is on the one side of the target line (14'*a*) and the arm (29'*a*) from which the hand extends is the arm (29'*a*) furthest from the target line (14'*a*).

8 Claims, 40 Drawing Sheets

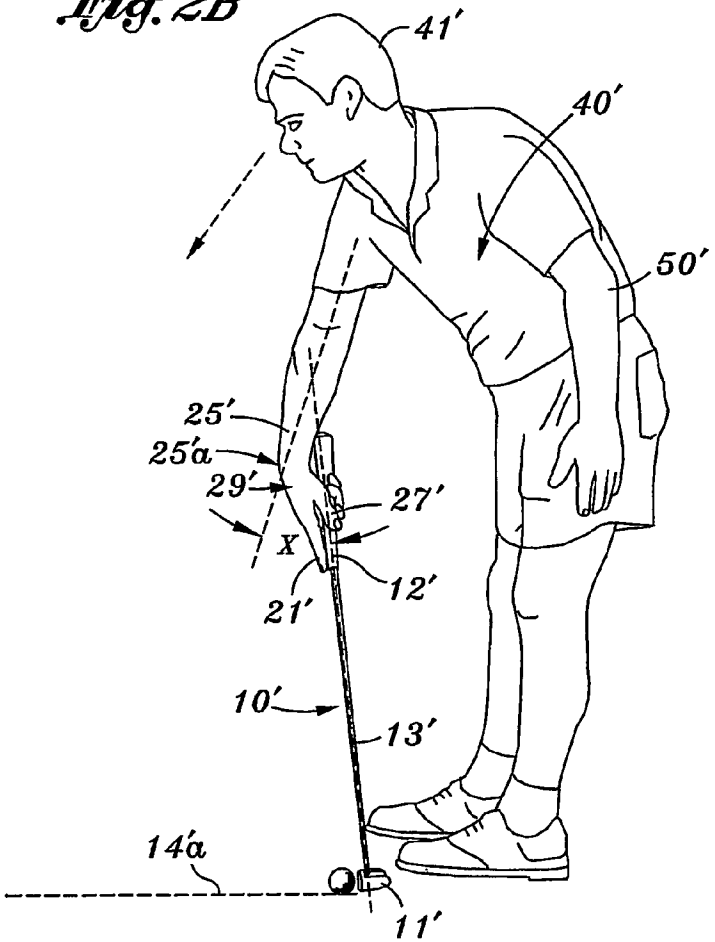
Fig. 2'B
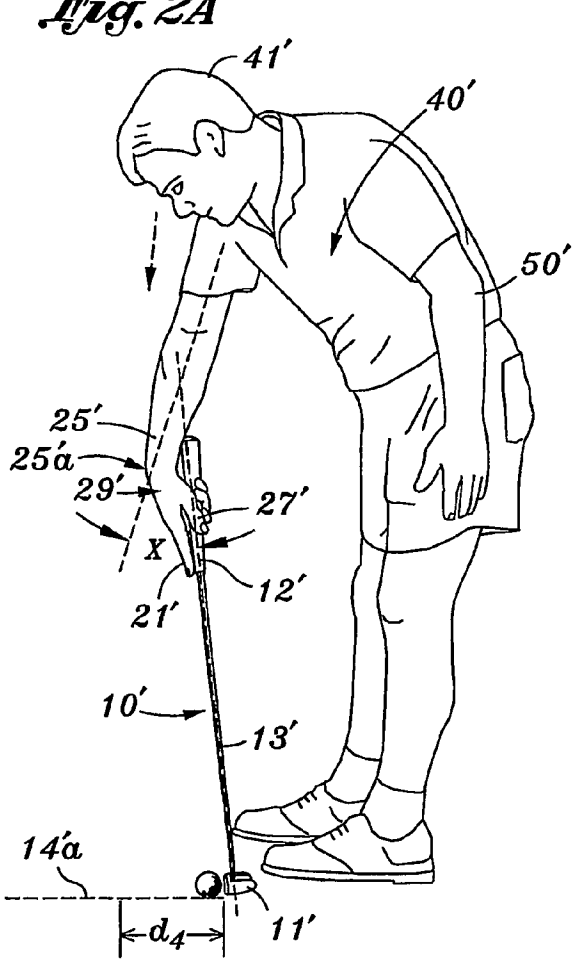
Fig. 2'A

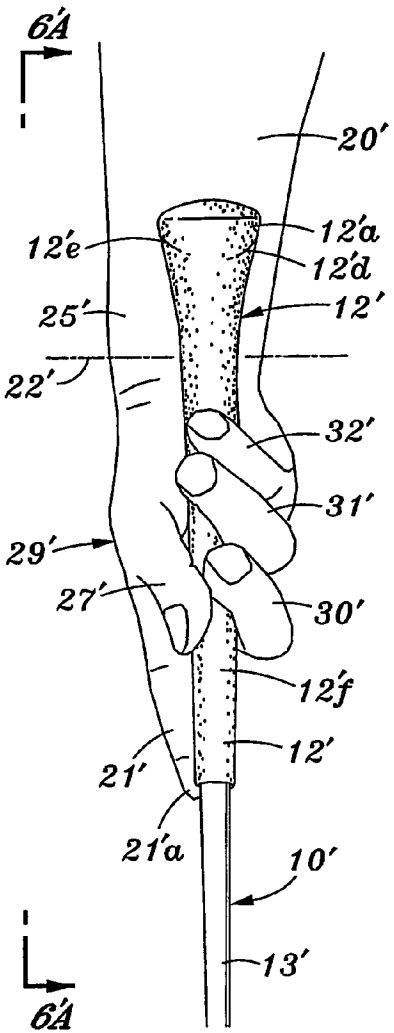
Fig. 5'B
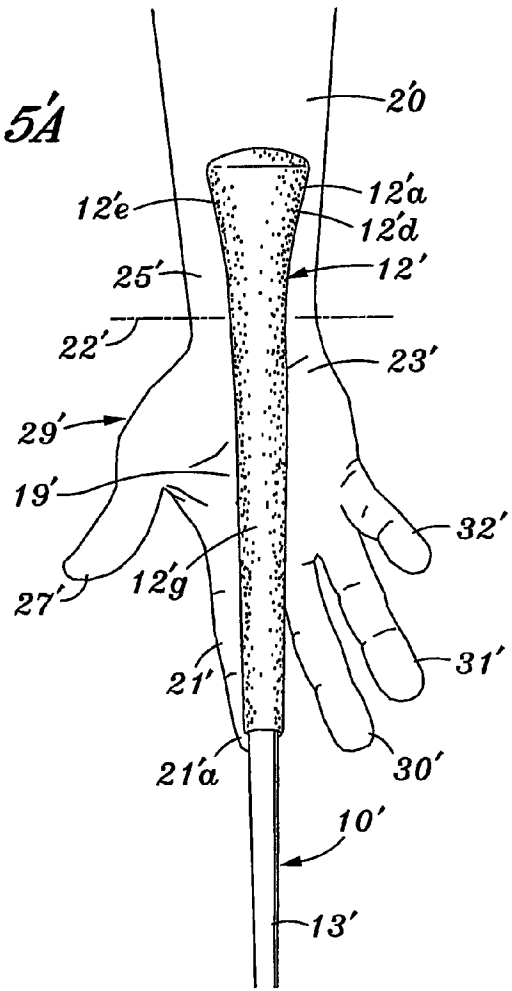
Fig. 5'A

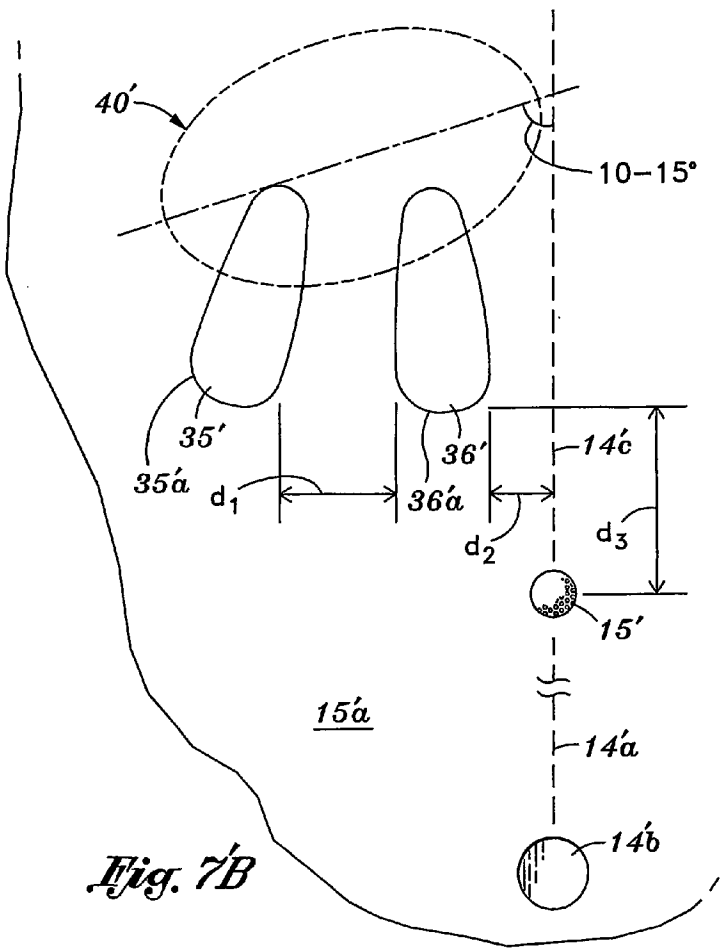
Fig. 7'B
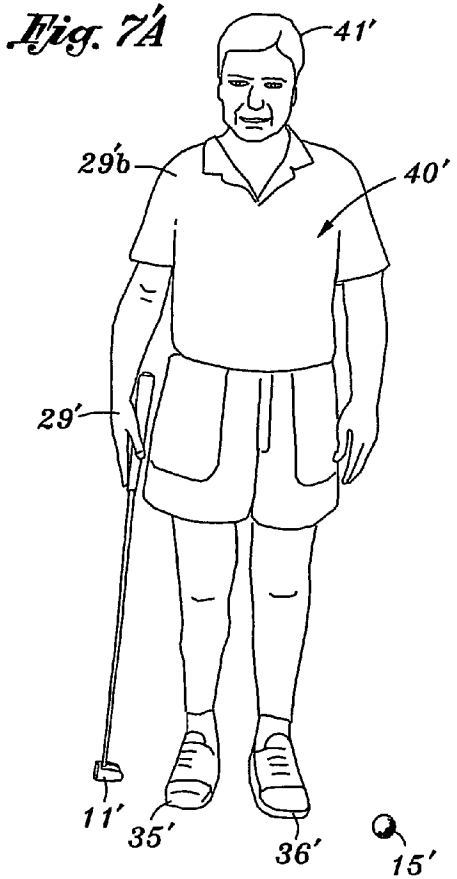
Fig. 7'A

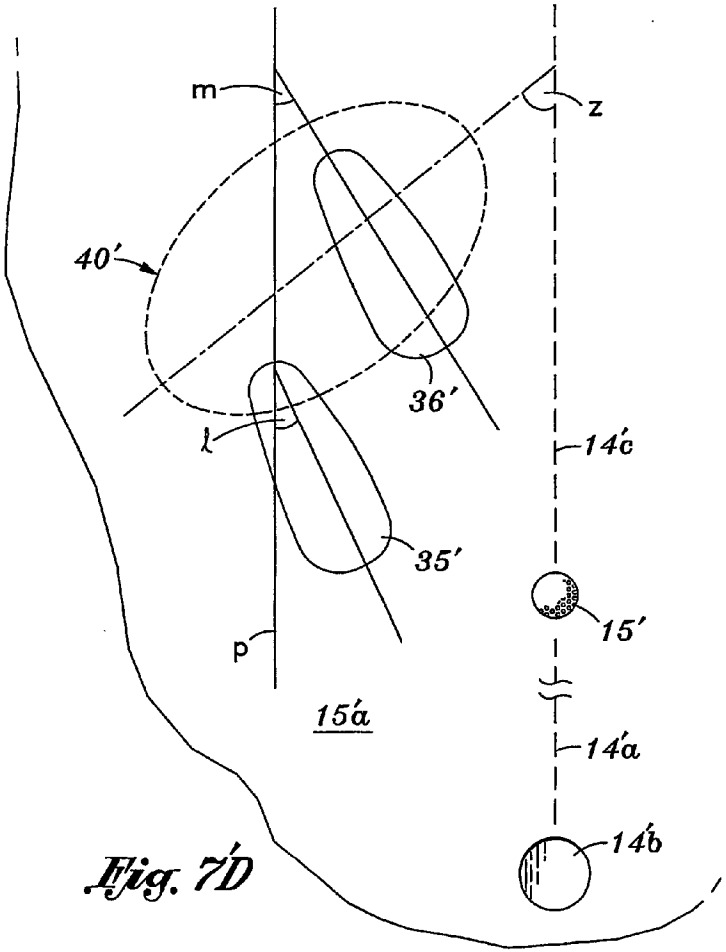
Fig. 7'D
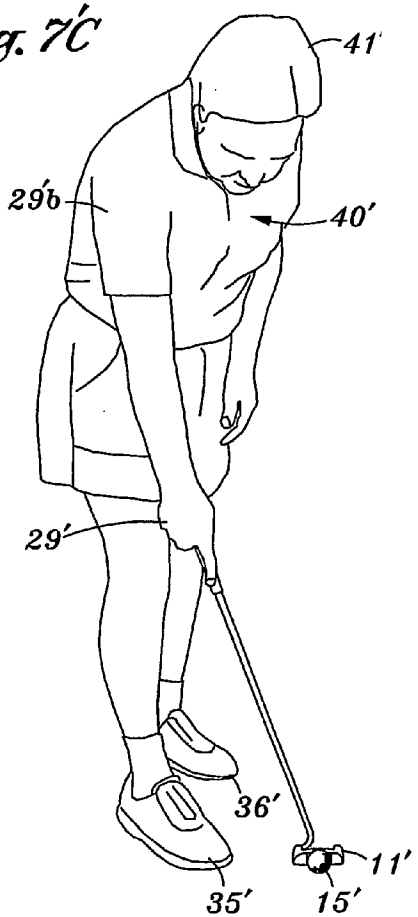
Fig. 7'C

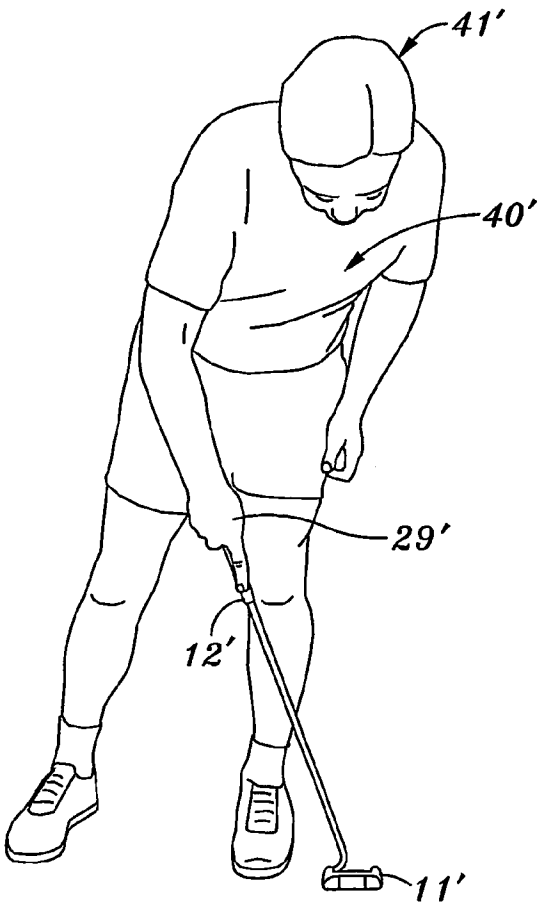
Fig. 7'F
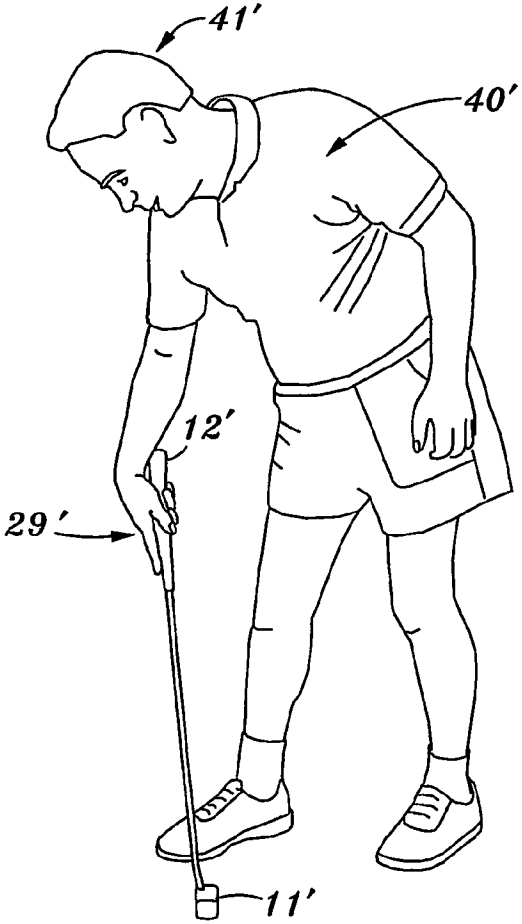
Fig. 7'E

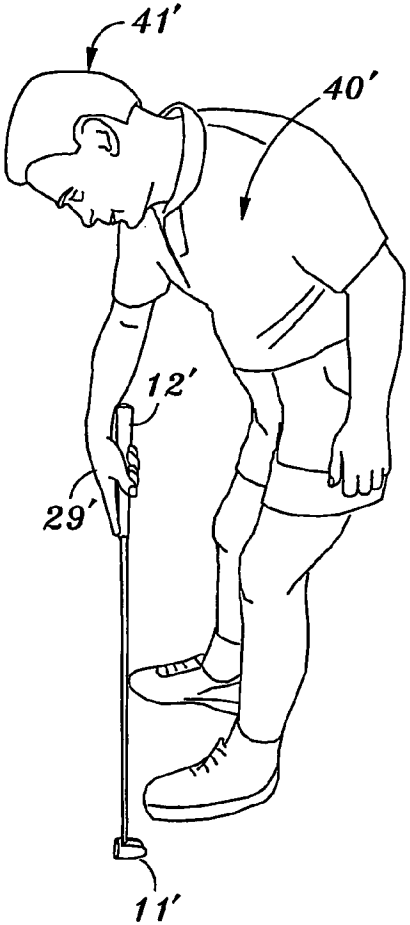
Fig. 7'G
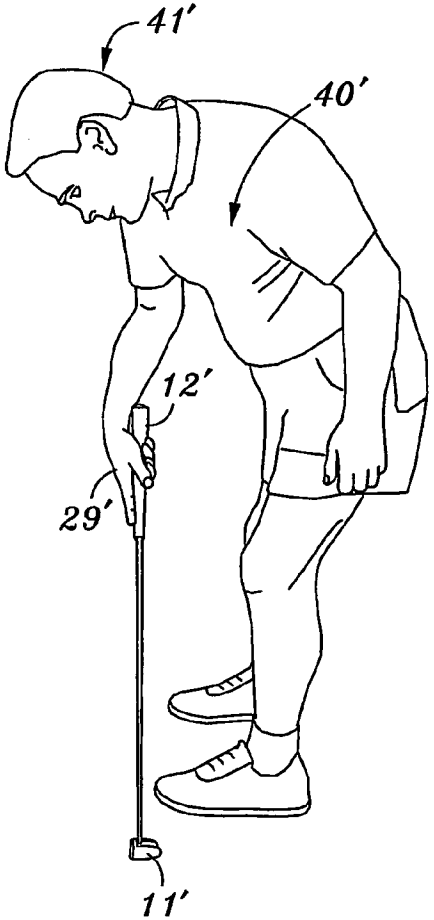
Fig. 7'H
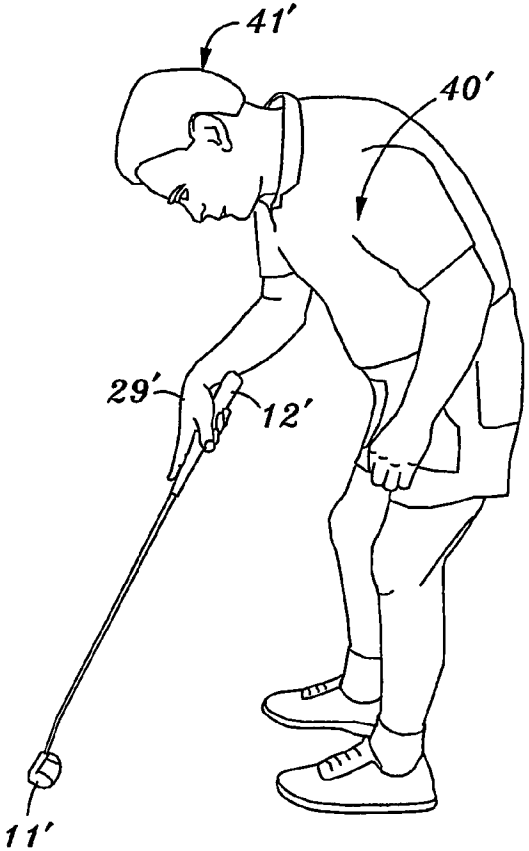
Fig. 7'I

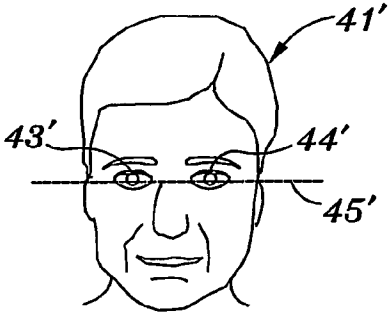
Fig. 8'B
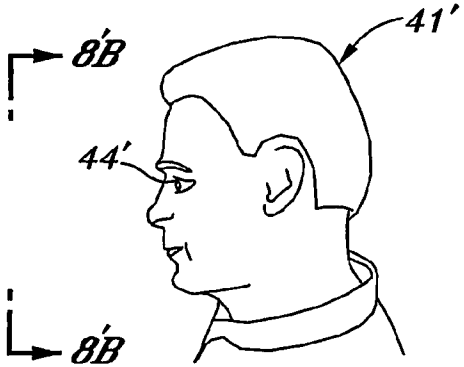
Fig. 8'A
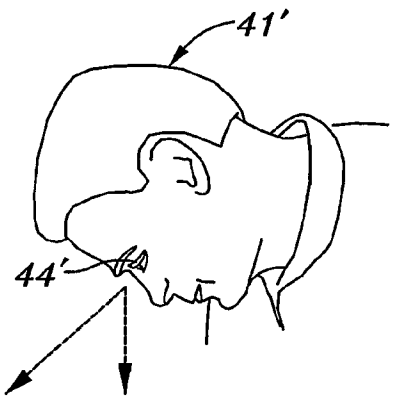
Fig. 8'C

12'e
12'c
12'a
8'
12'f
7'
10'
13'
11'
12'
12'h
13'
7'a
7'b
7'c
12'g
12'i
8'a
8'b
8'c
$t_1$
$t_2$
$t_3$
$t_4$
$w_1$
$w_2$
$l_1$
$l_2$
$l''$

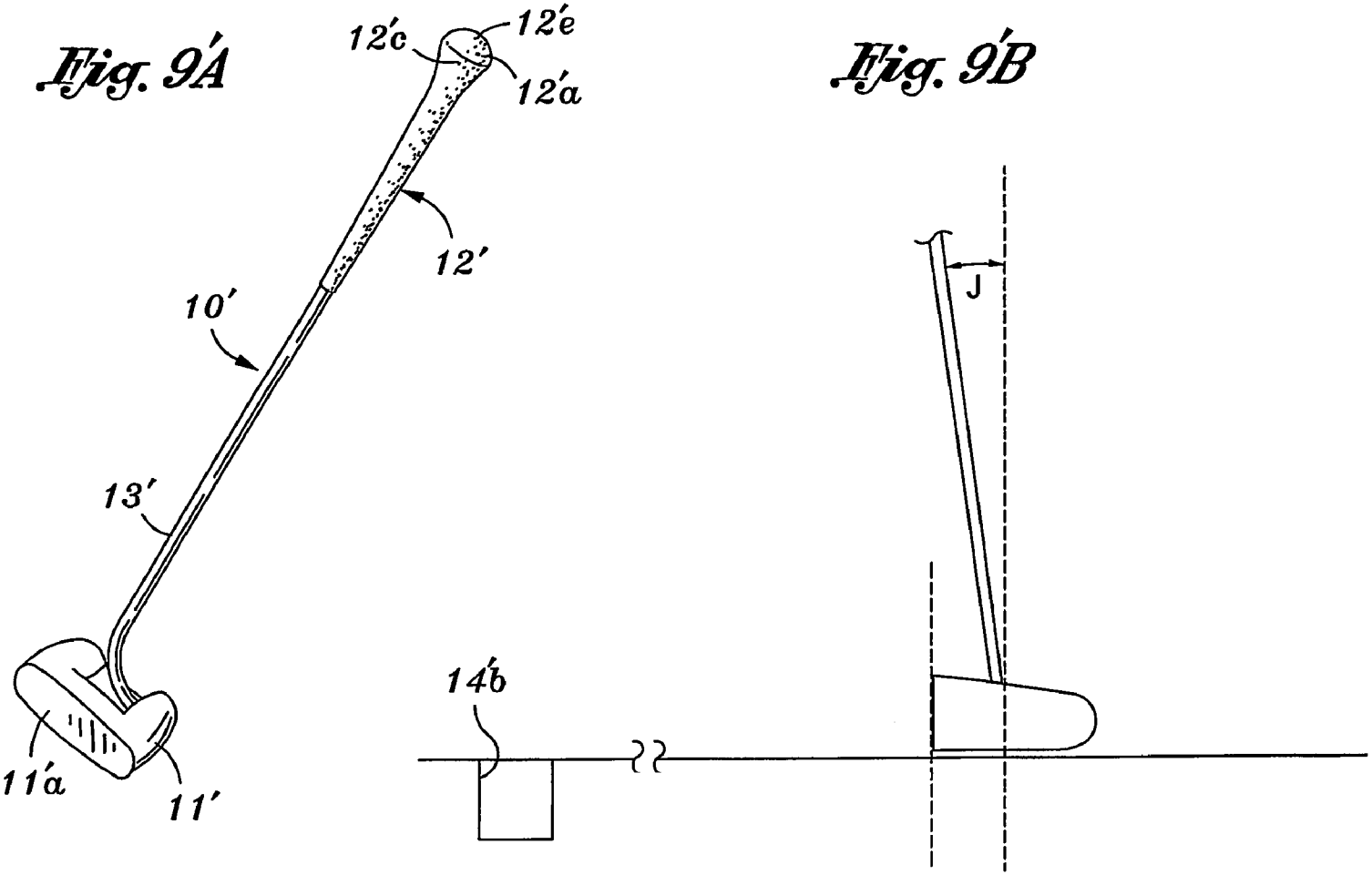
Fig. 9'B
Fig. 9'A

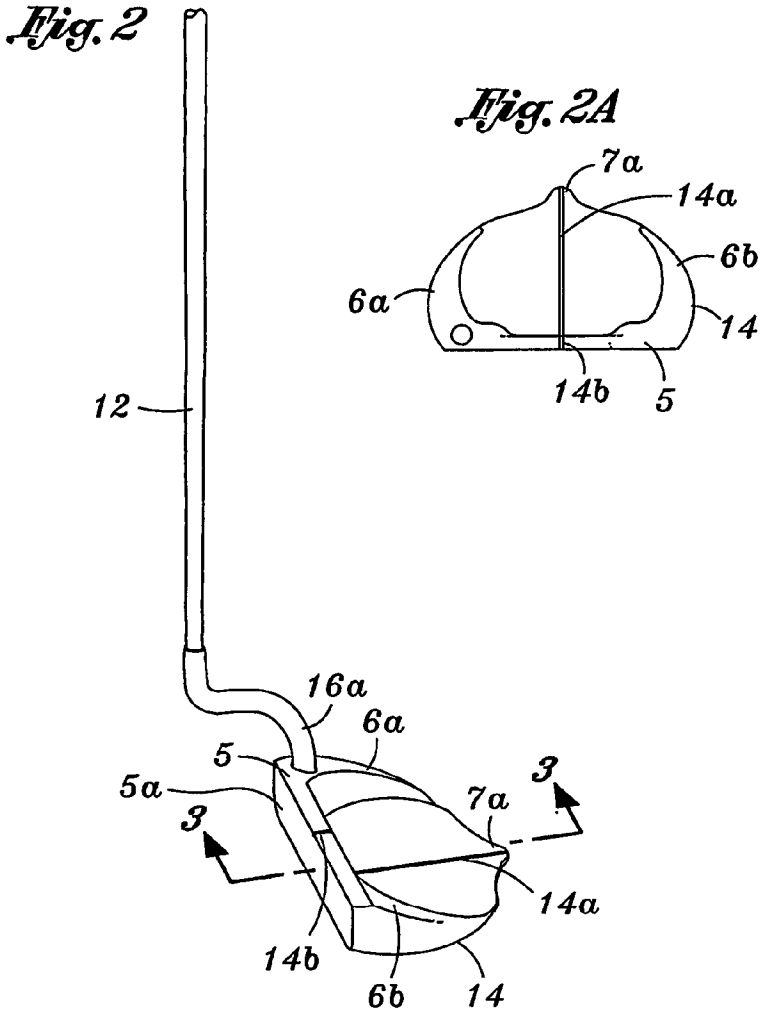
Fig. 2
12
16a
6a
7a
14a
7b
14
6b
14b
5
5a
3
3
Fig. 2A
7a
14a
6b
14
5
14b
6a
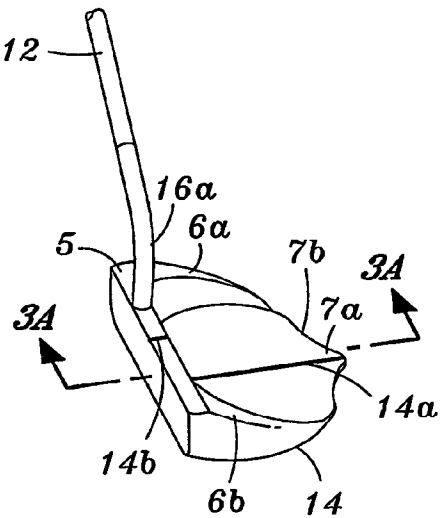
Fig. 2B
12
16a
6a
7b
7a
14a
3A
14
6b
14b
5
3A

B
16
10
20

B
16b
16
10
12
16a
14

B
10

PUTTING METHOD AND PUTTER

RELATED PATENT APPLICATIONS & INCORPORATION BY REFERENCE

This application is a utility patent application based on PCT application PCT/US02/32484, international filing date 10 Oct. 2002, which in turn is based on U.S. provisional patent application Ser. No. 60/328,672, entitled "PUTTING METHOD USING ONLY DOMINANT HAND AND ARM & PUTTER USED THEREWITH," filed Oct. 11, 200. These related applications are incorporated herein by reference and made a part of this application. If any conflict arises between the disclosure of the invention in this utility application and that in the related provisional application, the disclosure in this utility application shall govern. Moreover, Applicants incorporate herein by reference any and all U.S. patents, U.S. patent applications, and other documents cited or referred to in this application or cited or referred to in the U.S. patents and U.S. patent applications incorporated herein by reference.

DEFINITION

The "target line" means a straight line along which a golf ball initially rolls when putted, including a rearward extension of this straight line. Ideally the target line corresponds to a straight line that a golfer visualizes on a surface of a green that he intends the ball to travel initially at the correct speed so the ball falls into the hole in the green. The pronouns he, his, etc. referring the male gender include the female gender.

BACKGROUND OF THE INVENTION

Golf originated over four hundred years ago. Since then many changes have occurred in golf equipment, balls, swing methods, golf course design, construction and maintenance.

Golf is said to be two separate and distinct games played on the same course. In the first game, a ball is hit into the air for distances up to several hundred yards, herein called a "full shot". In the second, the putt, a ball is hit to roll over the surface of a green for distances from less than a foot to more than one hundred feet into a small hole on the green, herein called a "putt".

From the time of golf's origin to the present, golfers found the best swing to hit a full shot was to stand facing the ball on the ground at a right angle to the target with both hands holding the grip of the golf club, to rotate the body, use the major joints and muscles of the body to create leverage, to swing the arms back away from the ball and then to rotate the body and arms forward in an effort to cause the golf club to strike the ball into the air in the direction of the target and to a proper distance, herein referred to as the "traditional swing."

During the first few hundred years of golf the surfaces of greens were rough, bumpy and made of sand, crushed rock and seashells. It took considerable force to putt a ball over those surfaces. Golfers found that the best way to putt on those rough greens was to stand and address the ball in a manner similar to the traditional swing. Since the innovation of modern machinery and superior grass growing methods, greens are smoother and modern balls require much less force to putt balls across them. However, golfers, out of habit or maybe a lack of a better method, have continued to use a miniature version of the traditional swing to putt.

The full shot uses the human body differently than when the human body is used to putt. Briefly, the full shot requires considerable rotation of the body; the major joints of the body and arms open and close in precise timing to create leverage; the arms roll over and swing in a wide arc; the major muscle groups of the body and arms contract and relax extensively; the muscles expend considerable energy to create club speeds up to more than a hundred miles an hour; while the arc of the swing and direction of the club face is controlled by the golfer. Succinctly, the full shot requires both substantial power and control.

Although some golfers today use their wrists and/or arms to swing the putter, the majority of today's two-handed putting golfers putt by slowly rotating the upper body trunk to produce a short, shallow arc of the putter head. The golfer attempts to hold his hands, wrists, elbows and arms in an inactive position so as not to manipulate the putter head and putter face. He attempts to hold the major joints of the body, except for the slow, short arcing of the upper trunk, in the relative positions they were placed at the putting address. Body movement is kept to a minimum. Leverage of body joints is not only unnecessary, it is unwanted. The arms swing in a slow, shallow arc as a result of the short arc movement of the upper body trunk. The body's major muscles do not move, except for the slow, shallow, short movement of the upper trunk. The back and accessory muscles expend the energy, albeit small amounts, necessary to swing the putter. The putter head moves at relatively slow speeds. The arc of the swing and direction of the putter face is controlled by the golfer. This restricted putting movement can be seen almost weekly on the televised professional golf tournaments. Succinctly, a putt requires substantial control and little power.

It is obvious that a golfer must use his human body in the form it exists to hit a full shot or a putt. The human body is made for survival and living on earth. It was not made specifically to play golf, whether to execute a full shot or a putt. In fact, the human body is not well formed for the efficient and excellent execution of either golf method. Some of the sources of the human body's limitations and restrictions to the performance of golf are: its many bones, their shapes and their relative location of one to another; its many major and minor joints and their relative location of one to another, as well as their various capacities and limitations; its many muscles and their capacities, limitations and relative locations; its lack of capacity to execute the precise timing and coordination required by golf methods; the body's limitations for power and precise control over the golf club; and the body's limited ability to accurately sense the existence of the external environment and the influence that those external conditions will have on the body's ability to execute a golf swing and the movement of the ball after it is struck.

With few exceptions, golfers hold the putter grip with both hands when putting. There are various methods to hold the grip with two hands. Two-handed putting provides the golfer with more than enough power for putting. The two hands holding the grip provide the golfer with opposing holding forces that provide general (but not precise) physical control over the putter. However, the many bones, joints, muscles, etc., as referred to above, contained in the hands, arms and body, and their relative locations, create vectors of force on the putter grip from many directions which makes executing a precise controlled putting stroke difficult. A putting stroke consists of a backstroke, a forward stroke, and a follow-through stroke.

The traditional way for golfers to putt is to stand facing the ball on the ground at a right angle to the target line. In this position the golfer's head is also at about a right angle to the target line. He holds the grip of the putter with both hands in front of his body with the putter face aimed down the target line. Herein this traditional way is called a "traditional two-handed technique", "traditional two-handed method" or a "traditional two-handed putt". He looks down at the ball and putter face with the eyes in a frontal, level viewing position. Before putting, golfers usually look over the line of the putt over which the ball will roll in order to determine the contour of the surface. However, after addressing the ball with his body and eyes at right angles to the target line, the golfer rotates his head to the left and looks out of the sides of his eyes to observe the distance, the direction of the hole and the contours of the surface of the green. From this side angle viewing position, the golfer attempts to judge the distance from the ball to the hole, the direction the ball needs to be hit, and the amount of force required to 'sink' the ball into the hole. The golfer then returns his visual focus to the ball and putter face in an attempt to correctly aim the putter face, judge the distance to the hole and estimate the amount of force needed to hit the ball to the hole as he remembers from previous observations. He does this with his body, head and eyes at right angles to the target line.

Traditional two-handed putting, as described above, is complicated and difficult. It limits and restricts successful putting results even for those golfers with exceptional talent, gifted coordination and those who diligently practice.

Some golfers have attempted to putt while holding the grip with only one hand. One hand is sufficient to provide enough power for putting. However, the limitation of having only one force on the grip, (as compared to two opposing forces using a two-handed method), substantially limits the golfer's control over the putter and the orientation of the putter face. For these reasons and others, very few golfers who try one-handed putting methods continue to putt one-handed.

Putting requires golfers to exercise precise and consistent movement, or restraint of movement, of multiple muscles and parts of the body, arms, wrists and hands. Such multiple use and restraint of use of body parts frequently produce inconsistent and inaccurate results in the inherently difficult performance of putting. It is common during the putting swing, that various muscles, joints and body parts will change positions, and/or the muscles and body parts will be activated at different relative times, and/or the muscles and body parts may work against, conflict or oppose one another, or any combination of the above. The end results are inconsistent and inaccurate putts. The movement of so many parts of the body in various combinations and timings is one of the major reasons golfers experience frustration, anxiety and failure in their putting. One only needs to observe golfers on a putting green to see the unsuccessful attempts made to control the putting stroke, the orientation of the putter face and the line of putt of the ball.

Golf is a game or a sport that functions under specific sets of rules and regulations established and published by old and traditional associations that act as stewards for the maintenance of codes by which its participants may play and compete within rules and regulations that are uniform, fair, equitable and enhance the enjoyment of the game by its participants. When a new putting method and putter are created for use on a golf course, the inventor must take those rules and regulations in consideration in the development and creation of that putting method and putter.

From the beginning of the research and development of this invention and considering all of the above information, the goals of this invention were and are to create a putting method that: (1) provides adequate power, (2) increases the general and precise control over the putter and the putting stroke, (3) improves putting accuracy and consistency, (4) compliments the performance of the parts of the human body and their functions with the putting method, rather than conflicting or inhibiting them, (5) reduces the competing forces of the joints, bones, muscles, etc. that exert their forces on the body, the putter and the movement of the putter; (6) simplifies the putting process, (7) improves the ability of golfers to be aware of and use their sensory capacities, including accurate visual and tactile data, in the performance of putting, (8) comply with the rules and regulations established by the governing associations that are the authorities and stewards of the rules and regulations of golf, and (9) by wholly or partially achieving these goals, increase the golfing public's sense of enjoyment of the game of golf.

SUMMARY OF THE INVENTION

This invention has several features that are set forth in the CLAIMS. These features provide this invention with its many desirable attributes. After reading the following section entitled "DETAILED DESCRIPTION," one will understand how the features of this invention provide its benefits, which include, but are not limited to, providing a putting method and putter more suited for use by the human body and its senses, more compatible with the conditions found on and around the surface of the green, and compliant with the rules and regulations of golf. This invention solves, to a great extent, the above stated problems and situations and provides solutions for the purpose improving the ability of golfers to putt more accurately and to better enjoy the game of golf.

With this invention, a unique method of grasping a putter is employed to improve accuracy of putts. A golfer using one hand and associated arm holds a portion of a putter's grip with the golfer's index finger extending lengthwise along a side of the grip. This portion of the grip rests along the palm of the golfer's hand and the remaining digits of the golfer's hand are wrapped around this portion. A proximal end of the putter's shaft extends beyond the wrist associated with the one hand and bears against an underside of the associated arm. Only the one hand and arm may be used, but improved results are obtained when the golfer's other hand is placed on the putter to move in unison with the one hand grasping the putter as discussed above. Typically, this other hand, or a substantial part of this other hand, is placed on the grip immediately below the one hand.

In one embodiment, the proximal end of the shaft is between his wrist and elbow of his arm. In others embodiments, the proximal end of the shaft is just at the elbow, or extends above his elbow and bears against the underside of the upper portion of his arm between his elbow and arm pit. The shaft extends to or above the golfer's elbow when both hands are employed. Preferably, when using only one hand or when using both hands, the golfer's elbow is crooked. Although it is preferred to have the elbow crooked, the golfer's elbow may be substantially fully extended.

According to one embodiment of the putting method of this invention, a golfer (a) grasps a portion of the putter's grip with one hand so that the grip's proximal end extends above his wrist and bears against the underside of the arm associated with the one hand to configure the one hand, arm and putter in a predetermined positional relationship, (b) addresses the ball by standing upright to one side of a target line with his body facing in the same general direction as the target line and both his feet on the one side of the target line and positioned nearby the ball, so that essentially most of his body is on the one side, bringing his arm associated with the hand grasping the putter across the front of his body and positioning the putter head adjacent to the ball and the putter face behind and facing the ball, and (c) strikes the ball by swinging the putter through a backstroke, forward stroke, and follow-through stroke while substantially maintaining the arm and putter in the predetermined positional relationship.

While still maintaining substantially the same predetermined positional relationship, the golfer may slightly rotate his forearm at the elbow of the associated arm just after striking the ball to pivot the forearm in an upward direction and slightly twist the one hand in a manner to keep the putter face square to the target line. When employing only one hand, the golfer uses primarily the shoulder associated with this one hand and its supporting muscles to swing the putter, and primarily this one hand and arm muscles, to maintain the arm and putter in the predetermined positional relationship as the putter is swung, with the shoulder serving as a pivot. When using both hands to grasp the putter, the golfer uses both his shoulders and their supporting muscles to swing the putter, both shoulder sockets serve as pivots, and both hands and both arm muscles are used to maintain the hands, arms and putter in the predetermined positional relationship as the putter is swung, In this method, the putter head rises when striking the ball and the putter face is substantially vertical when the golfer strikes the ball. Typically, the golfer pulls the putter head through the forward stroke and follow-through stroke, and maintains the putter face substantially square to the target line while swinging the putter. In addressing the ball, preferably the golfer stands so that his shoulders are substantially at a right angle to the target line, however, he may slightly rotate his upper torso into a position turned towards the target line. Regardless of his stance, he places essentially most of his weight on his foot closest to the target line, and keeps his body essentially still while swinging the putter. Preferably, the golfer positions his upper body and head to cause his eyes to be in a substantially horizontal position, with at least one eye located substantially vertically above the target line.

The hand, arm and putter in the predetermined positional relationship enable the golfer to be better able to control the direction of the putt. This predetermined positional relationship is maintained with substantially the same hand pressure at the address to the ball and throughout the backstroke, forward stroke and follow-through stroke. The golfer pushes his index finger against the grip to lever the proximal end of the shaft against his arm to create a pressure he detects.

The proximal end of the shaft bearing against the underside of the arm establishes an acceleration gauge that, with practice, is effectively used to control distance. At the beginning of the forward stroke due to the inertia of the putter's head at the distal end of the shaft, this proximal end increases the pressure applied to the underside of the arm that the golfer senses. The greater the acceleration, the greater the increase in pressure. This increase in pressure remains the same throughout the forward stroke as long as the putter's acceleration is constant. The golfer feels any change or deviation from this increase in pressure occurring at the start of the forward stroke. Through practice, the golfer is able to maintain a desired constant acceleration of the putter head by not allowing the pressure to change during the forward stroke.

In accordance with this invention, a novel putter is provided that is especially useful with the method of this invention. This putter includes one or more of the following features:

(1) It includes an elongated shaft having a length that exceeds about 40 inches, typically from about 40 to about 55 inches.

(2) The shaft has attached at a distal end a putter head with a face, the longitudinal axis of the shaft and the putter face form a declining angle of from about 1° to about 15°.

(3) The putter head has a sole plate attached to a faceplate to form there between a substantially right angle.

(4) The face plate has a face and a top surface that is displaced from a top surface of the sole plate, the displacement between the top surface of the face plate and the top surface of the sole plate being typically from about 0.5 to about 1.5 inch.

(5) The top surface of the face plate and the top surface of the sole plate each have a centrally positioned alignment line at a right angle to the face, the alignment lines being aligned with each other.

(6) It includes a grip typically having a length that exceeds about 15 inches, ranging from about 15 to about 30 inches.

(7) The face plate has opposed ends and a slopping wall extends rearward from each of its ends and merges with the top surface of the sole plate.

(8) The grip may have a substantially elliptical cross-section.

DESCRIPTION OF THE DRAWING

Some preferred embodiments of this invention, illustrating all its features, will now be discussed in detail. These embodiments depict the novel and non-obvious features of the putter used in this invention and methods of putting as shown in the accompanying drawing, which is for illustrative purposes only. The drawing illustrates this invention where the golfer uses his right hand in employing the novel method of grasping the putter and putter method according to this invention. A mirror image of this drawing would depict a golfer using his left hand in employing the novel method of grasping the putter and putter method according to this invention. This drawing includes the following figures (FIGS.), with like numerals indicating like parts:

A FIRST EMBODIMENT FIGURES

Figure 1:
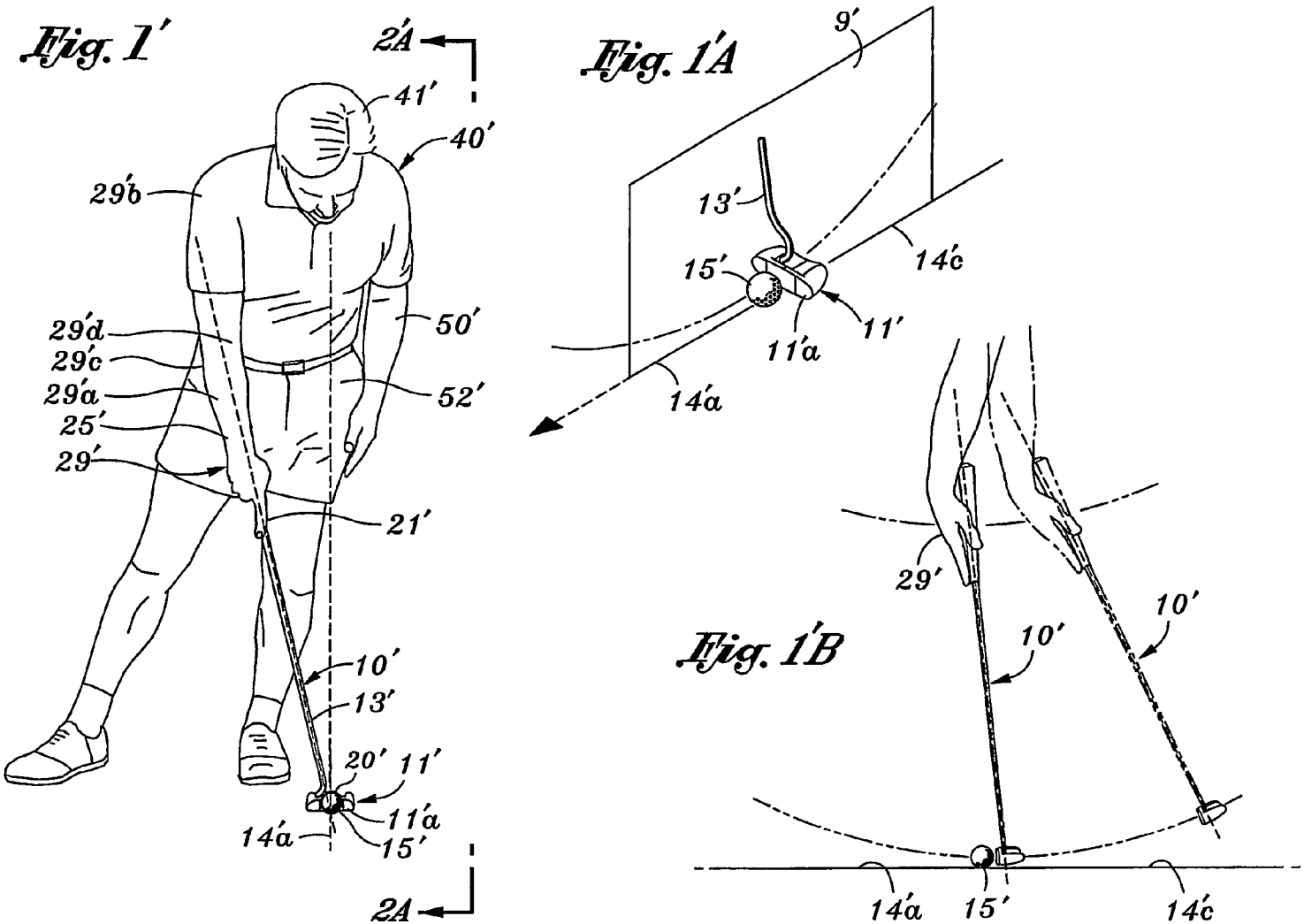

FIG. 1' is a front view of a right-handed golfer addressing a ball in accordance with the one-hand and arm putting method of this invention.

FIG. 1'A is a schematic perspective view depicting the arc of the putter head when using the one-hand and arm putting method of this invention.

FIG. 1'B is a schematic side view depicting the arc of the putter head when using the one-hand and arm putting method of this invention.

FIG. 2'A is a side view taken along line 2'A—2'A of FIG. 1'.

FIG. 2'B is a side view similar to that of FIG. 2'A with the golfer addressing a ball and his head raised to look along the target line.

Figure 3:
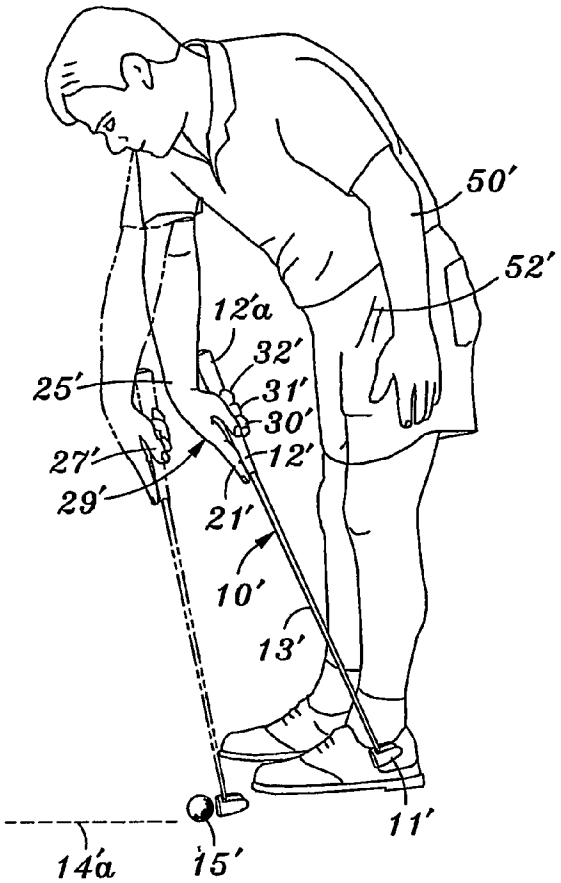

FIG. 3' is side view similar to that of FIG. 2'A illustrating the putter moved from the address position shown in dotted lines to the end of the backstroke shown in solid lines.

Figure 4:
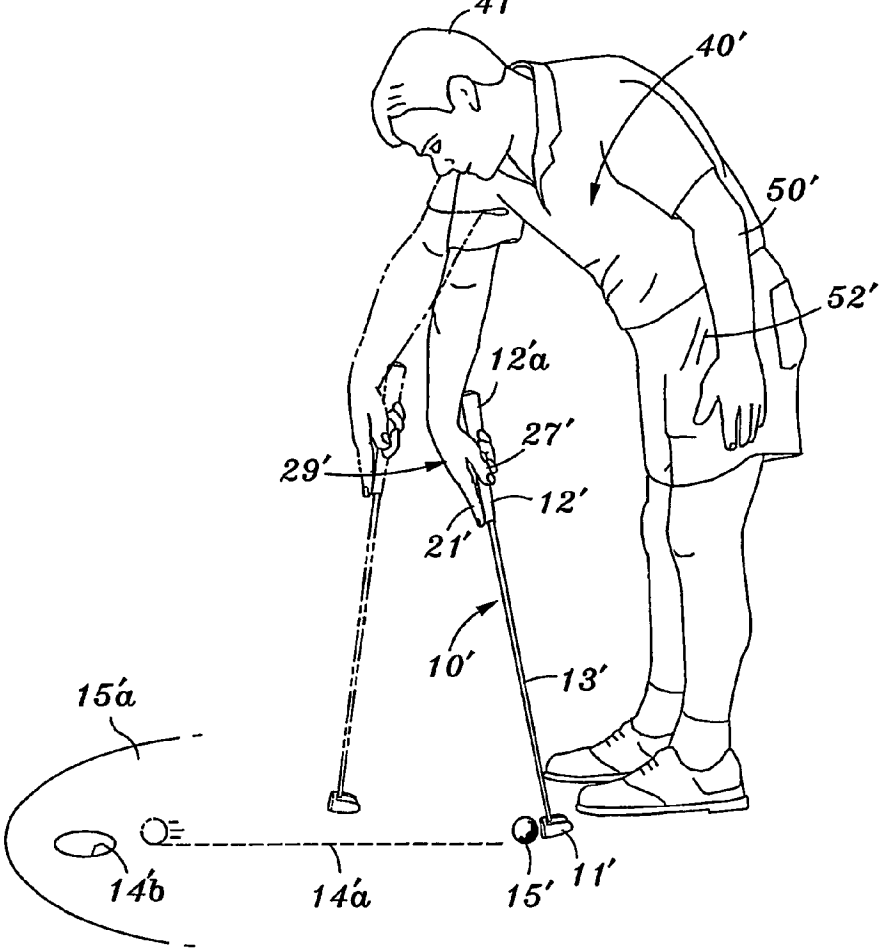

FIG. 4' is side view similar to that of FIG. 3' illustrating the putter moved from the end of the backstroke to striking the ball shown in solid lines, with the end of the follow-through stroke shown in dotted lines.

Figures 5, 6, 7:
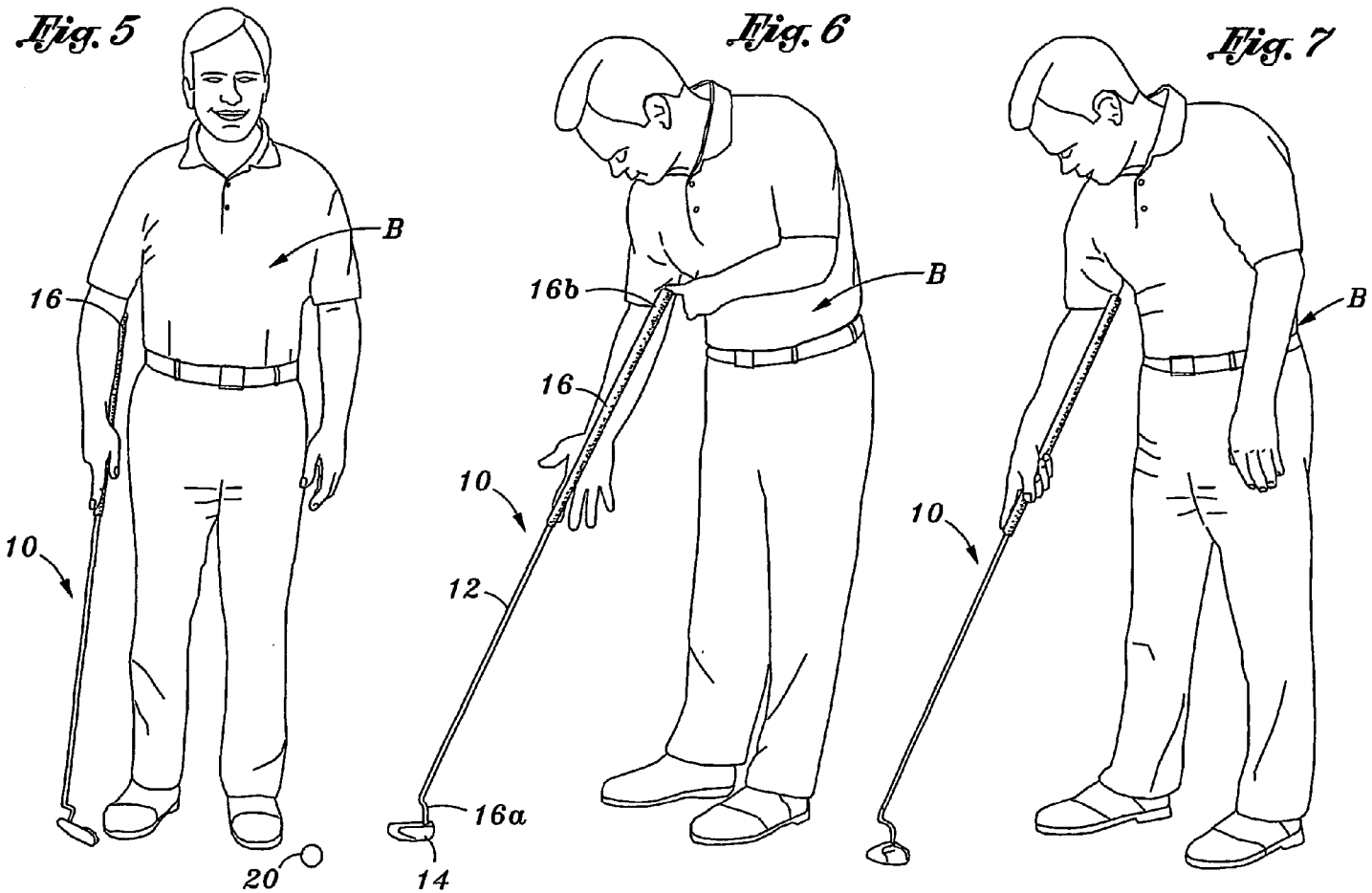

FIG. 5'A is a front view of the open right hand of the golfer illustrating the position the grip of the putter is placed in the palm of the right hand of the golfer.

FIG. 5'B is a front view illustrating the position of the right hand of the golfer as it grasps the grip of the putter.

FIG. 6'A is a side view elevation view taken along line 6'A—6'A of FIG. 5'B.

FIG. 6'B is a front view illustrating the position of the right hand of the golfer as it grasps the grip of the putter.

Figure 7:
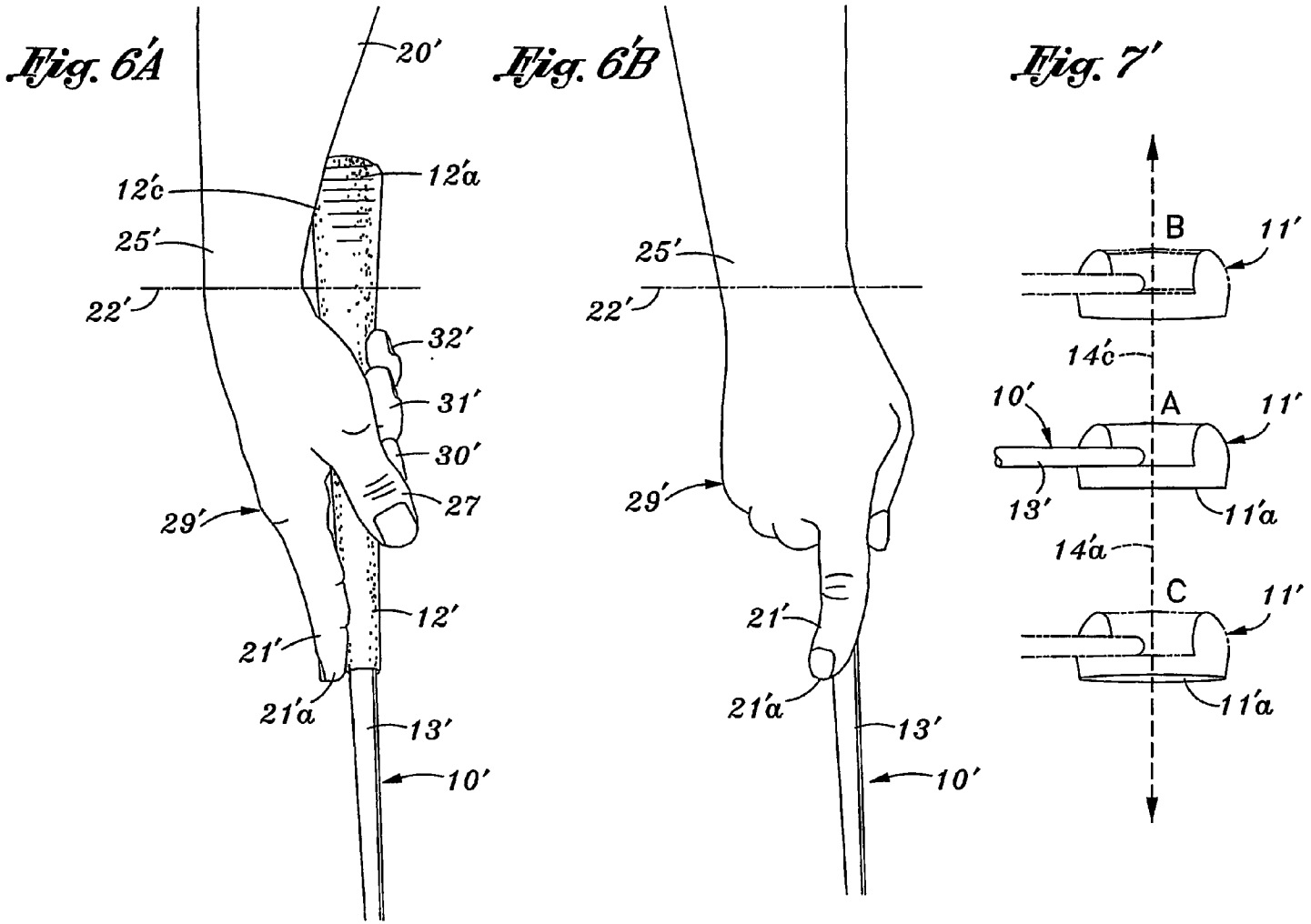
Figures 1, 7B:
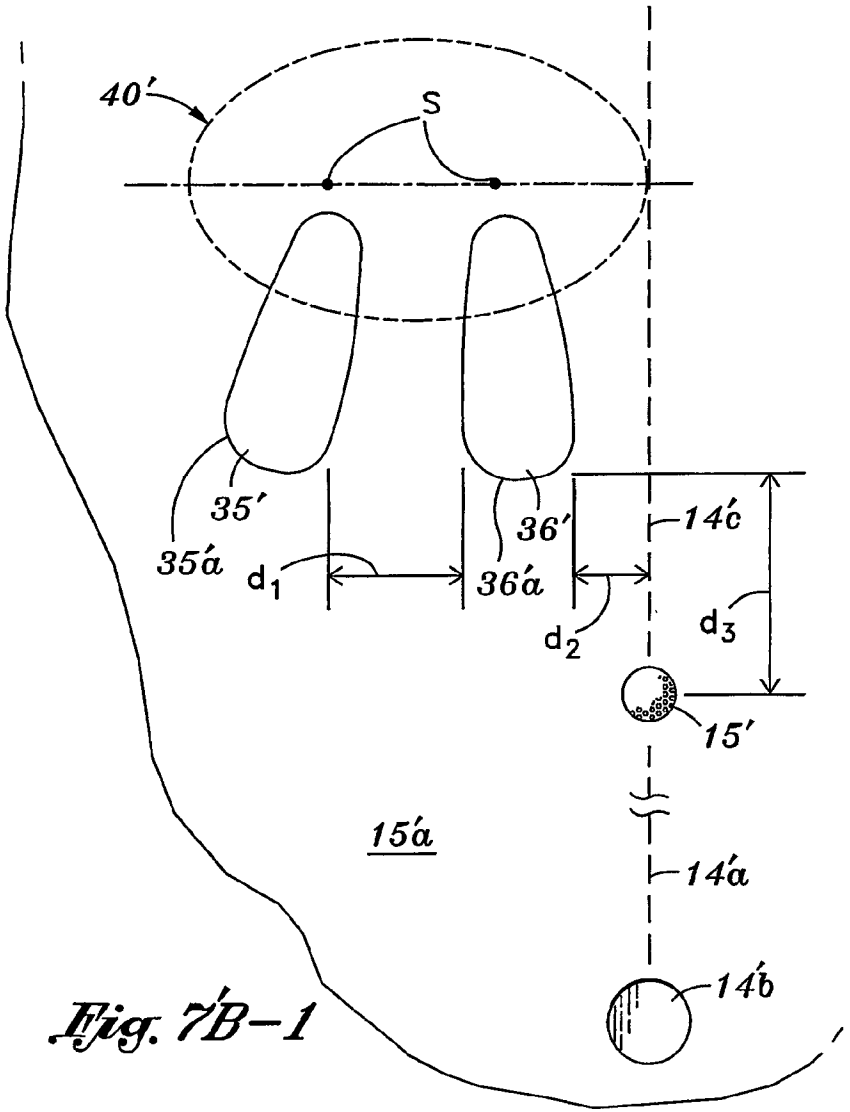

FIG. 7' is a plan view looking down on the putter head showing the putter head in different positions as it moves through the putting stroke.

FIG. 7'A is a frontal view of the golfer illustrating the beginning of one stance showing the initial body position relative to the ball.

FIG. 7'B is a bird's eye view schematically illustrating a first stance depicting the feet position relative to the ball and turning the upper torso of the body of the golfer towards the target line.

FIG. 7'B-1 is a bird's eye view schematically illustrating a second stance depicting the feet position relative to the ball and positioning the upper torso of the body of the golfer so that the golfer's shoulders are at a right angle to the target line.

FIG. 7'C is a perspective view of the golfer illustrating a third stance.

FIG. 7'D is a bird's eye view schematically illustrating the third stance shown in FIG. 7'C depicting turning the upper torso of the body of the golfer towards the target line and both feet turned towards the target line FIG. 7'E is a side view of the golfer illustrating the stance shown in FIGS. 7'C and 7'D.

FIG. 7'F is a frontal view of the golfer using a crooked elbow address.

FIG. 7'G is a side view of the golfer illustrating the crooked elbow address shown in FIG. 7'F.

FIG. 7'H is a side view of the golfer addressing the ball with his crooked right elbow so that this elbow serves as the pivot point of a forward stroke.

FIG. 7'I is a side view of the golfer in a follow-through stroke with his crooked right elbow and this elbow serving as the pivot point of a forward stroke.

Figure 8:
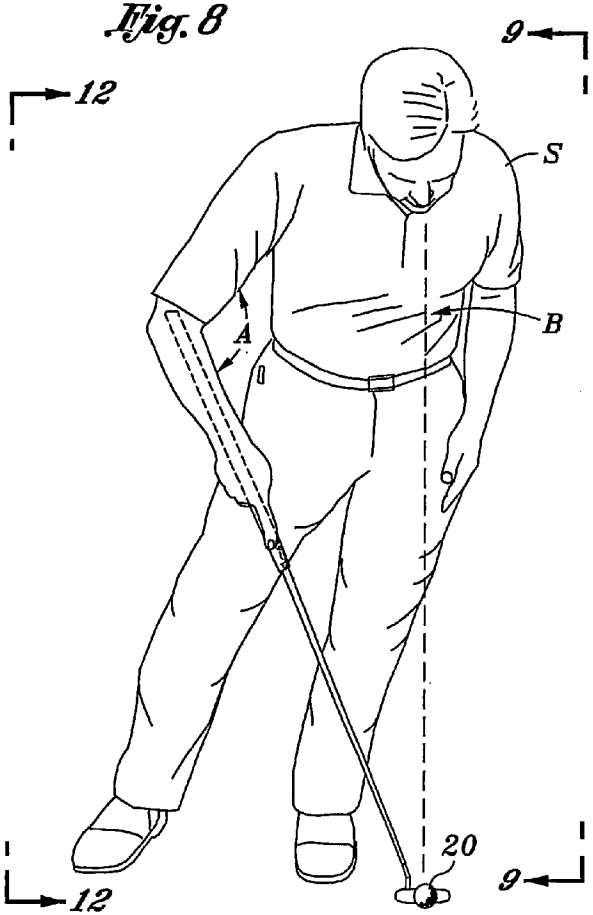

FIG. 8'A is a side view of the head of the golfer looking along the target line as the golfer addresses the ball.

FIG. 8'B is a front view elevation view taken along line 8'B—8'B of FIG. 8'A.

FIG. 8'C is a side view of the head of the golfer looking down at the ball or putter face, or alternatively looking down the target line, as the golfer addresses the ball.

Figures 9, 10, 11, 12:
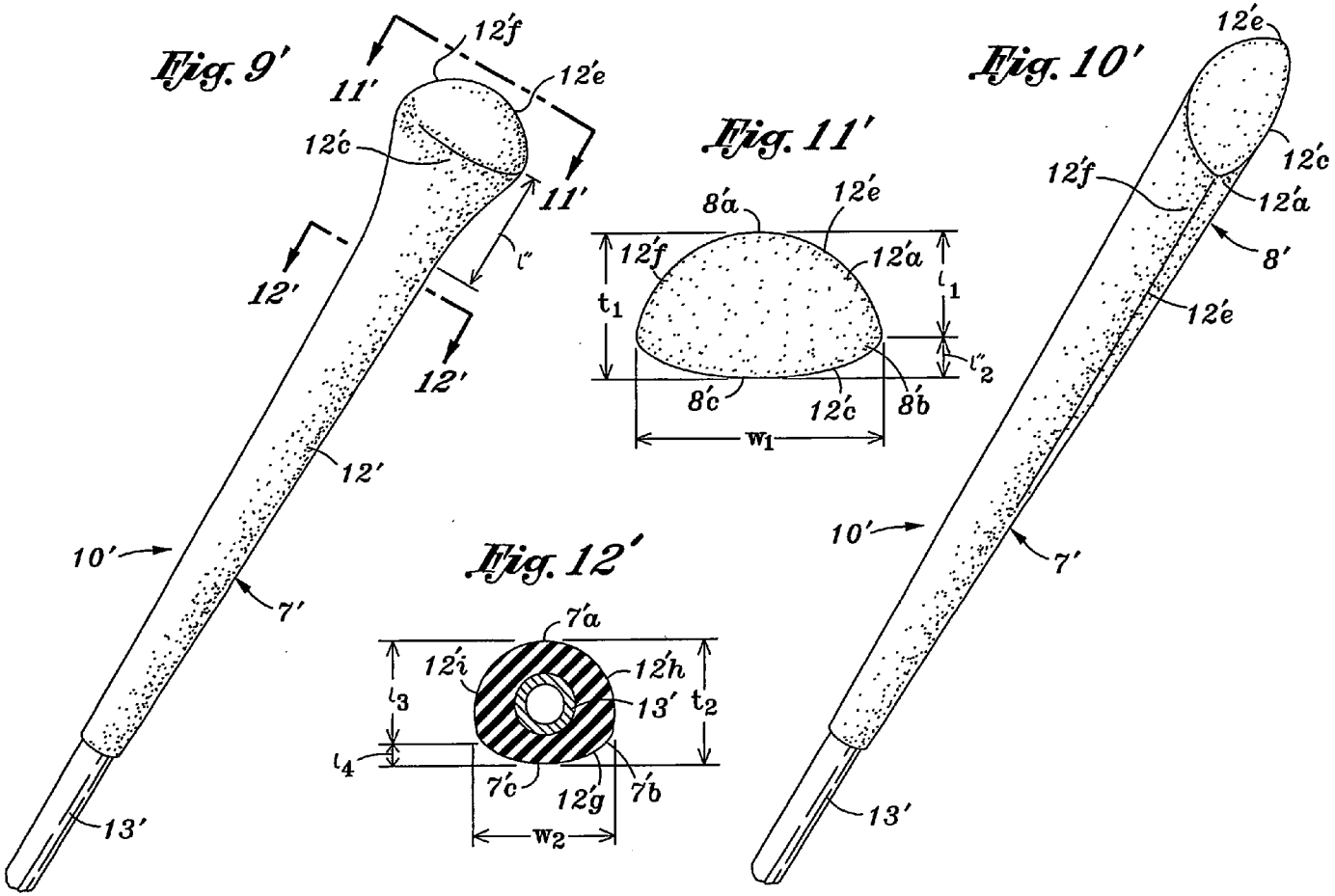

FIG. 9' is a perspective view of the grip of a putter used by a right-handed golfer shown in FIG. 9'A, with the side that is placed against the forearm facing outward.

FIG. 9'A is a perspective view of the same putter used in the one-hand and arm putting method of this invention.

FIG. 9'B is an enlarged, fragmentary side view showing the position of the putter head when addressing the ball.

FIG. 10' is a perspective view of the grip of the putter shown in FIGS. 9' and 9'A, with the side that is placed against the forearm facing to the right side.

FIG. 11' is a plan view taken along line 11'—11' of FIG. 9'.

FIG. 12' is a cross-sectional view taken along line 12'—12' of FIG. 9'.

A SECOND EMBODIMENT FIGURES

FIG. 1 is a side elevation view of the long putter of this invention with the face of the putter off-set behind the downward extension of the shaft through the use of a hosel used in performing the putting method of this invention.

Figure 1B:
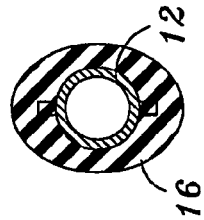
Figure 1A:
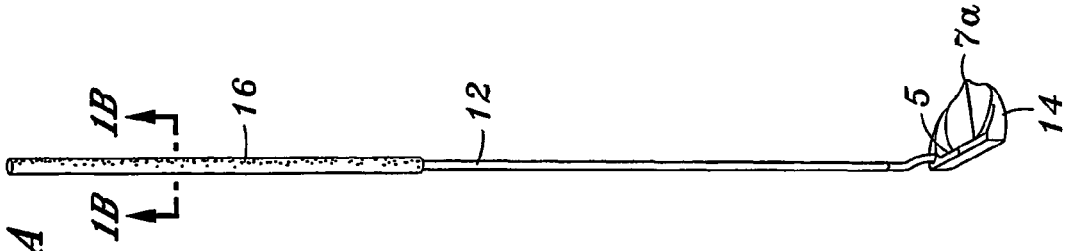
Figure 1:
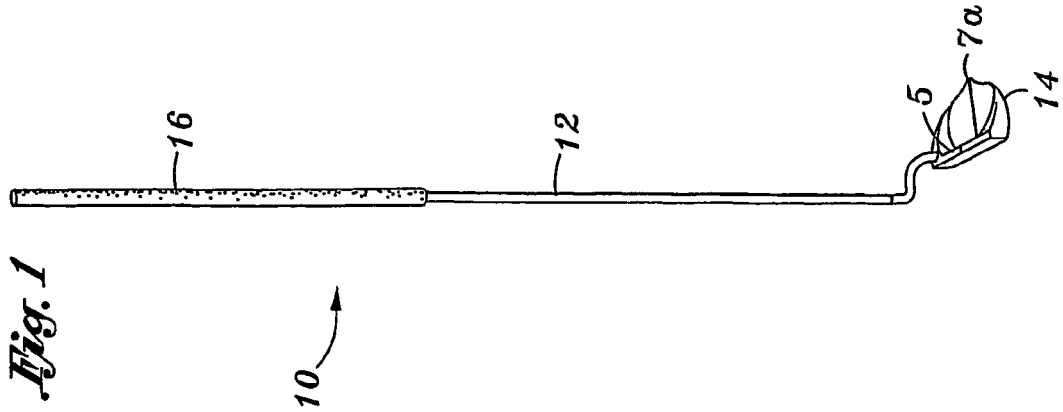
Figure 4:
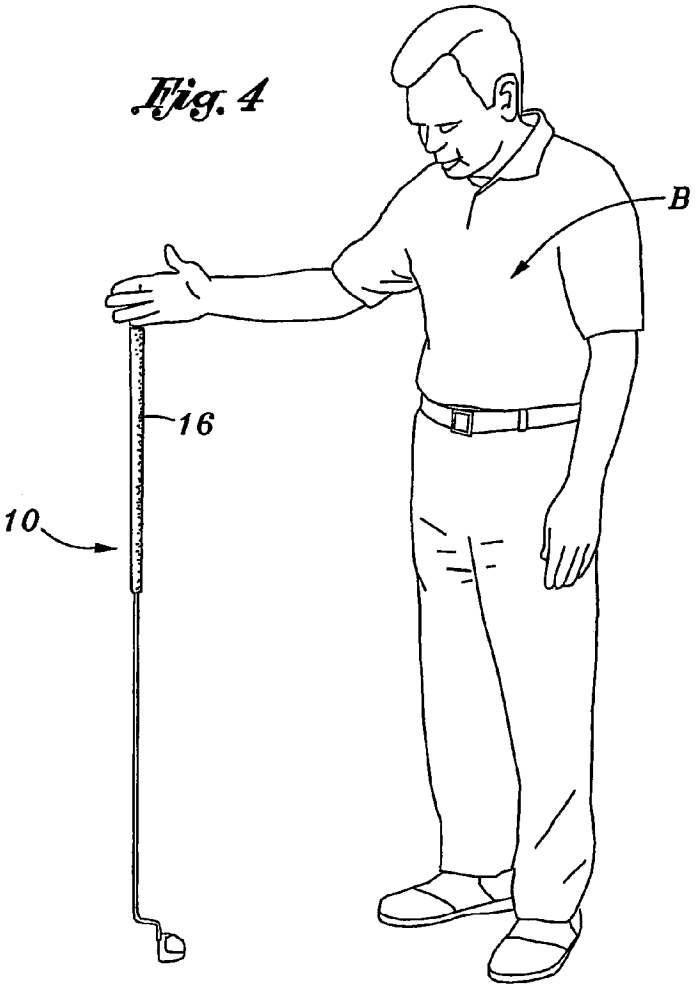

FIG. 1A is a side elevation view of the long putter of this invention with the face of the putter about in-line with the downward extension of the shaft through the use of a hosel used in performing the putting method of this invention.

FIG. 1B is a fragmentary cross section view of the elliptical grip at line 1*b* in FIG. 1A.

FIG. 2 is an enlarged, fragmentary perspective view of the head of the putter shown in FIG. 1.

FIG. 2A is an enlarged fragmentary perspective view of the top of the putter head shown in FIG. 1 showing the two lines dissecting the head in two parts. Line 14*a* is a line on top of the sole of the putter head and line 14*b* is a line on the top edge of the putter face, which is about one inch vertically higher than line 14*a*.

FIG. 2B is an enlarged, fragmentary perspective view of the head of the putter shown in FIG. 1A.

FIG. 3 is a cross-sectional view taken along line 3—3 of FIG. 2 showing the face of the putter off-set behind the extension of the shaft up to one and one quarter inches by the use of a hosel between the lower end of the shaft and the putter head.

Figure 3:
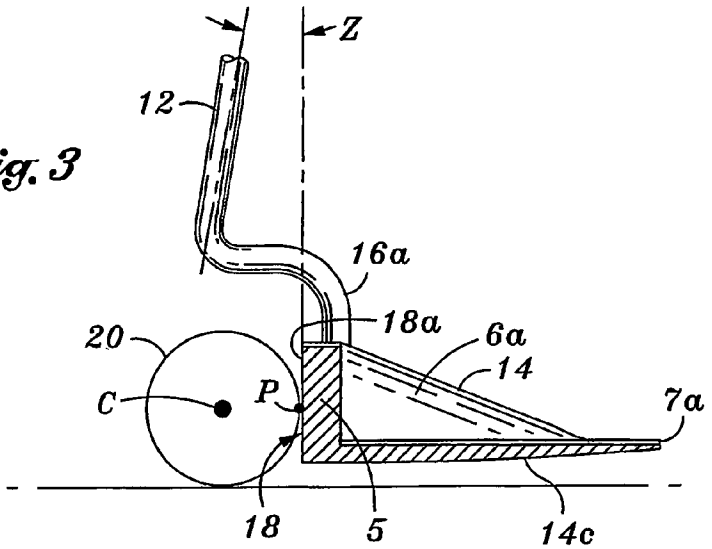
Figure 3A:
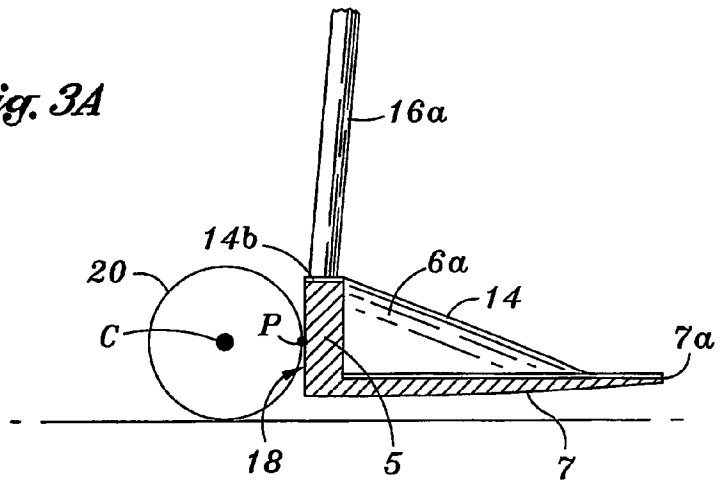

FIG. 3A is a cross-sectional view taken along line 3A—3A of FIG. 2B showing the face of the putter about in-line with the downward extension of the shaft by use of a hosel between the lower end of the shaft and the putter head.

Figure 3B:
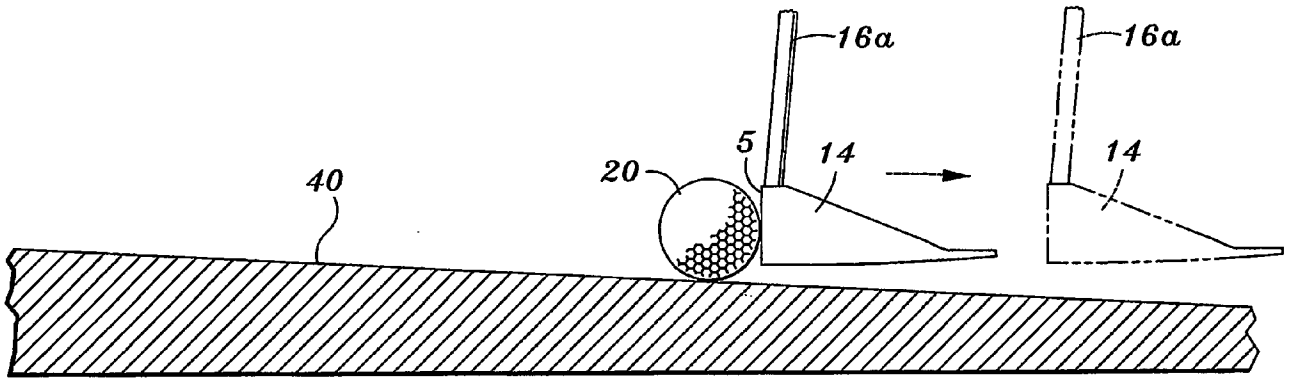

FIG. 3B is a side elevation view of the putter being moved rearward during the backstroke.

Figure 3C:
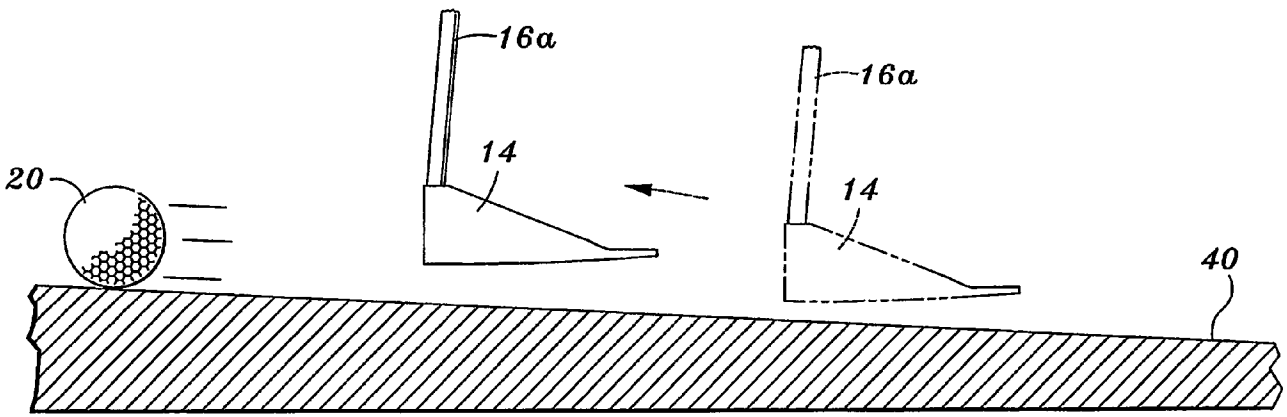

FIG. 3C is a side elevational view of the putter being moved forward during the follow-through stroke.

FIG. 4 is a view of the putter shown in FIG. 1 vertically supported on a green by a golfer, showing that the shaft is above the waist of the golfer with the head of the putter resting on the surface of the green.

FIG. 5 is a front elevation view of the golfer standing on the green directly facing the hole and holding the putter shown in FIG. 1 in his right hand, with the ball next to his left toe.

FIG. 6 is a side view of the golfer positioning the grip of the putter shown in FIG. 1 in his open right hand with the lower portion of the grip laying over the center of the palm and up the center of the forearm with the proximal end of the shaft resting against the underside of the lower portion of his upper right arm.

Figures 6A, 6B, 6C:
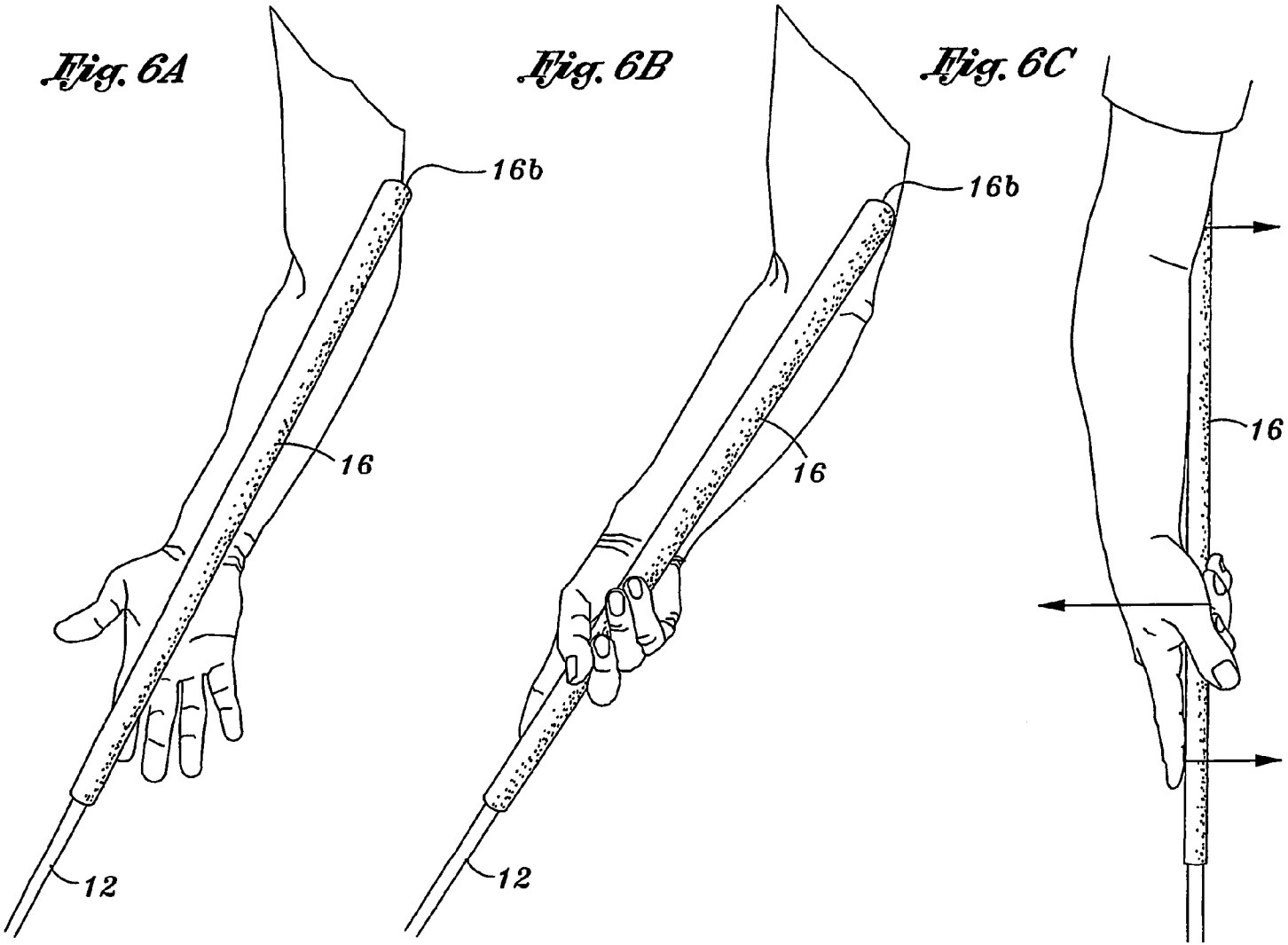

FIG. 6A is an enlarged fragmentary perspective view of FIG. 6 open hand position.

FIG. 6B is an enlarged fragmentary perspective view of FIG. 6 with the golfer's fingers closed around the grip.

FIG. 6C is a side view of an enlarged fragmentary perspective of FIG. 6 with the golfer's fingers closed around the grip.

Figures 6D, 6E, 6F:
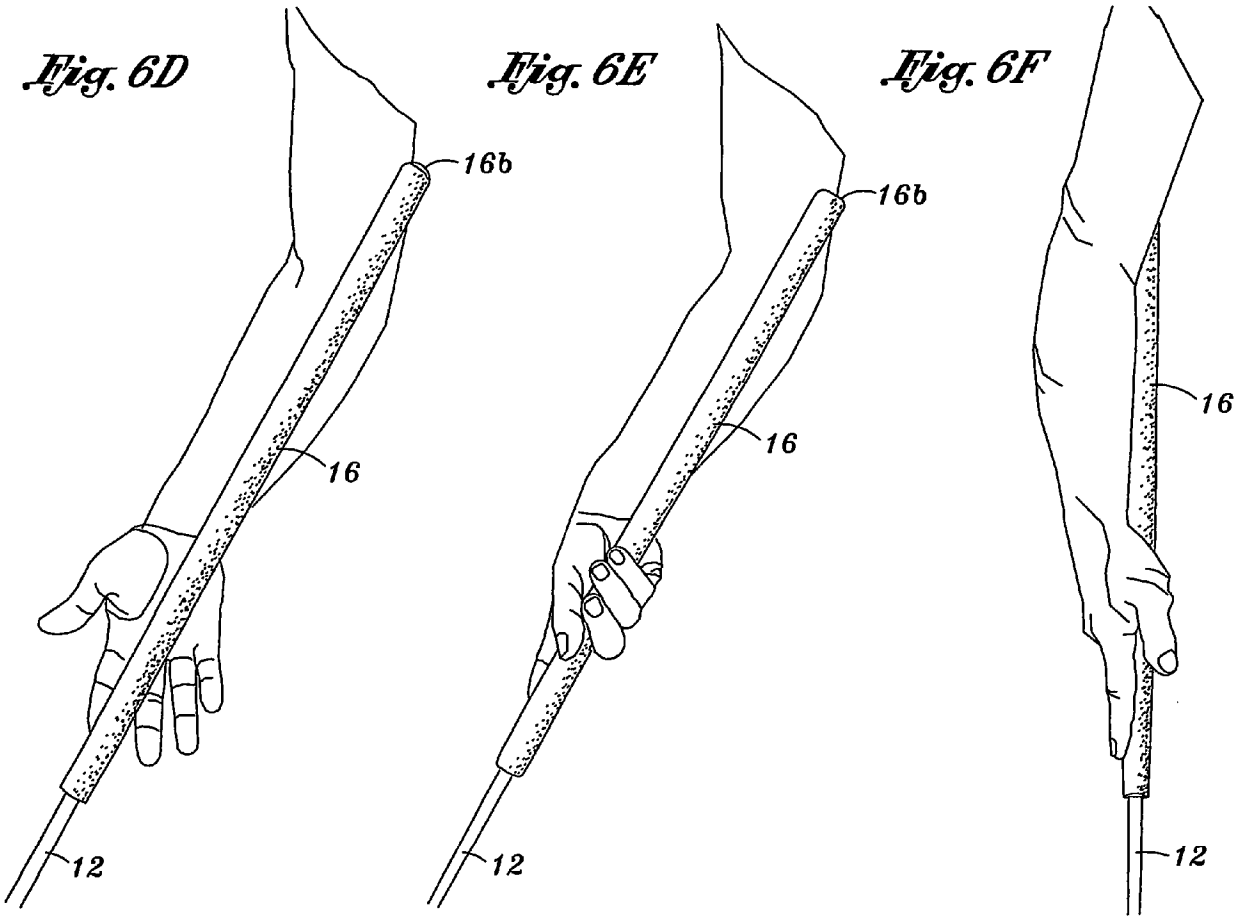

FIG. 6D is an enlarged fragmentary perspective view of FIG. 6 of the golfer positioning the grip of the putter in his open right hand with the lower portion of the grip laying across the lower portion of the palm to the heel of the palm and up the lower portion of the underside forearm with the proximal end of the shaft resting against the underside of the lower portion of his upper right arm.

FIG. 6E is the same enlarged fragmentary perspective view as 6D with the golfer's fingers closed around the grip.

FIG. 6F is a side view of the same enlarged fragmentary perspective as FIG. 6E.

Figure 6G:
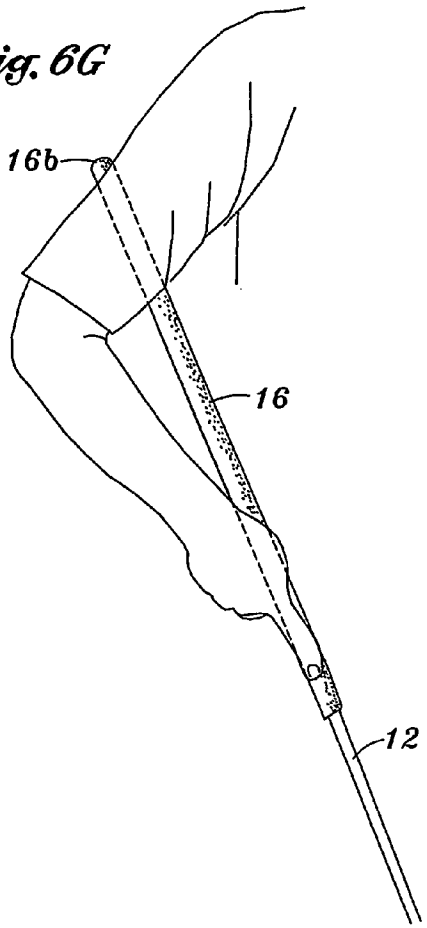
Figure 9:
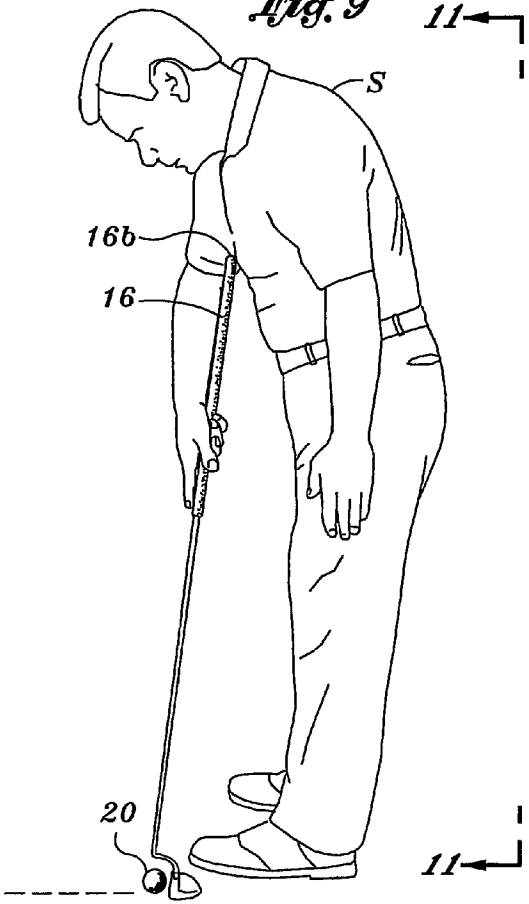

FIG. 6G is an enlarged fragmentary perspective view of FIG. 8 except that the proximal end of the shaft rests against the mid-bicep region of the golfer's upper right arm.

FIG. 7 is a view similar to that shown in FIG. 6 with the golfer's fingers closed around the grip and the front side of the grip lying against the underside of his right hand, wrist elbow and upper arm.

FIG. 8 is a front view of the golfer with his right arm across the front of his body as he addresses the ball. The golfer's eyes are vertically over the target line.

FIG. 9 is a left side elevation view taken along line 9—9 of FIG. 8 showing the inclined angle of the shaft using the offset putter design FIGS. 1 and 2.

Figure 9A:
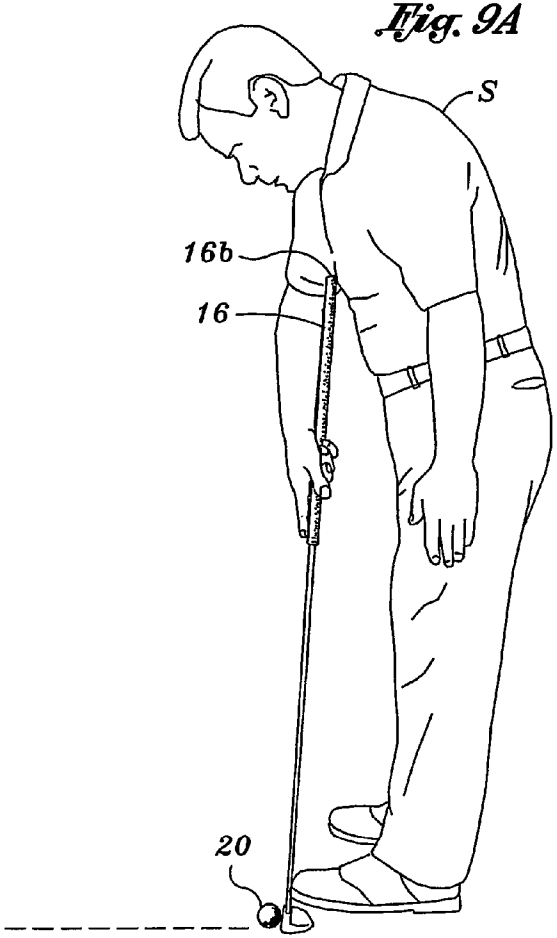

FIG. 9A is the same side elevation view as FIG. 9, showing the near vertical angle of the shaft using the near in-line putter design FIGS. 1A and 2B.

Figure 9D:
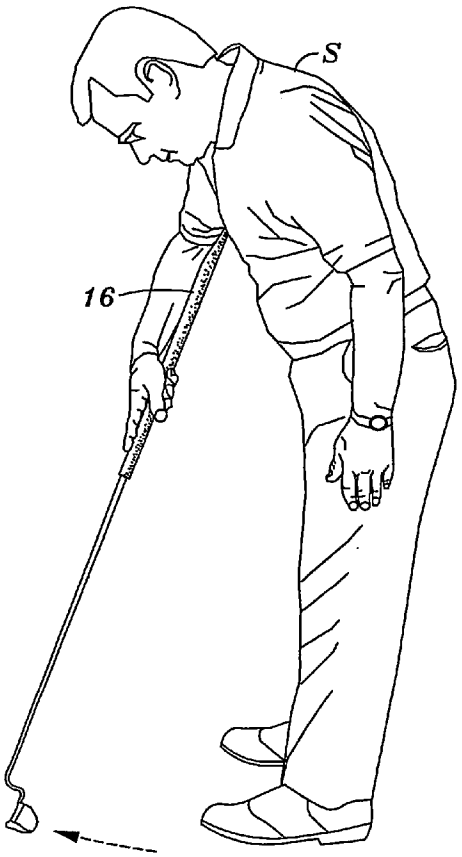
Figure 9C:
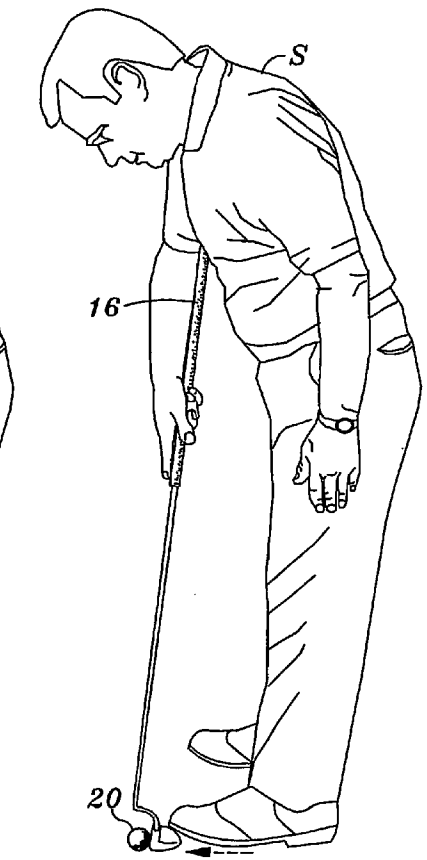
Figure 9B:
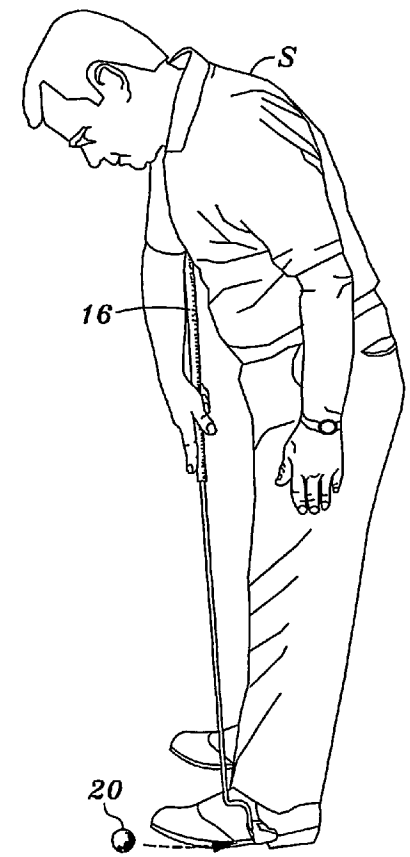
Figures 10, 11, 12:
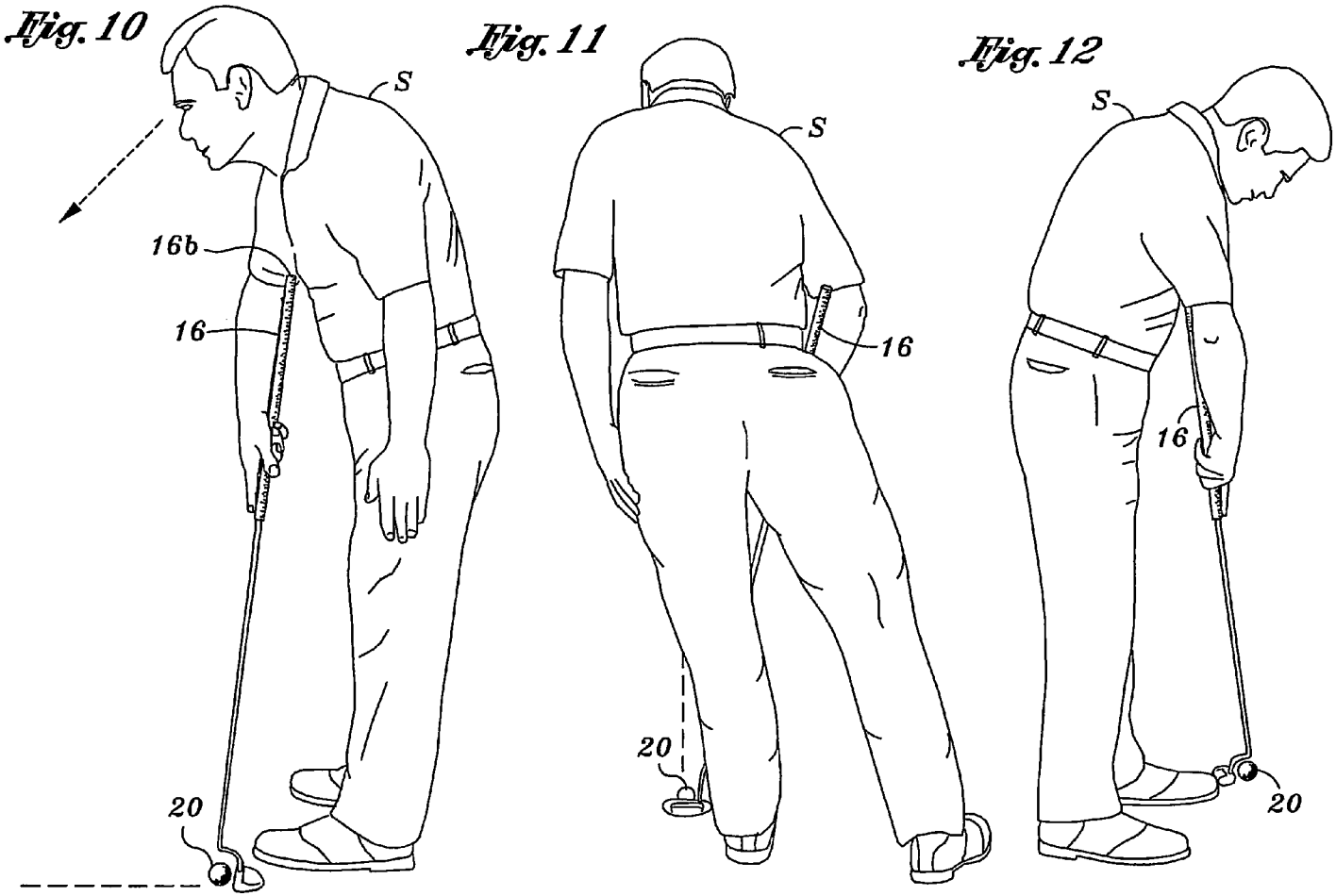

FIG. 9B is a left side elevation view similar to that shown in FIG. 9 except the putter head is at the end of the backstroke.

FIG. 9C is a left side elevation similar to that shown in FIG. 9 except the putter head is in the forward stroke striking the ball.

FIG. 9D is a left side elevation view similar to that shown in FIG. 9 except the golfer is at the end of the follow-through stroke.

FIG. 10 is a side elevation view similar to that shown in FIG. 9 except the golfer has raised his head to look down the target line.

FIG. 11 is a rear view of the golfer in the same position as that shown in FIG. 8.

FIG. 12 is right side elevation view of the address position taken along line 12—12 of FIG. 8.

Figure 12B:
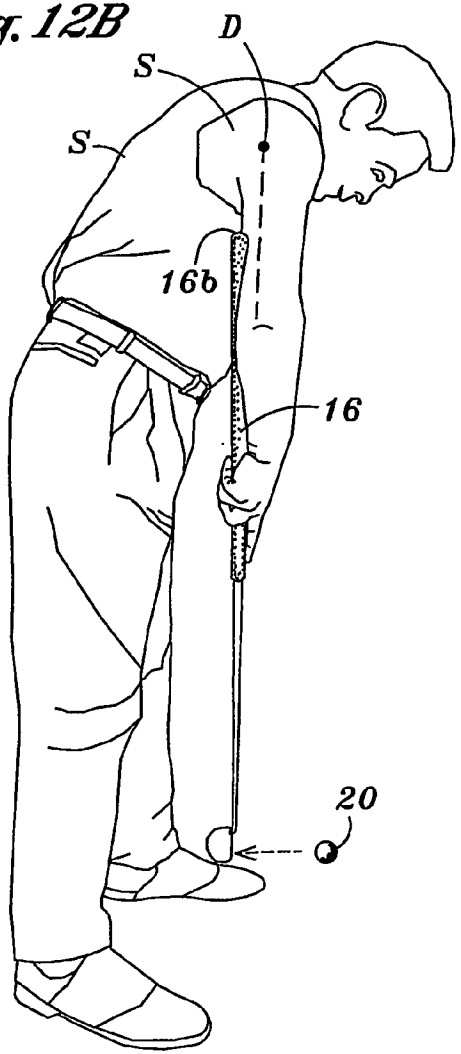
Figure 12A:
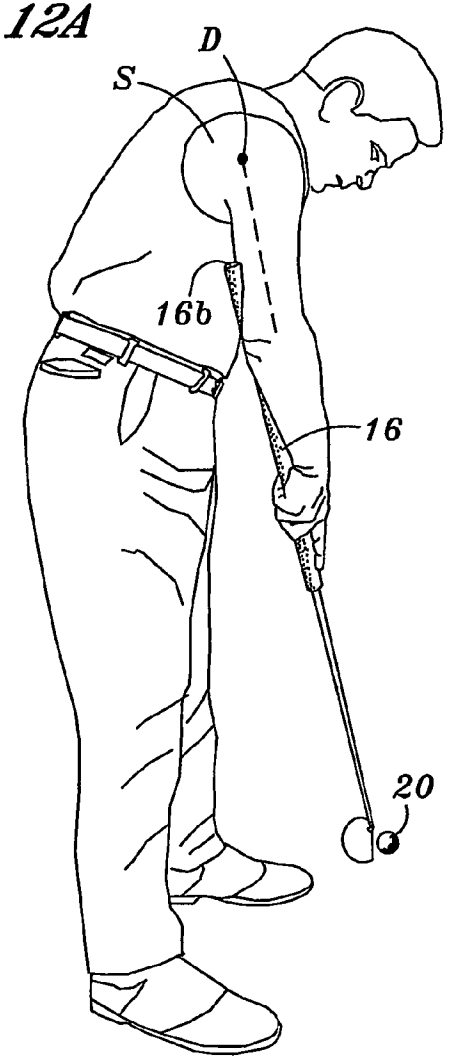
Figure 12D:
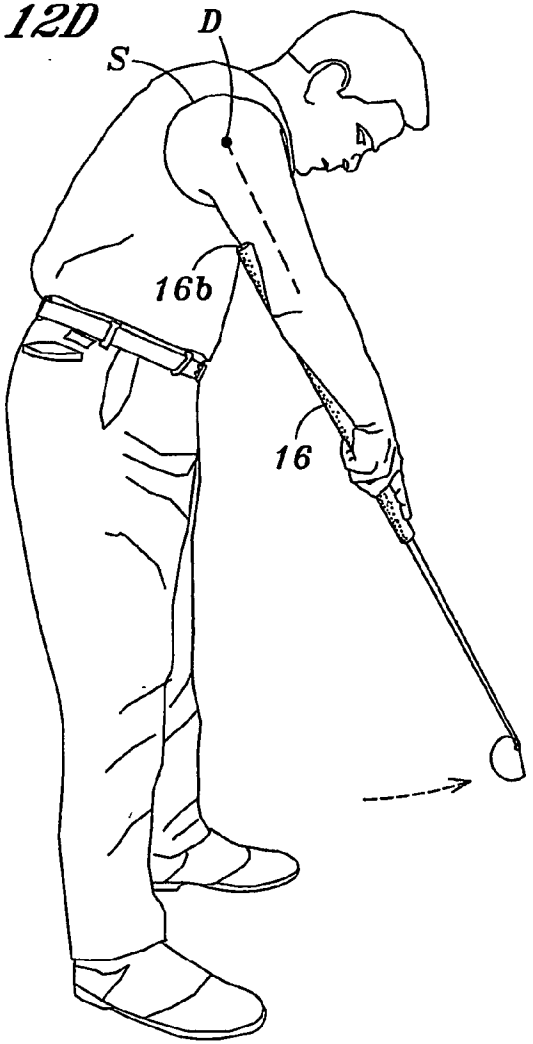
Figure 12C:
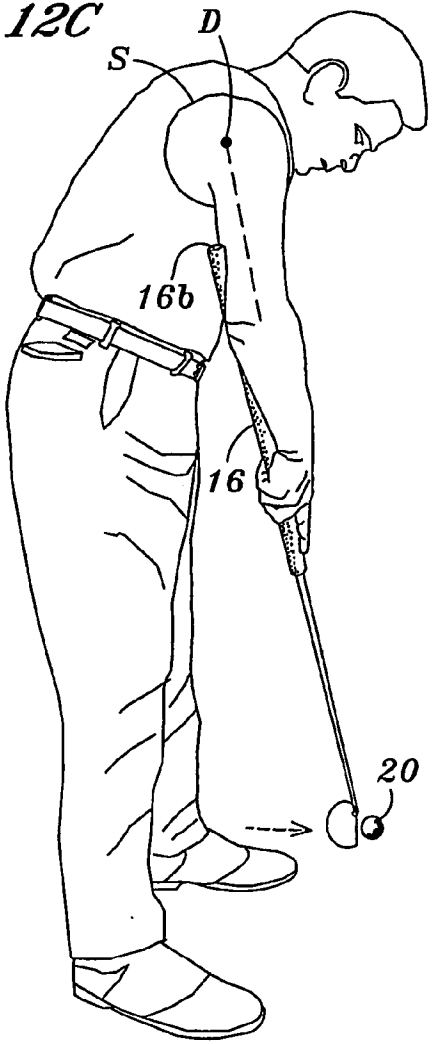
Figure 12F:
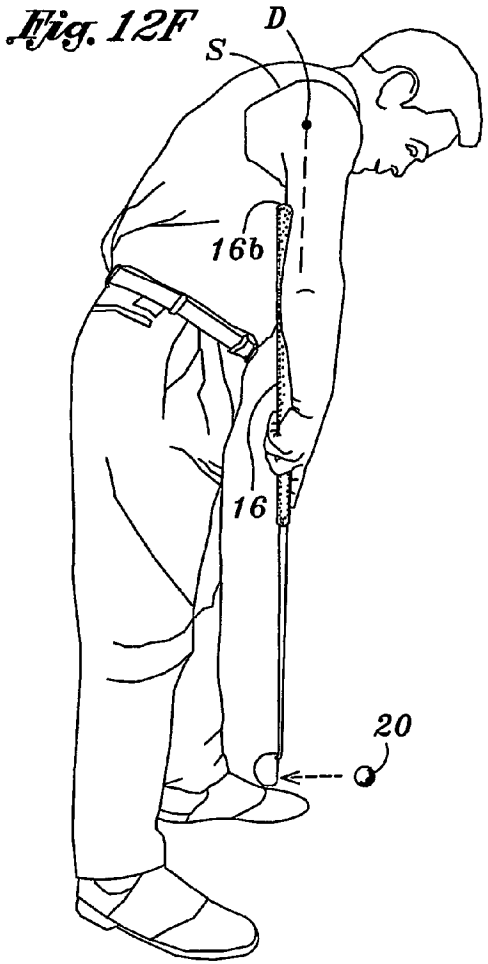
Figure 12E:
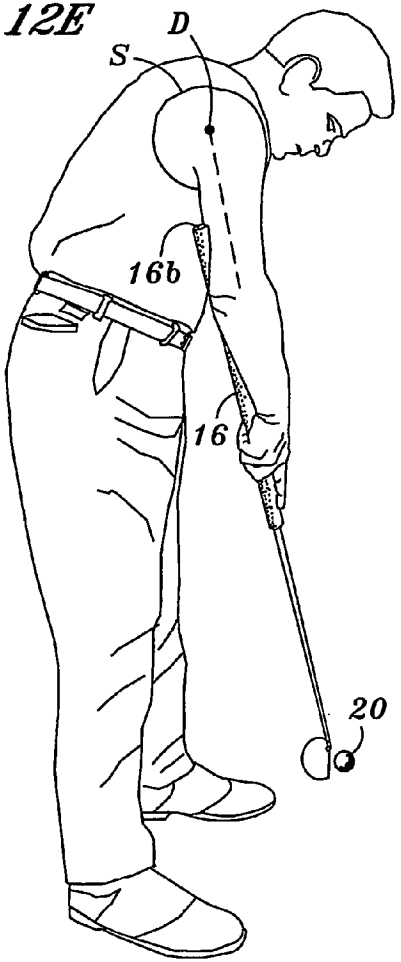
Figure 12H:
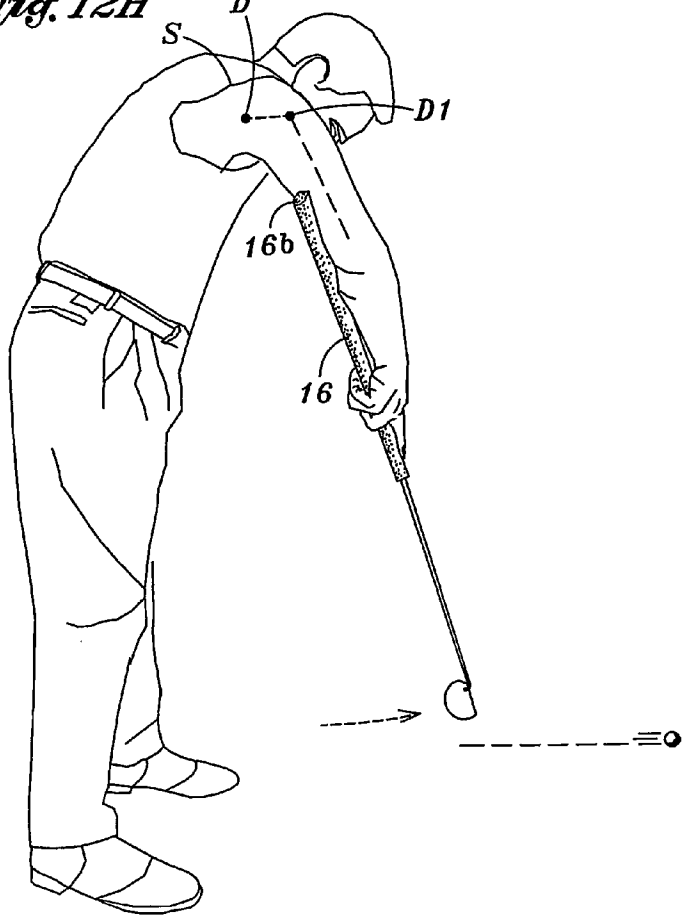
Figure 12G:
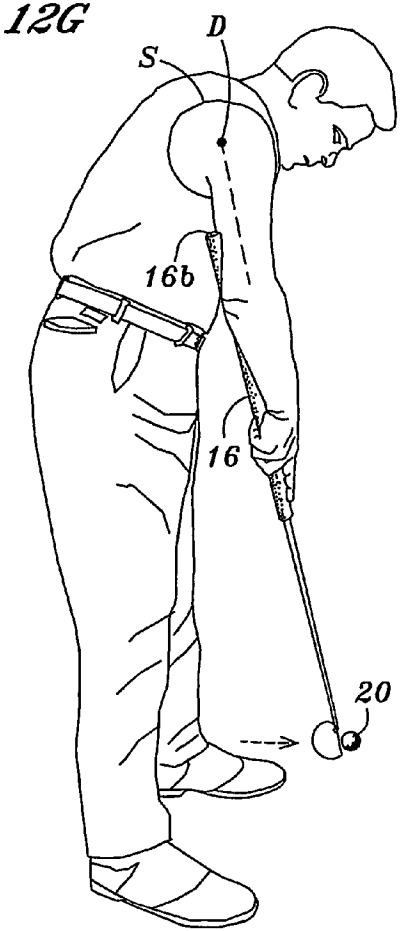
Figure 12J:
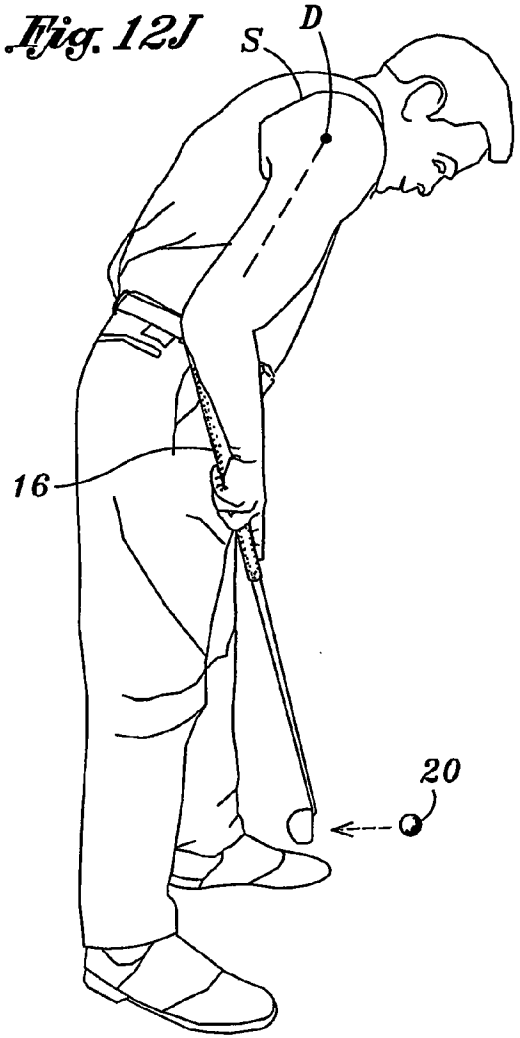
Figure 12I:
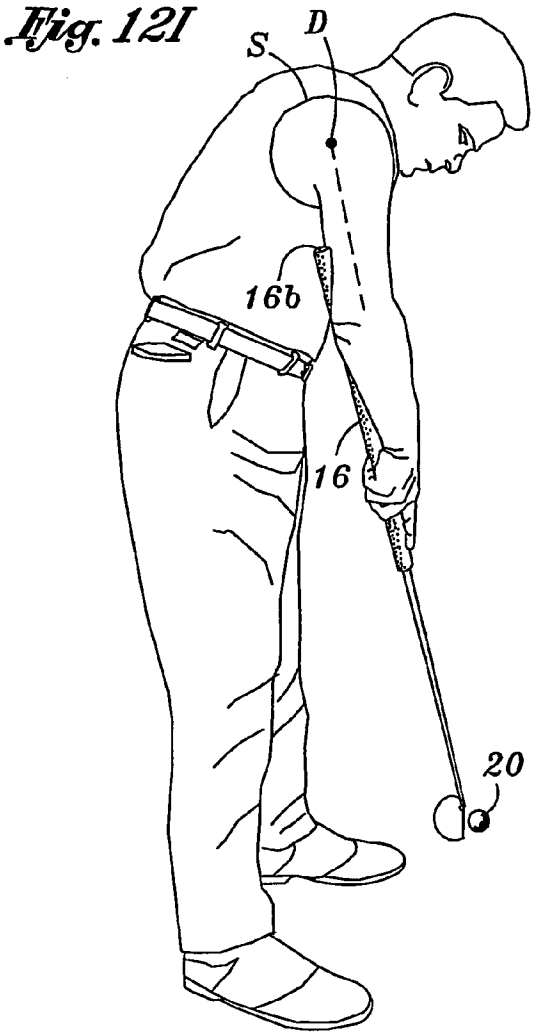
Figure 12L:
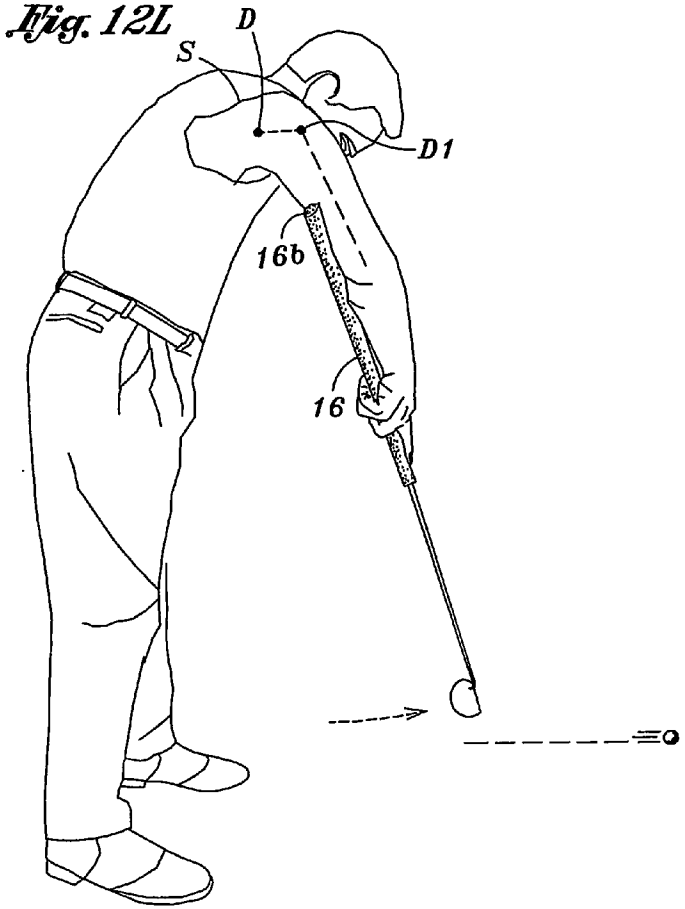
Figure 12K:
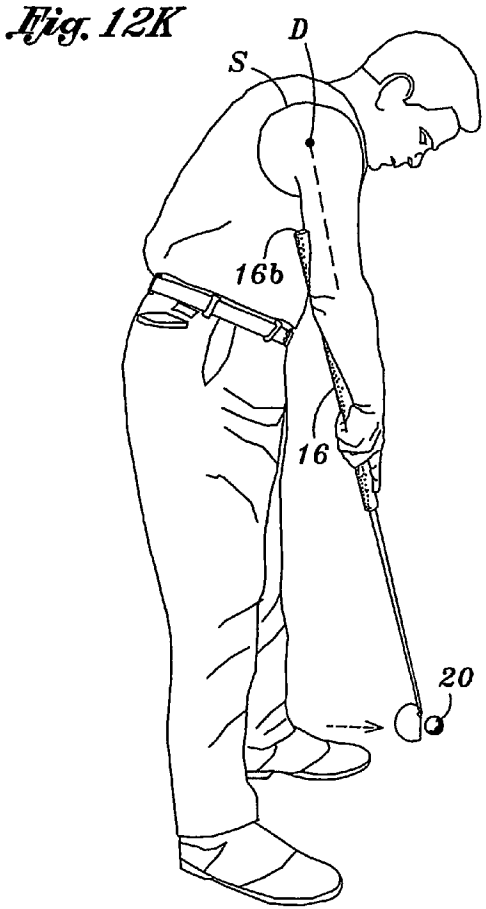
Figure 12N:
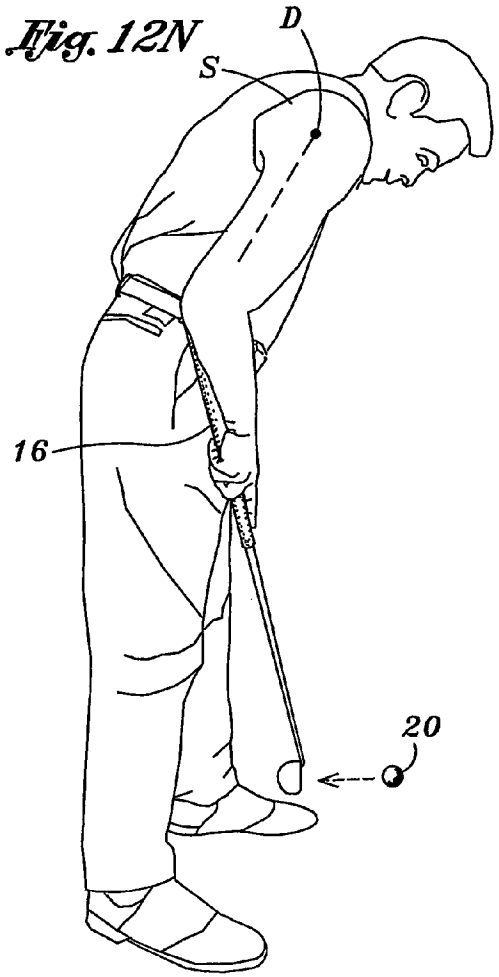
Figure 12M:
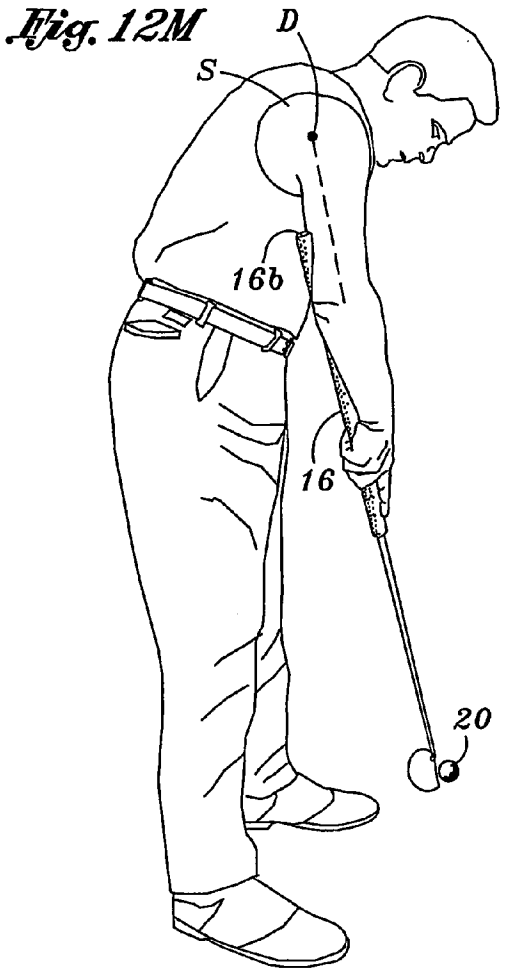
Figures 12O, 12P, 12Q:
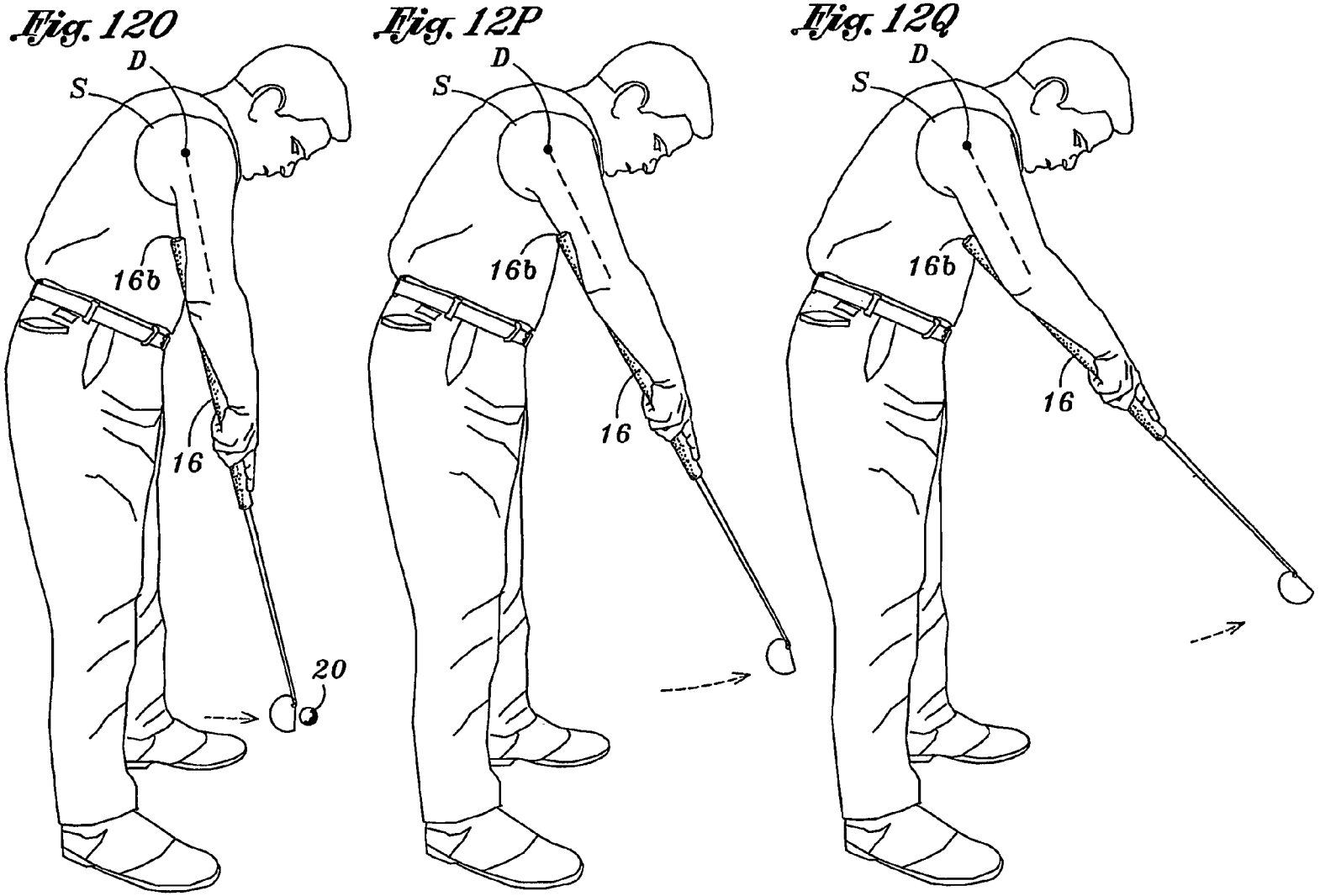

FIGS. 12A through 12Q are the same right side elevation view as FIG. 12.

FIG. 12A shows the address, 12B shows the end of backstroke, 12C shows the end of the forward stroke when the putter strikes the ball and 12D shows the end of the follow-through stroke, for one style of stroke used in this invention, called the "Pendulum-Pendulum Stroke".

FIG. 12A shows the position of the shoulder pivot point, (marked on the shoulder with a small black dot), the center of the humerus bone (marked by dashed lines) and the location of the hand-wrist-arm-elbow configuration, all at the address.

FIG. 12B shows the position of the shoulder pivot point, (marked on the shoulder with a small black dot), the center of the humerus bone (marked by dashed lines) and the location of the hand-wrist-arm-elbow configuration, all at the end of the backstroke.

FIG. 12C shows the position of the shoulder pivot point (marked on the shoulder with a small black dot), the center of the humerus bone (marked by dashed lines) and the location of the hand-wrist-arm-elbow configuration, all at the end of the forward stroke when the putter face strikes the ball.

FIG. 12D shows the position of the shoulder pivot point (marked on the shoulder with a small black dot), the center of the humerus bone (marked by dashed lines) and the location of the hand-wrist-arm-elbow configuration, all at the end of the follow-through stroke.

FIGS. 12E shows the address, 12F shows the end of backstroke, 12G shows the end of the forward stroke when the putter strikes the ball and 12H shows the end of the follow-through stroke, for one style of stroke used in this invention, called the "Pendulum-Scapular Stroke".

FIG. 12E shows the position of the shoulder pivot point, (marked on the shoulder with a small black dot), the center of the humerus bone (marked by dashed lines) and the location of the hand-wrist-arm-elbow configuration, all at the address.

FIG. 12F shows the position of the shoulder pivot point, (marked on the shoulder with a small black dot), the center of the humerus bone (marked by dashed lines) and the location of the hand-wrist-arm-elbow configuration, all at the end of the backstroke.

FIG. 12G shows the position of the shoulder pivot point (marked on the shoulder with a small black dot), the center of the humerus bone (marked by dashed lines) and the location of the hand-wrist-arm-elbow configuration, all at the end of the forward stroke when the putter face strikes the ball.

FIG. 12H shows the forward movement of the shoulder pivot point in relation to the shoulder pivot point during the address FIG. 12E, backstroke FIG. 12F and forward stroke FIG. 12G (marked on the shoulder by two black dots); the back black dot refers to the position of the shoulder pivot point at the end of the forward stroke and the forward black dot refers to the position of the shoulder pivot point at the end of the follow-through stroke; the forward movement of the center of the humerus bone, (marked by dash lines) in relation to the location of the humerus bone (marked by dash lines) in FIG. 12G; and the location of the hand-wrist-arm-elbow configuration, all at the end of the follow-through stroke.

FIG. 12I shows the address, FIG. 12J shows the end of backstroke, FIG. 12K shows the end of the forward stroke when the putter strikes the ball and FIG. 12L shows the end of the follow-through stroke, for one style of stroke used in this invention, called the "Linear-Scapular Stroke".

FIG. 12I shows the position of the shoulder pivot point, (marked on the shoulder with a small black dot), the center of the humerus bone (marked by dashed lines) and the location of the hand-wrist-arm-elbow configuration, all at the address.

FIG. 12J shows the position of the shoulder pivot point, (marked on the shoulder with a small black dot), the center of the humerus bone (marked by dashed lines) and the linear backward movement of the crooked elbow all at the end of the backstroke.

FIG. 12K shows the position of the shoulder pivot point, (marked on the shoulder with a small black dot), the center of the humerus bone (marked by dashed lines) and the location of the hand-wrist-arm-elbow configuration, all at the end of the forward stroke when the putter face strikes the ball.

FIG. 12L shows the forward movement of the shoulder pivot point in relation to the shoulder pivot point during the address FIG. 12I, backstroke FIG. 12J and forward stroke FIG. 12K (marked on the shoulder by two black dots); the back black dot refers to the position of the shoulder pivot point at the end of the forward stroke FIG. 12K and the forward black dot refers to the position of the shoulder pivot point at the end of the follow-through stroke; the forward movement of the center of the humerus bone, (marked by dash lines) in relation to the location of the humerus bone (marked by dash lines) in FIG. 12K, and the location of the hand-wrist-arm-elbow configuration, all at the end of the follow-through stroke.

FIGS. 12M shows the address, 12N shows the end of backstroke, 12O shows the end of the forward stroke when the putter strikes the ball and 12P shows the end of the follow-through stroke, for one style of stroke used in this invention, called the "Linear-Pendulum Stroke".

FIG. 12M shows the position of the shoulder pivot point, (marked on the shoulder with a small black dot), the center of the humerus bone (marked by dashed lines) and the location of the hand-wrist-arm-elbow configuration, all at the address.

FIG. 12N shows the position of the shoulder pivot point, (marked on the shoulder with a small black dot), the center of the humerus bone (marked by dashed lines) and the linear backward movement of the crooked elbow all at the end of the backstroke.

FIG. 12O shows the position of the shoulder pivot point, (marked on the shoulder with a small black dot), the center of the humerus bone (marked by dashed lines) and the location of the hand-wrist-arm-elbow configuration, all at the end of the forward stroke when the putter face strikes the ball.

FIG. 12P shows the position of the shoulder pivot point (marked on the shoulder with a small black dot), the center of the humerus bone (marked by dashed lines) and the location of the hand-wrist-arm-elbow configuration, all at the end of the follow-through stroke.

FIG. 12Q is the same as FIG. 12P, except the forearm and putter have swung forward from the elbow pivot point.

Figure 13:
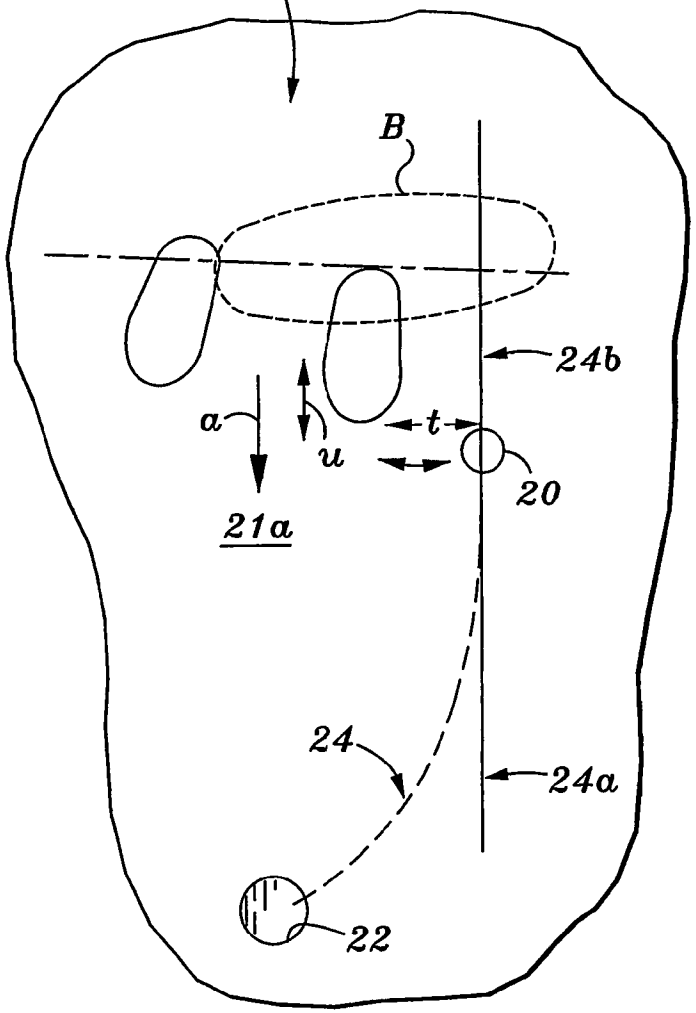

FIG. 13 is an overhead view diagram showing the position of the golfer's feet and body relative to the ball, the target line and the line of putt of the ball.

A THIRD EMBODIMENT FIGURES

Figures 14A, 14B, 14C:
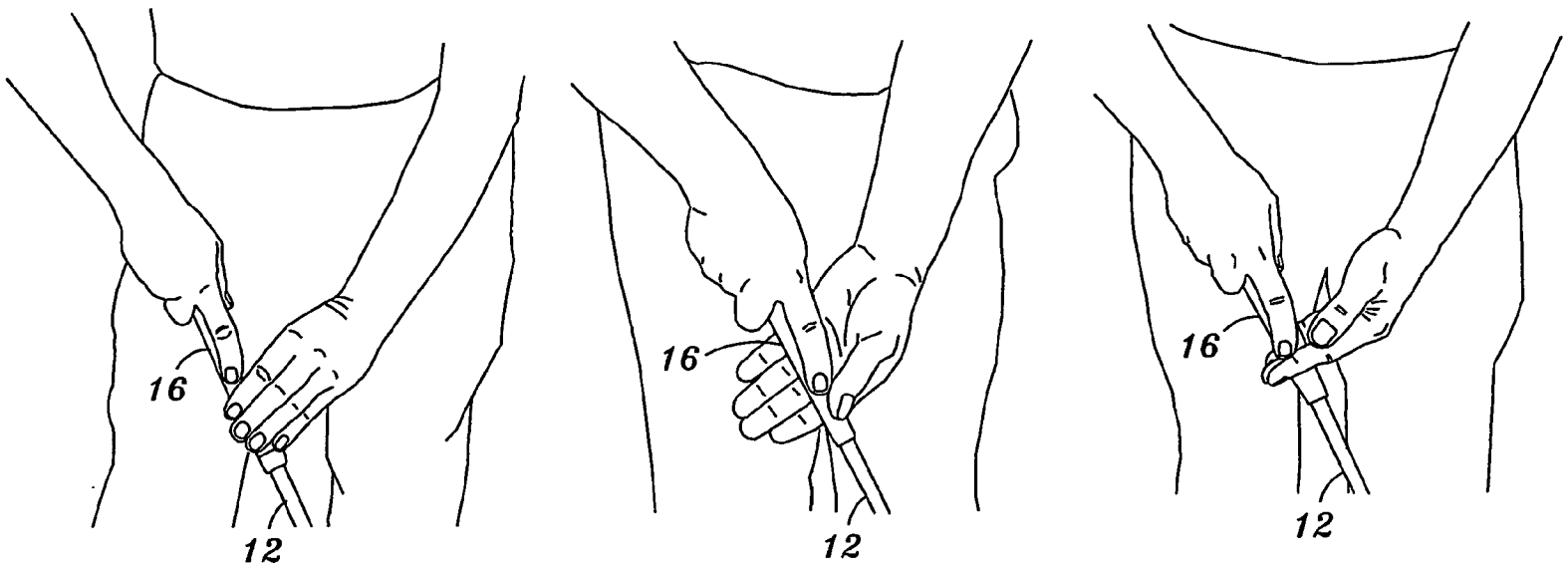

FIG. 14A is a fragmentary front view of a golfer holding the putter with both hands and the right arm where the pad of the left thumb is on the backside of the grip and the pads of the fingers are on the front side of the grip.

FIG. 14B is the same fragmentary view as FIG. 14A except the four fingers of the left hand are on the back side of the grip and the pad of the thumb is on the front side.

FIG. 14C is the same fragmentary view as FIG. 14A except the grip is placed between the middle and ring fingers of the left hand with the palm of the hand facing up.

Figure 14E:
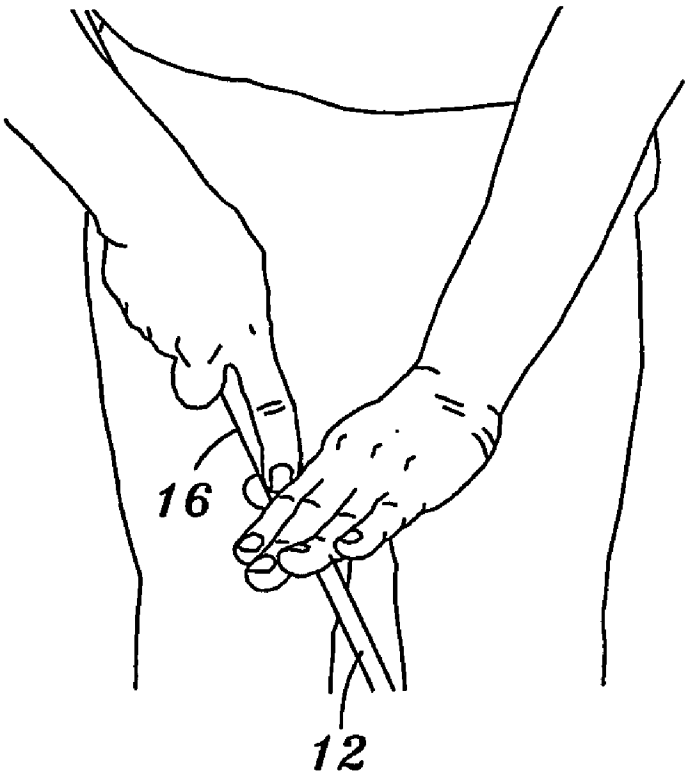
Figure 14D:
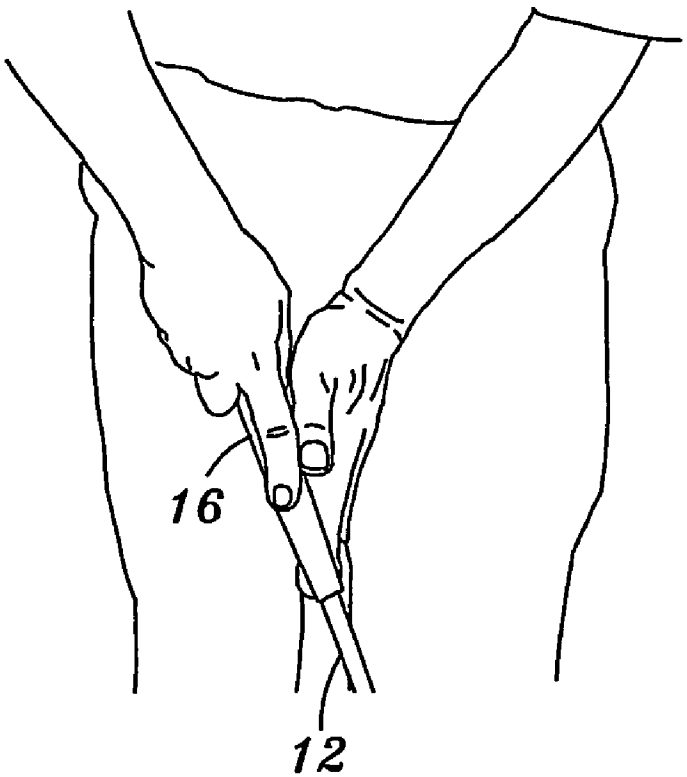

FIG. 14D is the same fragmentary view of the left hand as FIG. 14A except the four fingers of the left hand are extended and touching one another and the side of the fore finger is about parallel to and against the backside of the grip with the fingers about vertical.

FIG. 14E is the same fragmentary view as 14A except the grip is between the thumb and forefinger of the left hand, the four fingers are extended and about in a horizontal position and the left hand is facing downward.

Figure 15:
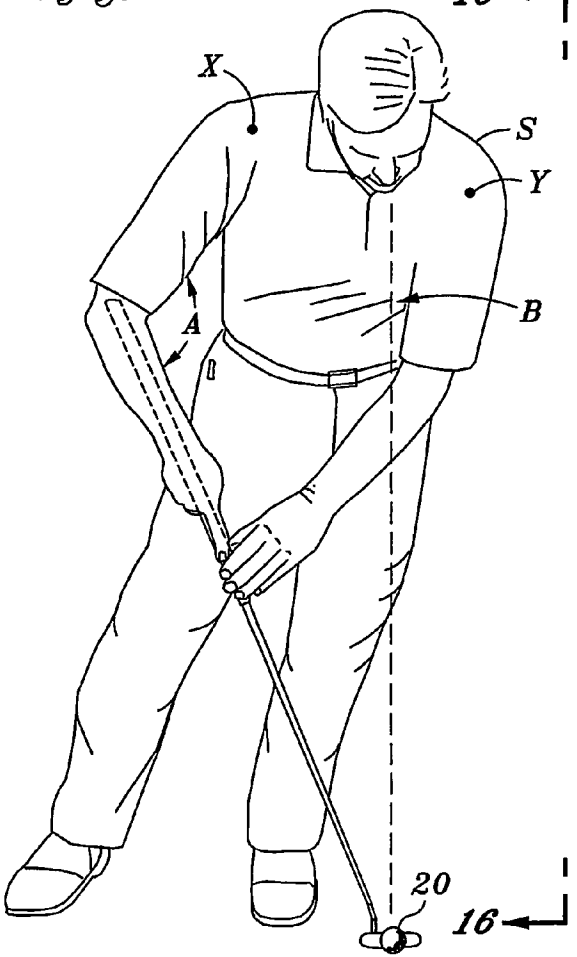

FIG. 15 is a front view of the golfer with his right arm across the front of his body and his left hand on the grip as he addresses the ball, with the golfer's eyes vertically over the target line.

Figure 16:
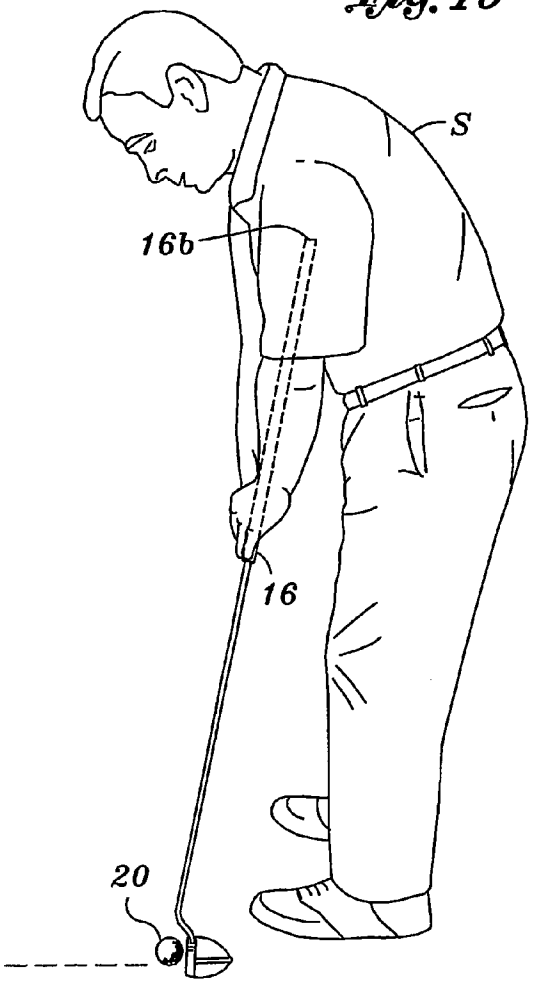

FIG. 16 is a left side elevation view taken along line 16—16 of FIG. 15 showing the inclined angle of the shaft using the offset putter shown FIGS. 1 and 2.

Figure 16C:
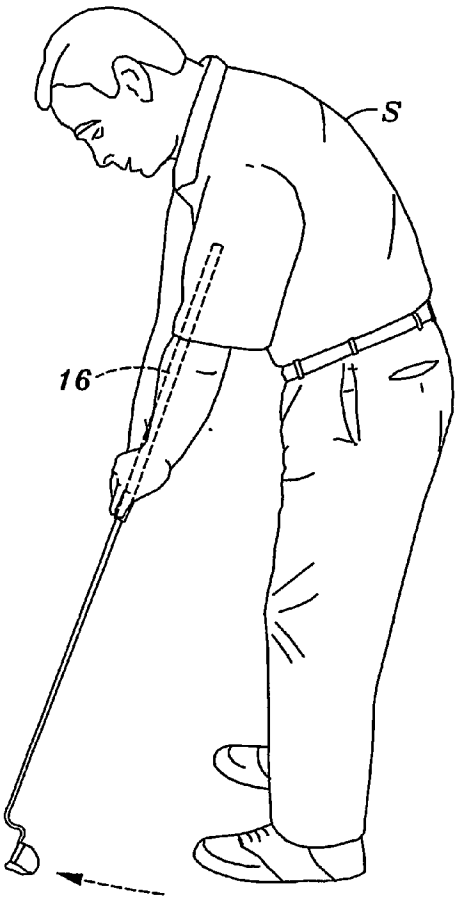
Figure 16B:
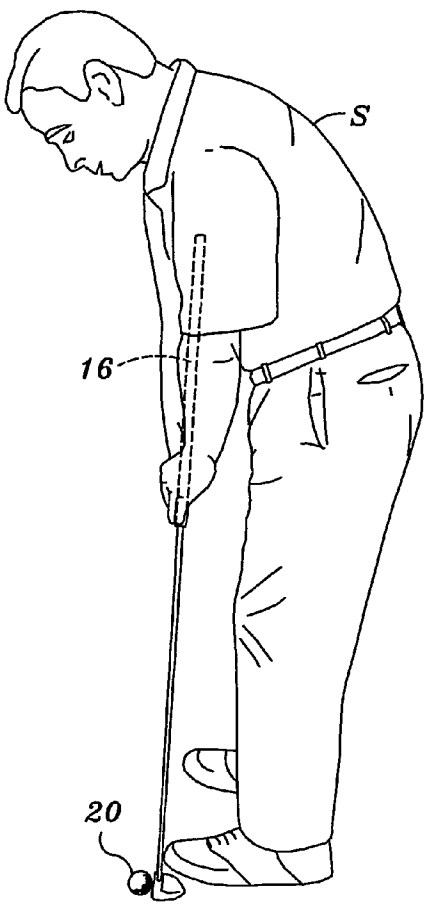
Figure 16A:
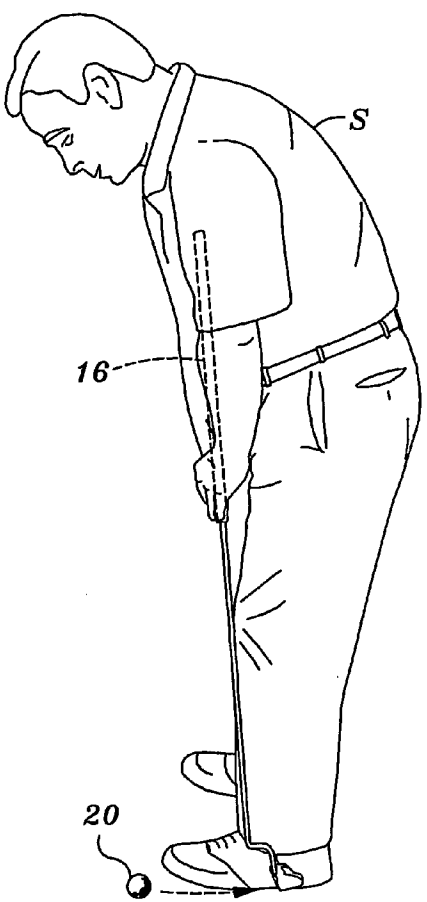

FIG. 16A is a left side elevation view similar to that shown in FIG. 16 except the putter head is at the end of the backstroke.

FIG. 16B is a left side elevation similar to that shown in FIG. 16 except the putter head is in the forward stroke striking the ball.

FIG. 16C is a left side elevation view similar to that shown in FIG. 16 except the golfer is at the end of the follow-through stroke.

Figure 17:
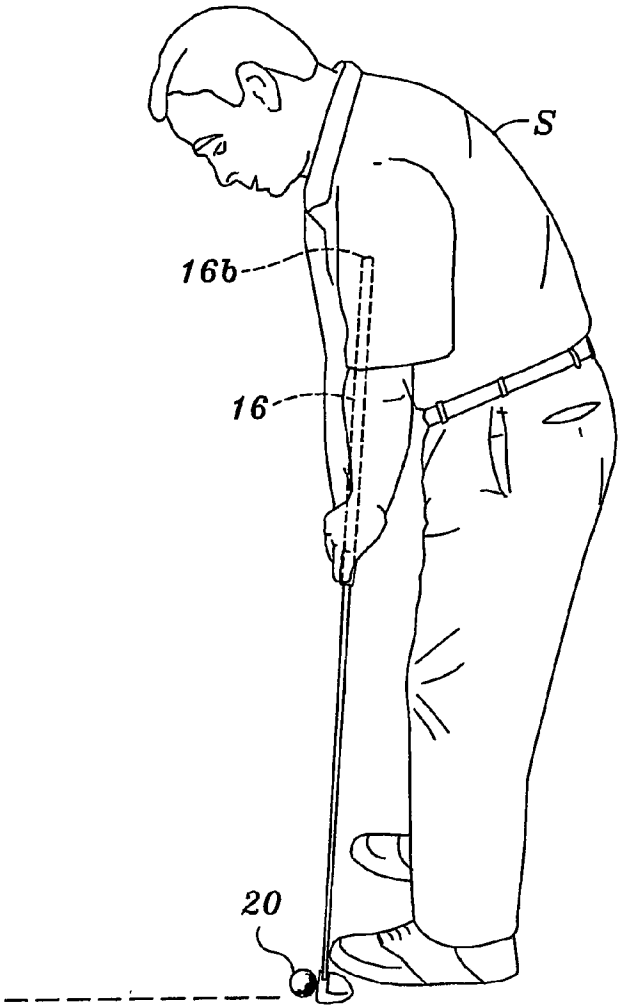

FIG. 17 is the same side elevation view as FIG. 16 showing the near vertical angle of the shaft using the near in-line putter shown FIGS. 1A and 2B.

Figure 17A:
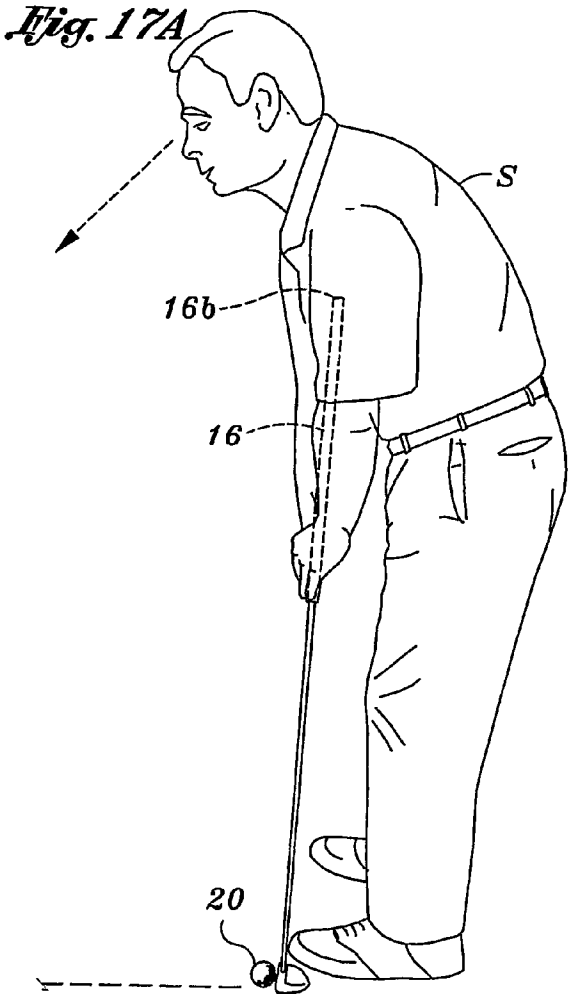

FIG. 17A is a side elevation view similar to that shown in FIG. 17 except the golfer has raised his head to look down the target line.

Figure 18:
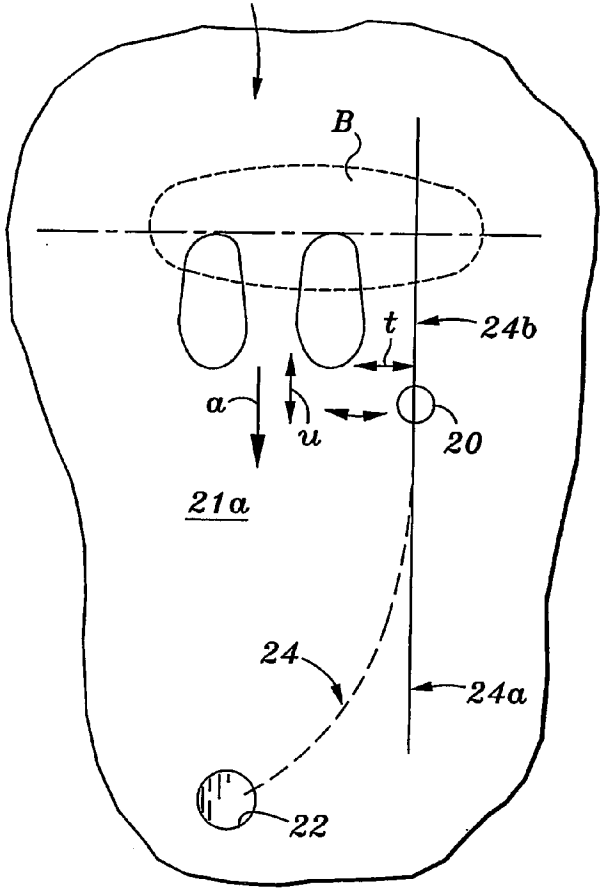

FIG. 18 is an overhead view diagram showing the position of the golfer's feet and body relative to the ball, the target line and the putt of the ball.

DETAILED DESCRIPTION

Some Preferred Embodiments

A First Embodiment

Introduction

In the first embodiment of this invention, a normally dominant right-handed golfer uses a putter 10' that is a variation of a conventional left-handed putter. The putter 10' has the top end of its grip widened as shown in FIG. 5'A and FIGS. 9' through 12'. It includes a head 11' connected by a shaft 13' to a grip 12'. Preferably, the top end 12'*a* of the grip 12' of the putter 10' is widened to facilitate the one-hand and arm putting method of this invention, but the method of this invention is not limited to using this type of modified grip. In other words, the putter 10' has its grip modified to better practice the method of this invention, but its head 11' is oriented in the same manner as a conventional left handed putter.

As depicted in FIG. 5'A and FIGS. 9' through 12', the upper portion 8' of the grip 12' tapers inward to merge with a lower portion 7' having dimensions less than the dimensions of the upper portion. The upper portion 8' has an over all length l of about 1 inch and a top end 12'*a* with a slightly less rounded front side 12'*c*. As viewed in FIGS. 9' and 11', the right side 12'*e* and left side 12'*f* of the upper portion 8' are more rounded than the front side 12'*c* and they converge. Consequently the upper portion 8' has a bowed triangular shape. Preferably, the width $w_1$ at the upper portion 8 is about 1¾ inches, its thickness $t_1$ is about 1 inch, its length $l_1$ from the apex 8'*a* to the edge 8'*b* is about ⅞ inch, and its length $l_2$ from the edge 8'*b* to the maximum outer point 8'*c* of the rounded front side 12'*c* is about ⅛ inch. The lower portion 7' as viewed in FIGS. 9' and 12' also has a bowed triangular shaped, but is not as flatten as the upper portion 8'. It has a front side 12'*g*, a right side 12'*h*, and left side 12'*i*. Preferably, the width $w_2$at the lower portion 7' is about ¾ inches, its thickness $t_2$ is about 1 inch, the length 13 from the apex 7'*a* to the edge 7'*b* is about ⅞ inch, and the length $l_4$ from the edge 7'*b* to the maximum outer point 7'*c* of the front side 12'*g* is about ⅛ inch. The front sides 8'*c* and 12'*c* are on the same side of the putter as the face 11'*a* of the head. The dimensions of the grip may be modified to accommodate individual preference.

Central to the method of this invention is the putting swing, which comprises a backstroke, a forward stroke, and a follow-through stroke. As depicted in FIG. 1'A, during the putting swing, the putter head 11' is swung through a vertical plane 9' that intersects the ball being putted. As illustrated in FIG. 7'B, the target line is 14'*a*. In this case, the line of putt and the target line 14'*a* are identical. During the putting swing, the putter head 11' moves in the vertical plane 9' through an arc overlying the target line 14'*a* and a rearward extension line 14'*c* of the target line. The putter face 11'*a* is a substantially flat surface having an incline from 1 degree to about 10 degrees in relation to the shaft 13' in a vertical position. As shown in FIG. 9'B, the shaft of the putter 10' is oriented at an angle j from 1 degree up to about 10 degrees with respect to the vertical when addressing a ball 15'. In the address position the putter face 11'A is about vertical to the surface of the green. The degrees of inclination of the face 11'*a* and the degrees the shaft is oriented forward when addressing the ball may differ due to individual preference, however, they are about equal and reciprocal. During the entire putting swing, however, the putter face 11'*a* is maintained substantially square, that is at a right angle, to the target line 14'*a*. The manner in which the putter's grip 12' is held, the stance and address, and other aspects of the one-hand and arm putting method of this invention will now be discussed in detail.

Holding the Putter Grip

The golfer holds the grip 12' with only one hand, in this case the right hand 29', so that when the right arm is moved across the front of the golfer's body as shown in FIG. 1', the face 11'*a* of the putter head 11' is square with the target line 14'*a* (FIG. 4). As illustrated in FIG. 5'A, an intermediate portion 12'*g* of the grip 12' of the putter 10' is first placed in the middle of the palm 19' of the golfer's open right hand 29' with the tip 21'*a* of the index finger 21' nearby the lower end 12'*b* of the lower portion of the grip 12'. The less rounded side 12'*c* faces outward, resting against the underside of the forearm 20'. Next, as shown in FIGS. 1' and 6'A and 6'B, the fingers 30', 31', and 32' of the golfer are closed to grasp the grip 12'. As depicted in FIG. 5'B, the wide top end 12'*a* of the grip 12' rests against the inner forearm 20' of the golfer about 1 to about 4 inches above the fold of the skin between the heal pad 23' of the palm 19' and the wrist 25'. Line 22' indicates this fold, which is the hinge of the wrist. The exact distance above the line 22' that the top end 12'*a* extends is an individual preference of each golfer. The index finger 21' is extended straight down the less rounded side 12'*c* of the grip 12'. The thumb 27' extends down the left side 12'*f* of the grip 12' just to the left of the index finger 21'. As best shown in FIGS. 5'B, 6'A and 6'B, the remaining three fingers curl around the right side 12'*e* and rear side 12'*d* of the grip 12' and hold the grip 12' firmly.

In this first embodiment, the necessary power to stroke a putt requires only one source of force, in this case the right hand that holds the grip 12'. A second source of force for power is not needed. The necessary control over the stroke and control over the direction of the putter face 11'*a* requires the grip 12' to be held firmly by opposing forces: the force of the index finger 21' pushing backward, the force of the last three fingers 30', 31', and 32', pulling forward, and the force of the underside of the forearm 20' pushing back against the top 12'*a* of the grip 12' levered into the forearm.

The wrist 25' is pushed into a pronated (inwardly bent) position as shown in FIG. 2'A, so that the wrist is bowed away from the grip 12' and the hinge 22' of the wrist 25' is placed at a right angle to the target line 14'*a*. The tip 21'*a* of the index finger 21' is pushed backward against the grip 21'. The bending of the wrist 25' and the backward force of the index finger 21' combined with the other three fingers 30', 31', and 32' curling around and strongly holding the grip 12' levers the top end 12'*a* of the grip 12' into the inner forearm 20' of the golfer. The putter shaft 13', including the grip 12', serves as a lever and the golfer's fingers 30', 31' and 32' serve as the fulcrum of this lever. The result is a controlled configuration of the right hand 29', right wrist 25', right inner forearm 20', and putter 10' to create a combined pressure within the hand, wrist and forearm of the golfer that the golfer feels and uses to maintain a constant acceleration. The golfer feels at his wrist any change or deviation from this configuration. Through practice, the golfer is able to maintain a constant acceleration of the putter head 11' by not allowing the pressure of this configuration to change during the putting stroke. This firm arm-hand-wrist-putter configuration is maintained with substantially the same hand pressure at the address to the ball 15' and throughout the backstroke, forward stroke and follow-through stroke. The purpose of the firm arm-hand-wrist-putter configuration is (a) to provide two opposing sources of force employing only one arm (instead of the traditional method of using two hands for two opposing sources of force) to control the stroke of the putter and control the direction of the putter face 11'*a*, (b) to keep the hand tightly secure to the grip 12', (c) to cause the putter 10' to move straight back over the backward extension of the target line 14'*a* during the backstroke and to move straight forward over the target line during the forward stroke and follow-through stroke, (d) to keep the putter face 11'*a* square to the target line 14'*a* at all times, and (e) to prevent the putter face 11'*a* from twisting, turning, inclining or declining during the putting stroke.

The Putting Stance

The putting stance refers to the way in which a golfer stands in preparation to putt, especially the placement of his feet, hips, shoulders, arms, hands and head at the address. The golfer may adopt different stances when practicing the method of this invention. A first stance is depicted in FIGS. 7'B and 7'F, a second stance is depicted in FIG. 7'B-1, and a third stance is depicted in FIGS. 7'D and 7'C.

First Stance

In the first stance as depicted in FIGS. 2'A, 2'B, 7'A and 7'B, the golfer stands upright on the right side of the target line 14'*a* facing the target line 14'*a*. His shoulders are in their relaxed, natural position. His feet 35' and 36' are a distance $d_1$ between about 4 and about 8 inches apart; however, individual preference may cause this distance to vary. The feet point in the general direction of the target line 14'*a*. The location of the ball 15' on the green 15'*a* is a distance $d_2$ of about 4 to about 8 inches to the left side of the toe of the left foot 36' and about even with or a distance $d_3$ up to about 5–8 inches ahead of the toe 36'*a* of the left foot 36'. The shoulders are at an inward angle of about ten degrees to about fifteen degrees as shown in FIG. 7'B.

Second Stance

As shown in FIG. 7'B-1, the golfer in the second stance stands upright on the right side of the target line 14'*a* facing the same direction as the target line 14'*a*. His shoulders S are in their relaxed, natural position. His feet 35' and 36' are a distance $d_1$ between about 4 and about 8 inches apart; however, individual preference may cause this distance to vary. The feet point in the general direction of the target line 14'*a*. The location of the ball 15' on the green surface 15'*a* is a distance $d_2$ of about 4 to about 8 inches to the left side of the toe of the left foot 36' and about even with or a distance $d_3$ up to about 5–8 inches ahead of the toe 36'*a* of the left foot 36'. The shoulders S are about perpendicular to the target line 14'*a*, as shown in FIG. 7'B-1.

Third Stance

The third stance, as depicted in FIGS. 7'C and 7'D, is about the same as the first stance, except that the toe 35'*a* of the right foot 35' is about even with the forward position of a ball 15' and pointing at an angle 1 of about twenty-five degrees to thirty degrees inward from the direction of a line p parallel to the target line 14'*a*. The toe 36'*a* of the left foot 36' is about fifteen inches behind the toe of the right foot 35' and is also pointing at an angle m of about twenty-five degrees to thirty degrees inward from the direction of a line p parallel to the target line 14'*a*. The twenty-five degree to thirty-degree angle of the feet (rather than having them point in the general direction of the target line, as described in first stance) provides additional balance and stability. As shown in FIG. 7'E, due to the position of the feet 35' and 36' using the third stance the right shoulder is substantially ahead of the other shoulder and the shoulders are at about a forty-five degree inward angle z to the target line 14'*a* rather than a ten degree to fifteen degree inward angle as described in the first stance. The angle positions of the feet and shoulders permit the right arm to swing freely and forward down a line p parallel to the target line 14'*a*. This third stance is particularly useful and effective on long putts due to the ease of the forward stroke and follow-through stroke.

The Putting Address

From the upright relaxed standing position shown in FIG. 7'A, the golfer, as described above, holds the grip 12' of the putter 10' in his right hand 29' and brings his right arm 29'*a* across the front of the body as shown in FIG. 1'. The face 11'*a* of the putter 10' is placed behind the ball 15' as shown in FIG. 1'. As shown in FIG. 2'A, the shaft 13' of the putter 10' is about 1 to 10 degrees declined from vertical with the surface of the green 15'*a*. The right shoulder 29'*b* is kept in a natural, relaxed position next to the body. The right shoulder 29'*b* is not be pushed or extended away from the body, nor lifted up, as in a shrug. The right shoulder 29'*b* at the address of the ball 15' is in its same natural position next to the body as it was when standing with the arms at the sides. The wrist 25' is pronated to its extreme position so it can not be pronated more and pushed away from the body toward the hole 14'*b* so that the outside 25'*a* of the wrist is a $d_4$ between about four and about 8 inches vertically ahead of the face 11'*a* of the putter head 11'. The outside 25'*a* of the wrist 25' is the most forward point of the arm-wrist-hand-putter configuration. The face 11'*a* of the putter is in a near vertical plane. The right shoulder 29'*b* and the putter face 11'*a* are in a near vertical plane.

The elbow of the right arm can be positioned two ways. In the first elbow position, the elbow is extended open causing the arm to be about straight from the wrist to the shoulder as shown in FIG. 1'. From a front view the shaft 13' of the putter 10' and the arm appear to be about one straight, continuous line joined at the grip 12' by the hand. From a side view as shown in FIG. 2'A the shaft 13' and arm appear bowed forward with the outside of the wrist 25' in a forward most position. This straight arm-shaft configuration permits the putting stroke to be simple, free flowing, however, it tends to lack control over side movement of the stroke and leverage for addition power.

In the second elbow position, as shown in FIGS. 7'F and 7'G, the right elbow 29'*c* is slightly crooked (bent, causing the arm 29'*a* to be about straight from the wrist 25' to the elbow 29'*c* and the upper arm to be about vertical. From a front view as shown in FIG. 7'F, the shaft 13' of the putter 10' and the arm 29'*a* up to the elbow 29'*c* appear to be about one straight, continuous line joined at the grip 12' by the hand 29'; the upper arm is about vertical. From a side view as shown in FIG. 7'G, the shaft and arm appear bowed forward with the outside of the wrist in a forward most position, This crooked elbow configuration permits the putting stroke to be free flowing and it controls the forward and side movement of the stroke; it also adds leverage for addition power. The crooked elbow is about four to eight inches in front of the outside of the right hip. The inside angle 29'*d* of the right elbow 29'*c* faces inward at about a right angle to the target line 14'*a*.

Using either elbow position, the arm 29'*a*, including the elbow 29'*c*, wrist 25', hand 29', and putter 10' instead of acting independently as separate parts now are interconnected in such a way as to form one unit. They are 'welded' together, so to speak, in their respective positions by the contraction of muscles of the right hand 29', wrist 25', and arm 29'*a*. This connected relationship of the arm 29'*a*, wrist 25', hand 29', and putter 10' is maintained in this controlled configuration during the backstroke, forward stroke, and follow-through stroke. The arm 29'*a* and shaft 13' reinforce one another to stabilize and control the putting stroke and control the direction of the putter face 11'*a*. As best shown in FIG. 1', the left hip 52' is leaned laterally towards the target line 14'*a* so that the eyes 43' and 44' of the golfer are substantially directly over the target line 14'*a*. The head 11' of the putter 10' is behind the ball 15'. The angle of the golfer's head 41' is then adjusted so that his eyes 43' and 44' are in a level, horizontal position as indicated by the line 45' in FIGS. 8'A through 8'C. This eye position permits the golfer to:

(a) look as shown in FIG. 2'B and FIGS. 8'A and 8'B straight down the target line 14'*a* with his eyes in a straight frontal horizontal viewing position which greatly improves the golfer's ability to judge the effect of the slope of the green upon a moving ball and the distance of the ball 15' to the hole 14'*b*, (b) look as shown in FIG. 2' and FIG. 8'C vertically straight down at the target line 14'*a* or the face 11'*a* of the putter 10' at which time the golfer may adjust and/or verify the aim of the face 11'*a* of the putter 10', and (c) look back and forth, first looking down the target line 14'*a* and then looking downward at the face 11'*a* of the putter 10' to check the angle of the face 11'*a* for directional adjustment purposes.

Both looking positions depicted in FIGS. 2'A and 2'B locate the golfer's eyes in their most optimal effective, horizontal viewing position as illustrated in FIG. 8'C.

Upon the accomplishment of all of the above steps, the right shoulder 29'*b* acts as a stationary hinge from which the arm 29'*a* is free to move backward in the backstroke and forward in the forward stroke in an unrestricted manner (as discussed in the forward stroke #1 section herein), or to act as a stationary hinge from which the arm 29'*a* is free to move backward in an unrestricted manner in the backstroke and with the elbow to act as a stationary hinge in the forward stroke and follow-through stroke (as discussed in the forward stroke #2 section herein). The arm 29'*a*, wrist 25', hand 29' (being held firm by the golfer) and the putter 10' act as a pendulum with the shoulder 29'*b*, serving as a hinge or pivot point for the pendulum movement of the arm-wrist-hand-putter unit.

Squaring the Face of the Putter

As shown in FIGS. 1', 2'A, 3, 4 and 7', the face 11'*a* of the putter 11' is kept square to the target line 14'*a* during the entire putting stroke. In FIG. 7', position A depicts the beginning position of the head 11' and face 11'*a* at the address as discussed above. In FIG. 7', position B depicts the end of the backward stoke. The face 11'*a* is maintained square with the target line 14'*a* while moving from position A to position B. In FIG. 7', position C depicts the end of the forward stroke and follow-through stroke. The face 11'*a* is maintained square with the target line 14'*a* while moving from position B and through A to position C.

The face 11'*a* of the putter is kept square to the target line 14'*a* during the entire swing by a combination of:

A. The golfer keeps the arm-wrist-hand-putter controlled configuration firm and in the same relative positions to one another (a) beginning with the address, (b) through the backward retraction or backstroke illustrated in FIGS. 2'A and 3', and (c) from the position shown in solid lines in FIG. 3', the end of the backstroke, (d) through the forward propulsion of the putter 10', (e) through a forward stroke to make contact with the ball 15' as depicted in FIG. 4', and (f) then through a follow-through stroke as shown in dotted lines in FIG. 4'.

B. The golfer moves the arm and putter backward in a slow, smooth, deliberate and continuous movement using the shoulder 29'*b* as a hinge and moving his hand on a line parallel to the target line 14'*a*. During, or at the end of the backstroke, the golfer may check and adjust (i) whether the putter head 11' is moving over the target line 14'*a*, (ii) the length of the backstroke, (iii) the orientation of the face 11'*a*, keeping it square with the target line 14'*a*, and (iv) the tactile pressures of the components of the hand-wrist-arm-putter configuration. If these pressures change from the same pressures at the address, the golfer knows that the arm-wrist-hand-putter configuration deviated from the desired controlled configuration. The golfer may then make the appropriate adjustments to those pressures.

C. The golfer may cause the putter head 11' to pause at the end of the backstroke at a distance behind the ball 15' as determined by the golfer. The pause of the putter head at the end of the backstroke refers herein to that moment when the backward movement of the putter head has momentarily stopped and the forward stroke has not yet begun. At that moment the putter head is in transition between backward and forward movement.

D. The golfer initiates the forward stroke by moving the entire hand-wrist-arm-putter configuration forward with his hand 29' and arm 29'*a* on a line parallel to the target line 14'*a*. During the first few inches of this forward stroke the golfer causes the forward movement to be fast enough to generate a lever action between the top of the grip 12*c* and the underside of the forearm 20'. It is the pressure of the top end 12'*a* of the grip 12' into the underside of the forearm at (1) the address plus (2) the additional pressure created by this lever action that tends to control and keep the putter face 11'*a* square to the target line 14'*a*.

The lever action is created as follows. The putter 10' acts as a lever and the palm 19' and fingers 30', 31', and 32' serve as the fulcrum. The long length of the shaft 13' between the putter head and the hand on the grip, compared to the short length of the grip between the heel of the hand and the top of the grip 12*c*, and heavy weight of the putter head 11' and shaft below the hand compared to the light weight of the grip 12' above the heel 23' of the hand and the top end of the grip 12'*a*, coupled with inertia acting on the mass of the putter head 11' are factors affecting the lever action employed in this invention. The putter head 11' and shaft below the hand are substantially heavier than the shaft 13' and grip 12' above the heel 23' of the hand. During the initial movement of the forward stroke the putter head 11' tends to remain at rest as a result of inertia acting on the mass of the putter head 11'. The putter head 11' lags behind the forward movement of the hand and arm causing the putter head 11' to be pulled forward by the hand and arm, and inertia acting on the mass of the putter head 11' causes the wrist 25' to slightly hinge backward. Because the hinge of the wrist 25' is set perpendicular to a line parallel to the target line 14'*a* at the address and kept square to the target line during the backstroke, the putter face 11'*a* stays square to the target line 14'*a* even when the force of inertia pulls the wrist 25' into a deeper pronation. Consequently, sufficient force is generated to lever the top end 12'*a* of the grip 12' into the forearm 20'. The golfer can then feel an increase in pressure as the top end of the grip 12'*a* is pressed more firmly against the underside of the forearm 20'. This increase in pressure adds firmness to the hand-wrist-arm-putter configuration, and tends to keep the putter face 11'*a* square to the target line 14'*a*. In other words, the putter head resists turning or twisting due to this increase in pressure as the putter head is moved forward. The golfer continues moving the entire hand-wrist-arm-putter configuration smoothly forward to complete the forward stroke and strike the ball 15'.

E. The golfer moves his hand forward maintaining the hand-wrist-arm-putter configuration along an arc parallel to the target line 14'*a* at a constant rate of acceleration. The constant rate of acceleration tends to cause the pressure of the top end 12'*a* bearing against the inner forearm 20' to also remain essentially constant. The golfer feels this pressure and with practice can detect any change in pressure. Although during the forward stroke the velocity of the forward propulsion of the putter head 11' is constantly increasing due to the constant rate of acceleration, the pressure of the top end of the grip 12'*a* against the underside of the forearm 20' tends to remain essentially constant. If the golfer detects a change in this pressure, he knows the putter head 11' is not moving at a constant rate of acceleration.

F. After the ball 15' is struck, the golfer moves the putter head 11' forward down the target line 14'*a*, while maintaining the controlled hand-wrist-arm-putter configuration. He moves the putter head 11' forward with the hand-wrist-arm-putter configuration in tact. When the putter head 11' comes to rest in the air, the putter face 11'*a* is square to the target line 14' and the putter head 11' is vertical over the target line, and the top end of the grip 12'*a* continues to exert pressure against the under forearm.

G. The hand is ahead of the putter head 11' during the forward stroke and therefore pulls the putter head forward. The putter head 11' follows the direction of the leading hand. As a result of the hand's pulling effect, the putter head 11' moves smoothly forward and the putter face 11'*a* tends to stay square to the target line.

Aiming the Putt

Aiming the putt may differ somewhat in detail from one golfer to another; however, the general principles discussed in the following steps are similar. These steps are as follows:

Step One: First, the golfer visually examines the conditions of the green and the effect of those conditions on the movement of the ball over the surface of the green, and decides on the direction of the target line 14'*a* and speed of the ball.

The golfer, using the method of this invention, is aided in aiming the putt correctly because:

(1) His stance and address places his eyes 43' and 44' vertically over the target line 14*a* so they are in their optimal, level, horizontal viewing position. He may raise his head as depicted in FIG. 2'B, to look down the target line 14'*a*. He is able to look directly down the target line 14'*a* at least ten to fifteen feet without raising his head as depicted in FIG. 2'A and visualize how the ball 15' will react to the slope of the green, or he may lift his head as shown in FIG. 2B to view the entire length of longer putts with eyes in the same level, horizontal position.

(2) He may adjust the direction of the putter face 11'*a* to be square with the target line 14'*a* during the backstroke or at a pause at the end of the backstroke.

(3) He can envision the rearward line extension 14'*c* of the target line 14'*a* and move the putter head 11' over this rearward line extension of the target line 14'*c* during the backstroke.

(4) He can envision the target line 14'*a* as he moves the putter head 11' through the forward stroke and follow-through stroke.

Step Two: The golfer addresses the ball as described in the stance and address section.

Step Three: After the ball has been addressed and the putter face 11*a* is square to the target line, the golfer is prepared to initiate the putting stroke.

The Body

During the entire putting swing, the body of the golfer, except for the movement of the right arm stroking the putt, does not move. Although the position of the non-dominant left arm 50' is not critical, preferably, the left arm is kept along side of the golfer as shown in FIGS. 1' through 4'. In the backstroke, the putter head 11' moves back in a pendulum like arc with the shoulder 29'*b* acting as a stationary hinge. During the putting stroke, the shoulder 29'*b* stays in the same position it assumed at the address during the backstroke. Any vertical or horizontal shoulder movement in the backstroke or forward stroke may cause the putt to be inaccurate.

The Backstroke

Step one: The golfer places the face 11'*a* behind the ball 15' as shown in FIGS. 1' and 2'A. The ball 15' is lined up to be struck in the middle of the face 11'*a* as shown in FIGS. 1' and 7'.

Step Two: With the hand-wrist-arm-putter configuration firmly maintained, the arm 29'*a* is extended to its full 'connected' length with the wrist 25' bowed forward as shown in FIG. 3' and the elbow preferably either straight or slightly crooked (as chosen by the golfer). Preferably, the arm muscles contract to cause the hand-wrist-arm-putter configuration to move back slowly on a line parallel to the target line 14'*a* while keeping the components of the configuration in their same relative position as they were at the address. This movement causes the putter 10' to move slowly back along the rearward line extension 14'*c* of the target line 14'*a*. The putter head 11' moves along an arcuate pathway that overlies the target line 14'*a*. The hand-wrist-arm-putter configuration stays in tact during the entire backstroke. The pressure of the front side 12'*c* of the top end of the grip 12'*a* against the underside of the forearm 20' also stays the same during the entire backstroke. The backstroke is relatively slow. Consequently, the inertia of the heavy putter head 11' does not cause the top end of the grip 12'*a* to move away from engagement with the underside of the forearm 20'. As depicted in FIG. 1'B, during the backstroke, the hand 29' moves in a pendulum like arc. The hand 29' is moved as shown in solid lines from its start position to a position slightly more directly facing the surface of the green 15'*a*, with the shaft 13' of the putter 10' moving into a slightly more acute angular relationship with the surface of the green. The result is a natural movement causing the putter head 11' to move straight back along the rearward line extension of the target line 14'*c* in an arc as depicted in FIG. 1'A. Also, moving the hand in this manner tends to keep the putter face 11'*a* square to the target line 14'*a*. The front side 12'*c* of the grip 12' is kept tight against the underside of the forearm 20' by the pressure of the index finger 21' and a firm grip of the fingers 30', 31', and 32'. Any looseness in gripping the putter 10' during the backstroke will cause the top end 12'*a* of the grip 12' to disengage from the underside of the forearm 20'. The slightest looseness of the grip during the backstroke may cause a change in the hand-wrist-arm-putter configuration, which may change the orientation of the putter face and/or path of the putter head, and result in inaccurate putting.

During the backstroke, the golfer may focus his eyes 43' and 44' on the ball 15', which is the traditional method, or, he may focus his eyes on the putter face 11'*a*. Watching the putter face 11'*a* during the backstroke has the advantage of permitting the golfer to check and adjust the following:

(1) Check whether the putter head 11' moves straight back from the ball and over the rearward line extension 14'*c*. If it is not, the golfer may make the appropriate adjustment.

(2) Check whether the length of the backstroke is the correct length for the specific putt. If it is not, an adjustment can be made.

(3) Check whether the putter face 11'*a* is square to the target line 14'*a* as it was at the address. If it is not, an adjustment can be made.

(4) Feel whether the hand-wrist-arm-putter pressure is the same at the end of the backstroke as it was at the address. If it is not, an adjustment can be made. At the end of the backstroke and before the forward stroke has commenced, the golfer may continue to focus his eyes 43' and 44' on the putter face 11'*a* or return eye focus on the ball 15'.

The Forward Stroke

Forward Stroke #1

After the putter head 11' has stopped at the end of the backstroke (position B, FIG. 7'), preferably the anterior deltoid muscles (refers herein to the right anterior deltoid muscle and the muscles that support that muscle) pull the arm and hand forward along an arcuate pathway that is parallel to the rearward line extension 14'*c* and the putter head 11' along an arcuate pathway that overlies the rearward line extension 14'*c*. As stated in the Squaring the Face of the Putter section herein, during the first few inches of the forward stroke, the inertia acting on the mass of the putter head 11' levers the wide and nearly flat side of the top of the grip 12*c* into the underside of the forearm of the golfer. This action reinforces the square position of the putter face 11'*a* to the target line 14'*a*. The stroke is smooth, controlled and unhurried. The initial grasp of the grip 12' with pressure of the top of the grip into the underside of the forearm plus the pressure of the top end 12'*a* of the grip 12' levered into the underside of the forearm during the forward stroke tends to keep the putter face 11'*a* square to the target line 14'*a* during the forward stroke and follow-through stroke. The shoulder 29'*b* stays in its original, relaxed position and acts as a hinge. The use of this method produces a simple movement, better control, and excellent accuracy of both the ball's direction and distance.

During the forward stroke:

(1) The right arm 29'*a* remains firm and 'connected' in the hand-wrist-arm-putter configuration with the elbow straight or slightly crooked (as chosen by the golfer) as it was at the address, (2) The hand pressure and the pressure of the top end 12'*a* of the grip 12' into the underside of forearm remains the same as it was at the address.

(3) As discussed above, the constant rate of acceleration of the putter head 11' coupled with the effect of inertia tending to hold the putter head at rest, levers the top end 12'*a* of the grip 12' into the underside of the forearm. This levered pressure tends to hold the top end 12'*a* of the grip 12' and the underside of the forearm tightly together while moving forward on a line parallel to the target line 14'*a*. As a result, the putter face 11'*a* is more firmly held in a position square to the target line 14'*a*.

(4) The wrist 25' remains bowed backward as it was at the address, (the wrist does not hinge forward) and (5) The right shoulder remains relaxed in a stationary position as it was at the address. Preferably, the anterior deltoid muscles contract to supply the power to propel the arm and putter 10' forward.

Forward Stroke #2

The forward stroke #2 is about the same as the forward stroke #1, except that during the forward stroke #2 the elbow (not the shoulder) acts as the stationary hinge.

As illustrated in FIGS. 7'H and 7'I, at the beginning of the forward stroke #2, preferably the bicep and forearm muscles of the right arm contract to cause the arm below the elbow to move forward and upward. At the same time, the elbow remains in place.

The Follow-Through Stroke

Follow-Through Stroke #1

As illustrated in FIGS. 1'A and 1'B, during the backstroke, forward stroke and follow-through stroke, the putter head 11' arcs back and forward directly over the rearward extension line 14'*c* and the target line 14'*a*. The golfer senses that he is moving the putter head 11' in the vertical plane 9' that intersects the rearward extension line 14'*c* and the target line 14'*a*. Moving the putter head 11' in this vertical plane 9', combined with the putter face 11'*a* being square with the target line 14'*a*, provides accurate putting.

After the ball 15' is struck, the putter head 11' moves forward down the target line 14'*a*, keeping the same hand-wrist-arm-putter configuration past the point where the ball was struck, and forward into the follow-through stroke so long as the integrity of the hand-wrist-arm-putter configuration can be maintained. When the putter head 11' comes to rest in the air as shown in dotted lines in FIG. 4', (*a*) the putter face 11'*a* is square to the target line 14'*a*, (b) the putter head 11' is vertical over the target line, and (c) the top end 12'*a* of the grip 12' continues to exert pressure against the underside of the forearm. At this time, the golfer can check as to whether he has successfully concluded the follow-through stroke as described above.

Follow-Through Stroke #2

As shown in FIG. 7'I, the follow-through stroke #2 is the same as follow-through stroke #1, except that during the follow-through stroke #2 the elbow (not the shoulder) acts as a stationary hinge. This hinging is a continuation of forward stroke #2.

A Second Embodiment

THE PUTTER. The putter, which is specifically designed and has unique properties for use with this second embodiment of the putting method of this invention, is critical to the successful execution of this second embodiment.

As best shown in FIGS. 1, 1A, 2, 2B and 4, the putter 10 used in the second embodiment of this invention has an elongated shaft 12, a putter head 14 at the distal end of the shaft 12, and a grip 16 covering the proximal end of the shaft 12. The grip 16 covers more than one-third of the shaft 12, and is approximately two feet in length. Preferably, the grip 16 is cylindrical, or elliptical in shape as shown in FIG. 1B. The putter head 14 has a faceplate 5 with an edge 5*a* that may be used to align the putt as discussed subsequently. There are opposed downward slopping walls 6*a* and 6*b* extending rearward from the faceplate that taper into and terminate along a trailing edge 7*b* of a sole plate 7. The forward end of this sole plate 7 is integral with the underside of the faceplate 5 and the front plate and sole plate are at substantially a right angle as shown in FIGS. 3 and 3A. The rear end of the sole plate 7 has a centrally located outwardly pointed projection 7*a*. As best shown in FIGS. 3 and 3A, the front side of the faceplate 5 has a face 18 that is at a declining angle from about 1 to 12 degrees in relation to the downward extension of the shaft 12. The declining putter face 18 angle is an integral part of the method of this invention to give a ball 20 direct forward spin when the putter face 18 strikes the ball 20, using the method of this invention, as explained in the forward spin section of these detailed Descriptions. Typically, the length of the shaft 12 is about 48 inches, but will vary depending on the height and arm length of the golfer. As subsequently discussed in greater detail, the shaft 12 has sufficient length so that the grip 16 will extend up and against the golfer's lower underside portion of the upper arm as illustrated in FIGS. 6 through 6G.

When the putter face 18 is offset, as shown in FIGS. 2 and 3, it is behind the downward extension of longitudinal axis of the shaft 12 up to about one and one half inches. This longitudinal axis of the shaft 12 and the putter face 18 form an angle Z ranging from about 1° to about 15°. Also, the angle of the putter face 18 declines from vertical, in relation to the extension of the putter shaft 12. In other words, the putter face 18 in relation to the shaft 12 has a negative loft. At the address, the inclined angle of the shaft 12, relative to the surface of the green 21*a*, and the declined angle of the putter face 18, relative to the extension of the shaft 12, are about equal and opposite as shown in FIG. 3 and 3A. Therefore, when a golfer addresses the ball 20 to putt, the shaft 12 is inclined to the surface 21*a* of the green 21 and the putter face 18 is about vertical to the surface 21*a* of the green 21. As explain later herein, in the forward stroke, the angle of the path of the putter head 14 ascends from the surface of the green 21*a* by about 4 degrees at the point of impact with the ball 20, while the putter face 18 is vertical to the surface of the green 21*a*, FIGS. 3B and 3C. The combination of these factors causes the ball 20 to be struck forward off the putter face 18 with direct forward spin.

When the putter face 18 is about even (in-line) as shown in FIGS. 2B and 3A with the downward extension of the longitudinal axis of the shaft 12, it is about even with, or slightly behind, the downward shaft extension. The angle of the putter face 18 declines up to about 5 degrees from vertical in relation to the extension of the putter shaft 12 has. In other words, the angle of the putter face 18 as measured from the angle of the shaft 12 has up to about a 5-degree negative loft. At the address, the inclined angle of the shaft 12 relative to the surface of the green 21*a*, and the declined angle of the putter face 18, relative to the extension of the shaft 12, are about equal and opposite. The angle of the path of the putter head 14 ascends from the surface of the green 21*a* from about 2 to 4 degrees at the point of impact with the ball 20, while the putter face 18 is vertical to the surface of the green 21*a*, FIGS. 3B and 3C. The combination of these factors causes the ball 20 to be struck forward off the putter face 18 with direct forward spin.

As shown in FIGS. 2, 2A and 2B, there is a centrally located alignment line 14*a* on the top surface of the sole plate 7 and a centrally located alignment line 14*b* on the top surface of the faceplate 5. These two straight alignment lines 14*a* and 14*b* are aligned with each other and line 14*a* extends to the pointed projection 7*a*, and they dissect the putter head 14 in half. There is about a three-quarter inch to a one-inch vertical height difference between these two lines 14*a* and 14*b*. The two lines 14*a* and 14*b* are used to align the putter face 18 and to keep the putter face 18 square to the target line 24*a* during the putting stroke as described in the "Keeping the Putter Face Square to the Target Line" section of these Detailed Descriptions.

The putter face 18 may be about even (in-line) as shown in FIGS. 2B and 3A with the downward extension of the shaft 12, or it may be offset as shown in FIGS. 2 and 3 behind the downward extension of the shaft 12. In either case, a hosel 16*a* connects the top of the putter head 14 and the distal end of the putter shaft 12. This hosel 16*a* is located approximately at the intersection of the faceplate 5 and the wall 6*a* when the putter 10 is to be used by a right handed golfer. The hosel 16*a* is connected at the intersection of the faceplate 5 and the wall 6*b* when the putter 10 is to be used by a left handed golfer.

A putter used by golfers who putt right-handed using traditional two-handed methods of putting, use a putter whose shaft 12 is connected to the left side of a putter head as it faces target line 24*a* on the green 21 and is referred to as a right handed putter. A putter used by golfers who putt left-handed using traditional two-handed methods of putting, use a putter whose shaft is connected to the right side of a putter head as it faces the target line 24*a* and is referred to as a left-handed putter.

However, because a golfer who uses the method of this invention places the putter 10 across the front of his body B as shown in FIG. 8 and as described below, the putter head 14 is reversed from its traditional position. Therefore, a right-handed golfer using the method of this invention would use a putter traditionally called a left-handed putter and visa verse.

ONLY ONE-HAND AND ARM USED TO PUTT Only the dominant hand and dominant arm are used to securely hold and control the putter through the use of multiple contacts with the grip. The mechanics of the putting stroke are thereby simplified, more easily performed and result in more accurate and consistent putting.

As best depicted in FIGS. 6 through 12, the golfer uses only one hand, in this example only his dominant right hand. All other parts of the golfer's body situated on the same side as the dominant hand are considered dominant; body parts on the other side are considered to be non-dominant body parts. The dominant hand and dominant arm hold the putter grip 16 during the putting stroke. Only one hand, arm and shoulder (the right in this example) of the golfer are involved in the putting stroke according to the method of this invention. Using only one-hand and arm for putting eliminates the use of the left hand, arm, shoulder and back muscles that are used in two-handed putting.

The multiple contacts of the one-hand and arm of the golfer with the grip 16 as explained hereafter securely holds and controls the putter 10 by (1) the direct grasp of the grip 16 by the fingers and hand, (2) by the backward pressure of the index finger, (3) the grip 16 levered against the forearm, and (4) the grip 16 levered against the upper arm. It is these multiple control contacts with the grip 16 that provides improved control over the putter 10 and distinguishes this invention from (1) a simple grasp of a putter grip 16 by one hand or (2) a grasp the grip 16 with two hands as in traditional two-handed putting methods.

Holding a putter grip 16 by one hand only, without the other contact or contacts as described above in this invention, does not provide adequate control over the path of the putter head 14 or control over the orientation of the putter face 18.

BODY POSITION WITH RESPECT TO THE TARGET LINE The golfer's body faces in the same general direction as the target line. The forward facing body position provides the golfer with a direct, forward and natural view of the target line and permits the golfer to consistently swing the putter back and forward over the rearward extension of the target line and forward over the target line in the follow-through stroke, (rather than from side to side as in two-handed putting).

In putting, the golfer first studies the surface of the green 21*a* to estimate the way in which the contours of the surface of the green 21*a* and other factors will affect the direction and speed the ball 20 will roll when putted over the surface of the green 21*a*. This is called 'Reading the green'. For example, in FIG. 13, the contour of the green 21 is expected to cause the ball 20 to break to the golfer's right and have a line of putt depicted by the dotted line 24, provided the proper amount of force is given to the ball 20 when struck by the putter 10. Even though the ball 20 is expected to have a line of putt 24 along a curved path, the putter head 14 follows a straight line during the putting stroke called the target line 24*a* (FIG. 13). The path of movement of the putter head moves over the target line 24*a*, and over a rearward extension 24*b* of the target line 24*a*. The golfer mentally envisions a straight line on the surface of the green that he intends the ball to roll initially at the correct speed to cause the ball to fall into the hole 22. This imaginary straight line ideally corresponds to the target line 24*a* and its rearward extension 24*b*. He intends to move the putter head 14 and keep the putter face 18 aimed down the target line 24*a*, in the back, forward and follow-through strokes.

As shown in FIGS. 5 and 13, in using this putting method, the golfer stands with his body B positioned so that the front of his body B is approximately perpendicular to the target line 24*a* and its rearward extension 24*b*. As depicted in FIG.

13, he stands to the right of the target line 24*a* with both feet on the same side of the target line. His feet preferably are about even with each other, about 1 to about 2 feet apart. His body B faces the same general direction as the target line 24*a* as shown by the arrow a. As shown in FIGS. 8 through 12, he bends forward from his hips so his shoulders S are slightly forward. Preferably, his left arm and hand hang vertically to his side as depicted in FIGS. 8, 9, 10 and 11. The right arm is in a position to freely swing backward and forward parallel to the target line 24*a*. The ball 20 rests on the surface of the green 21*a* located at a distance t of about four to eight inches to the left of the toe of his left shoe and a distance u about even with, or up to 6 inches forward, of the toe of his left shoe according to individual preference.

The forward facing body position provides the golfer with a direct, forward and natural view of the hole 22 and permits the golfer to consistently swing the putter 10 back and forward over the rearward extension 24*b* of the target line 24*a* and forward over the target line in the follow-through stroke, rather than from side to side as in two-handed putting.

ARM ACROSS BODY. The dominant arm holding the putter is positioned across the front of the body to permit the golfer to easily swing and control the one-hand and arm putting movement and control the putter going backward and forward over and along the target line.

While holding the putter 10 as described herein, the golfer places his right hand and arm and the putter 10 diagonally across the front of his body B as depicted in FIG. 8. The putter head 14 is placed just behind the ball 20 and about four to six inches to the left of the toe of the golfer's left shoe and about even with or up to six inches forward of the toe of the left shoe. The position of the putting arm in front of the body B permits the golfer to control the stroke, the arm and to swing rearward in the backstroke, and forward stroke over the rear extension of the target line 24*b*, away from the body B, over the target line 24*a*, in the follow-through stroke.

NO BODY MOVEMENT—The methods of this invention restricts movement of the body during the putting stroke.

Body B movement can adversely affect the accuracy of the putting stroke. Consequently, greater putting accuracy is achieved when the golfer's body B (excluding the dominate hand, arm and rotation of the shoulder) does not move during the putting stroke. Ideally, the center of gravity of the torso of the body B remains in place during the putting stroke.

A small amount of body B movement can result in a slight change in the angle of the putter face 18, or in the direction of the swing path of the putter head 14, or the angle of ascent or descent of the putter head 14, which can cause inaccurate and inconsistent putting.

Keeping the body still with no movement of the body's center of gravity during the putting stroke will result in greater putting control and consistency. In other words, the less body B movement during the putting stroke reduces the tendency for an unwanted change in the orientation of the putter face 18, and/or direction of swing path, and/or the angle of ascent or descent of the putter head 14.

Using this invention, the torso of the golfer's body B does not move and does not play a moving role in executing the putting stroke. The only shift of body B weight results from the swinging movement of the mass of the right arm as it moves through a short, shallow arc on the left side of the body B. Also, the one arm swings from a single stationary pivot point (the right shoulder socket), which causes the humerus bone to swing in a pendulum movement, or the pivot point moves forward during the Scapular follow-through stroke discussed subsequently.

In contrast, in traditional two-handed putting methods there is a tendency for the body's center of gravity to shift during the putting stroke. This tendency is due to some or all of the following: the small rotation of the trunk of the body B around the axis of the spine, the rotation of the mass of the upper back, shoulders and chest in a shallow arc, the swinging movement of the mass of both arms, and the swinging movement of the mass of the putter 10. These movements tend to shift body B mass and are substantially more complex than those of this invention. Consequently, through the use of this invention, there are considerably fewer tendencies for the golfer's body B to move during the putting stroke.

HOLDING THE GRIP—Holding of the grip of the putter in this invention combines the hand and arm into a single, unified, firm and efficient putting instrument.

The golfer's grasp of the grip 16 is vital in controlling the putter 10 and the successful employment of the methods of this invention. As shown in FIGS. 6, and 7, the golfer places his right hand around the lower portion of the grip 16. The hand grasp of the grip 16 can be done in two ways in the use of this invention.

The first way to grasp the grip 16 is for the grip to lie across the middle of the palm, to the middle of the heel of the hand to the middle of the wrist as shown in FIG. 6A. The index finger of the right hand extends down the front side of the grip 16, as shown in FIGS. 6A, 6B and 6C. The hollow of the palm of the hand is closed around the front side of the grip 16 as shown FIG. 6B. The heel of the hand is at the middle of the underside of the wrist and rests against the front of the grip 16 as shown in FIG. 6B.

The second way to grasp the grip 16 is for the grip 16 to lie over the first joint of the middle finger of the hand, and diagonally across the lower portion of the palm to corner of the palm between the pad of the hand and the heel of the hand, FIGS. 6D, 6E and 6E. The index finger of the right hand extends down the front side of the grip 16. The middle, ring and little fingers close around the grip 16, keeping the grip 16 against the pad of the hand as shown in FIG. 6E. The grip 16 is not lying near the middle of the underside of the wrist as described in the first way to hold the grip 16. As shown in FIG. 6E, on closing the hand, the middle, ring and little finger curl around and hold the grip 16. The thumb lies on the side of the grip 16 between the index finger and the middle finger.

When using either of the two methods for the hand to hold the grip 16, the index finger is pushed back against the grip 16. This levers the intermediate front side of the grip 16 into the underside of the forearm and levers the front side of the top portion of the grip 16*a* into the shallow natural depression of the upper arm between the protrusion of the medial epicondyle, common called the 'funny' bone, on the bottom, and the lower underside portion of the biceps brachii muscle, on the top as illustrated in FIGS. 6A, 6B, 6C, 6D, 6E, 6F, 11 and 12. Or, this levers the front side of the top portion of the grip 16*b* is levered into the soft tissues adjacent to the underside of the mid-bicep muscle region FIG. 6G of the right arm. All parts of the fingers, hand and arm that touch the grip 16 are important and integral components to control the putter 10 and contribute to forming the unique hand-wrist-arm-elbow configuration employed in this invention.

As shown in FIGS. 8 and 11, preferably, the elbow is crooked or bent inward at the address of the ball 20 so that the angle A at the elbow between the forearm and upper arm is from about 120 to about 160 degrees, preferably about 140 degrees. The crooked or bent elbow:

1. positions the elbow, the arm and the socket of the shoulder at angles to one another FIGS. 8, 9, and 12 that tends to cause the putter face 18 to be aimed down the target line 24*a* throughout the movement of the putter 10 in the backstroke, forward stroke and follow-through stroke, and
2. strengthens the hold on the grip 16 and creates additional leverage within the hand-wrist-arm-elbow configuration, so that the grasp of the putter 10 is firm and thereby able to control the path of the putter head 14, control the orientation of the putter face 18 during the putting stroke, transfer the force generated by the putting stroke, and withstand the stress of the putting stroke and the putter face 18 striking the ball 20, and
3. places the arm in a leverage position that permits the golfer's muscles around the shoulder area to create optimal power to move and control the putting stroke.

The result is that the golfer forms his hand, arm and putter 10 into a firm and unified putting tool that, during the putting stroke, enables the golfer to exercise considerable control over the orientation of the putter face 18 and the path of the putter head 14.

In this invention, the following factors are responsible for the golfer's ability to securely hold the grip 16 of the putter 10:

1. the force of the index finger pushing backward,
2. the force of the palm and heel of the hand, using the first way of grasping the grip 16, or the force of the palm and the pad of the hand, using the second way of grasping the grip 16,
3. the grasping force of the last three fingers and the hand against the grip 16,
4. the levered force (due to the backward push of the index finger against the grip 16) of the intermediate portion of the grip 16 against the under side of the forearm, and
5. the levered force of the top end 16*b* of the grip 16 against the lower underside portion of the humerus bone or the mid-bicep region.

All the forces exerted by these factors are directed along lines of force that are about parallel to the target line 24*a*, either pushing forward towards or backward away from the target line 24*a*. This manner of holding the grip 16 tends to cause the hand-wrist-arm-elbow configuration to move backward and forward about parallel to the target line 24*a*. This holding method firmly places the wrist, hand and arm into a position that restricts the wrist, fingers and elbow from flexing or extending, and also restricts the hand, wrist and arm from rotating during the putting stroke. All these forces holding the grip 16 provide considerable control over the putter's velocity and the directional of movement putter head 14 and thereby tend to improve putting accuracy and consistency.

HAND-WRIST-ARM-ELBOW-CONFIGURATION The hand-wrist-arm-elbow configuration of this invention tends to cause the putter face to stay aimed down the target line and tends to cause the putter head to move along a path overlying the target line and its rearward extension during the putting stroke.

The grasp of the grip 16 by the right hand and the last three fingers, and the pressed index finger and the levered pressure of the grip 16 against the underside portion of the forearm and elbow as shown in FIGS. 6 through 6F, or mid-bicep region as shown in FIG. 6G of the upper arm, creates a unified, controlled, firm, but not rigid, hand-wrist-arm-elbow configuration. This hand-wrist-arm-elbow configuration and its use provide several benefits that encourage accurate and successful putting.

First, holding the grip 16 in the above-described manner, in particular, the index finger pushing backward against the grip 16, the middle, ring and little fingers acting as a fulcrum which levers the top end 16*b* of the grip 16 into the underside, lower portion of the humerus bone or mid-bicep region, creates a locking pressure between the golfer's right hand, wrist, lower arm, elbow, upper arm, and the grip 16 of the putter 10 to create a single unit that remains essentially unchanged during the entire putting stroke. Consequently, the putter face 18, held firmly, tends to remain in its address position, aiming down the target line 24*a*, throughout the entire putting stroke.

Second, the putter head is predisposed to move either directly backward and forward over the target line 24*a* and the rearward extension thereof 24*b* as a result of the forces and pressures that control the hand-wrist-arm-elbow configuration, which either exert pressure backward and forward of the target line 24*a*. Thus, the path of the putter head 14 tends to move straight back and forward over the target line 24*a* and its rearward extension 24*b*.

Third, the muscles and joints that control the orientation of the putter face 18 and the direction of movement of the putter head 14 during the putting stroke, namely the right hand and the arm, up to and including the elbow or mid-bicep region, act independently and separately from the joints and muscles that supply the power of the stroke, namely, the shoulder joint and socket and the lats muscles (refers to the right latissimus dorsi muscle and its supporting muscles of the golfer), the scapular muscles, which refer herein to the contractible fiber tissues that effect and support the anterior movement, protraction and abduction of the right scapula bone and the anterior movement of the right shoulder socket (pivot point) and their supporting muscles and the deltoid muscles.

Fourth, the shoulder joint and socket of the right arm act as a pivot point around which the top of the humerus bone rotates around a stationary pivot point as depicted in FIGS. 12B, 12C, 12D, 12F, 12G, 12J, 12K, 12N, 12O, 12P, and 12Q or the pivot point moves forward as depicted in FIGS. 12H and 12L. The lats muscles swing the humerus bone backward in the backstroke. The anterior deltoid muscles swing the humerus bone forward, or the scapular muscles, swing the shoulder pivot point forward during the follow-through stroke. The middle, ring and little fingers grasp the grip 16 and act as a conduit to transfer the forward force of the arm to the grip 16 during the forward stroke. This separation of the body parts that hold the grip 16 (the hand and the arm, up to and including the elbow or mid-bicep region) from the body parts that provide the power for the forward stroke (the anterior deltoid, scapular and supporting muscles) tends to prevent the power source from interfering and adversely affecting the control source, which might otherwise change the orientation of the putter face 18 and/or the direction of the path of the putter head 14.

Fifth, during the putting stroke, the golfer uses his tactile sensory capabilities. During backstroke and/or any pause at the end of the backstroke, the golfer uses the sensory capabilities in his fingers, hand and arm to measure the pressures of these body parts against the grip 16. He then mentally compares those pressures against those same pressures that he remembers existed at the address. He then adjusts those pressures, if necessary, to match the amount of pressure at the address plus the additional pressure from inertia acting on the mass of the putter head. He then begins the forward stroke and keeps that address pressure constant throughout the forward stroke and to the finish of the follow-through stroke. Keeping these pressures the same throughout the putting stroke, especially during the forward stroke, tend to keep the putter face in the same position as it was at the address, i.e. square to the target line 24*a*.

Sixth, the golfer keeps the angle of the elbow the same throughout the stroke as it was at the address with no additional flexing or extending of the elbow, except as shown in FIGS. 12J and 12N. Any changes of these pressures or changes in the angle of the elbow tend to cause the putter face 18 to turn from its intended position.

Thereby, through the use of this invention, the putter face 18 tends to remain aimed down the target line 24*a* during the putting stroke as it was at the address.

SHIFT BODY TO LEFT. At the address the body is shifted laterally toward the target line, so that preferably the golfer's eyes are directly vertical over the target line.

As best shown in FIGS. 8 and 11, at the address, the golfer's hips are shifted laterally to the left, without moving the position of his feet, so that most of the weight of his body B is over his left leg. He leans his torso and head to the left to such a degree that preferably his eyes are essentially directly vertical over the target line 24*a* enabling him to look directly at the alignment lines 14*a* and 14*b* on the putter head 14.

HEAD HORIZONTAL AND EYES VERTICAL OVER THE TARGET LINE. As used in this invention, at the address and throughout the putting stroke, the golfer's eyes are preferably placed directly vertical over the target line. The eyes are in a level, horizontal position in order to look down at the putter head or forward along the target line. This eye position permits the eyes to function in a natural, accurate and effective manner.

Human eyes operate most accurately and effectively when they are used to look forward from a frontal, level and horizontal position. The method of this invention capitalizes on this. As best shown in FIGS. 8, 9 through 9D and 10, the golfer adjusts the tilt of his head to a substantially horizontal position. His eyes are vertical over the target line 24*a*, and when looking down at the putter head 14, are vertically over the target line 24*a*. The golfer can look down at ball 20 and the putter head 14 at the alignment lines 14*a* and 14*b*, or he can look forward down the target line 24*a* or at the hole 22, with his eyes in a frontal, level horizontal position. His eyes are in their most optimal optical position to aim the putter 10, judge direction and distance, and stroke the putter head 14 along and over the target line 24*a*.

In contrast, the eyes of a golfer using traditional two-handed putting methods face about 90 degrees away from the target line 24*a*, which causes the golfer to turn and tilt his head to the left and look out of the corners of his eyes as he looks down the target line 24*a* to aim the putt, and/or to estimate the distance of the putt, or otherwise prepare to putt. When standing in the address position, the position of the eyes using traditional two-handed putting is inefficient and subject to considerable error in judging direction, distance and contours of the surface of the green 16*a*.

AIMING THE PUTTER FACE. During the address phase of putting, the golfer aims the putter face by causing the alignment lines on top of the putter head used in this invention to point down the target line and/or the putter face to be perpendicular to the target line while keeping the integrity of the hand-wrist-arm-elbow configuration and its relationship to the golfer's putting stance in tact.

In order to aim or adjust the aim of the putter face 18 toward or down the target line 24*a*, during the address phase, the golfer preferably places his eyes directly vertical over the target line 24*a*. He focuses on the two alignment lines 14*a* and 14*b* on the putter head 14 which will appear as one continuous line. He causes the lines to point directly down the target line 24*a*. He also may cause the faceplate 5 to be perpendicular to the target line 24*a*. After the golfer has addressed the ball 20, all parts of the body B and putter 10 are in an integral position. The golfer aims or adjusts the aim of the putter face 18 by altering his stance, that is, he keeps all parts of his body B and the putter 10 in their same relative positions as they were at the address and he repositions only his feet to aim of the putter face 18 down the target line 24*a*. This method of aiming the putter face 18 keeps the body B, the right arm, and the putter face 18 together as a single unit without readjusting their relative positions. Thus, hand-wrist-arm-elbow configuration and the body B are kept in the same relative positions as they were at the initial address position. The putter head 14 is not moved separately (without a proper shift of the body B) to cause the putter face 18 to be aimed down the target line 24*a* as that would adversely change the relationship between the body B, the hand-wrist-arm-elbow configuration and the putting stance, and hinder the putter head 14 from traveling back and forward over the target line 24*a*.

KEEPING THE PUTTER FACE AIMED DOWN THE TARGET LINE. Accurate putting requires the putter face to be aimed down the target line when it strikes the ball. The method of this invention encourages the putter face to be aimed down the target line at impact with the ball.

In order for a golfer to consistently strike the ball 20 in the direction of the target line 24*a* it is important that the putter head 14 be aimed down the target line 24*a* at the point of impact with the ball 20. Also, it is important that during the forward stroke, the putter head 14 moves along a path in a vertical plane directly over the target line 24*a* and its rearward extension 24*b*.

When using this invention, a golfer has the putter head 14 aimed down the target line 24*a* when it strikes the ball 20 by doing the following.

One, the golfer maintains the integrity of the hand-wrist-arm-elbow configuration by holding the grip 16 firmly, but not rigidly. During the entire putting stroke, the same amount of hand and arm pressure is exerted against the grip 16 as existed at the address position. During the stroke of the putt, the golfer neither permits the right elbow to change its flex or extend position from the way it was at the address position, except when the method depicted in FIGS. 12J, and 12N is employed.

Two, he uses either (1) a pendulum putting stroke wherein the right shoulder is in a stationary pivot point position during the backstroke, forward and follow-through stroke as illustrated in FIGS. 12A, 12B, 12C and 12D (as described in the Backstroke, Forward Stroke and Follow-Through Stroke sections herein) or (2) a linear backstroke and forward stroke wherein the flexed elbow moves backward and forward parallel to the target line 24*a* and the right shoulder is in a stationary pivot point position as depicted in FIGS. 12J, 12K, 12N and 12O or (3) a scapular follow-through stroke wherein the pivot point of the right shoulder moves forward on a line parallel to the target line 24*a* as depicted in FIGS. 12H and 12L, and described in the follow-through stroke section herein.

Three, as depicted in FIG. 8, he coordinates the lie of the putter 10, the position of his hand on the grip 16, the crook of the elbow and the location of the ball 20 to specific distances from the left foot so that during the entire putting stroke the putter face 18 tends to be and remain aimed down the target line 24*a*. Practice and experience will teach golfers the exact location for their optimum lie of the putter 10, hand, elbow and ball positions to cause the putter face 18 to be and remain aimed down the target line 24*a* during the putting stroke.

Four, preferably, if the golfer chooses, he can visually monitor the two alignment lines 14*a* and 14*b* during the backstroke and any pause at the end of the backstroke, to determine whether these alignment lines 14*a* and 14*b* are overlying the target line 24*a* and the putter face 18 has stayed square to the target line 24*a*. If the alignment lines 14*a* and 14*b* do not point down the target line 24*a* and/or the putter face 18 is not square with the target line 24*a*, the golfer may adjust the alignment lines 14*a* and 14*b* to point down the target line 24*a* and/or adjust the putter face 18 to a position that is square with the target line 24*a*, during the backstroke and/or during any pause at the end of the backstroke.

Five, at the address position, the golfer aims the putter face 18 by squaring it with the t line 24*a*. The golfer causes his eyes to be positioned vertically over the target line 24*a* in such a manner that the two alignment lines 14*a* and 14*b* appear to be one continuous straight line to the eyes and point down the target Line 24*a*. Therefore, the putter face 18 is aimed down the target line 24*a*. During the entire stroke the two lines are to appear as pointing down the target line 24*a*.

Six, during the forward stroke the golfer uses inertia operating on the mass of the putter head 14 to lever additional pressure of the front of the top end of the grip 16*a* against the lower underside portion of the humerus bone or the mid-bicep region. The direction of the additional pressure of the top end 16*b* of the grip 16 against the humerus bone or mid-bicep region is forward and about parallel to the target line 24*a*. The additional pressure also adds additional firmness to the hand-wrist-arm-elbow configuration. As a result of the additional firmness to the hand-wrist-arm-elbow configuration, the putter face 18 is held more firmly and securely in its square to the target line 24*a* position.

PUTTER HEAD ACCELERATION. Control of putter head acceleration is a major component to produce the desired putter head velocity when the putter face strikes the ball. Putter head velocity controls much of the character of movement of a putted ball. The method of this invention creates an Acceleration Gauge within the dominant arm of the golfer by which the golfer is able to know through a tactile sensation in the arm and thereby control the acceleration of the putter head during the forward stroke and follow-through stroke.

In general terms, speed is the rate at which an object moves; velocity is the speed at which an object moves in a certain direction; and acceleration is the increase in the rate of velocity at which an object moves compared to its previous velocity during a specific period of time.

Expert golfers and instructors generally agree that acceleration of the putter head 14 in the forward stroke at the point of impact with the ball 20, using any putting style, is critical and has multiple benefits for skillful, accurate and consistently good putting. An outline of some of the benefits of controlled putter head 14 acceleration (not necessarily in order of importance) include: (1) a tendency to improve the timing and coordination of the moving parts of the stroke, (2) a tendency to improve the tempo of the stroke, (3) a tendency to control putter head 14 velocity, (4) a tendency to control the velocity of a putted ball 20, and the distance it will travel on the surface of the green 21*a*, (5) a tendency to control the orientation of the putter face 18, (6) a tendency to control the path over which the putter head 14 travels, (7) a tendency to produce a firm contact between the putter face 18 and the ball 20, (8) a tendency to keep the wrist, hand and elbow and arm in their desired flex or extended positions, (9) a tendency to cause the moving parts of the putting stroke to move parallel to the target line 24*a*, and (10) a tendency to pull the putter head 14 into the ball.

These benefits are fulfilled by use of this invention. Through the use of this invention, as explained below, the putter head 14 tends to accelerate at a constant rate during the forward putting stroke. The constant acceleration rate of this invention is the result of the golfer being able to control the contraction of the power source muscles that control the forward stroke. Through practice the golfer attains consistency and greater accuracy in putting. According to this invention, the primary muscles that power the forward stroke are the right shoulder muscles and their supporting muscles. As a result, the forward power source controls the forward stroke; it leads the movement of the putter head 14 and pulls it forward. A putter head 14 that is pulled forward directly follows the leading movement of the power source. In this invention, the power source moves the arm about parallel to the target line 24*a*, which pulls the putter head 14 along the target line 24*a*.

Generally, when the power source for putting is not accelerating, the golfer is not in control of the movement of the putter head 14, and other forces tend to exert their influences on the putter movement, the putter head's path of direction and velocity. Such influences by other forces tend to move the putter head 14 in ways that conflict with pulling the putter head 14 along and over the target line 24*a*. Some of these other forces include, the rotation of the arm and hand, the flex or extension of the wrist or elbow, a change in finger and hand pressure, the movement of the arm in a direction other than parallel to the target line 24*a*, a change in the relative positions of the moving parts of the body B, and a change in the timing and tempo of the moving parts of the body B.

An important and unique feature of this invention is that it permits the golfer's tactile sensory capacities to monitor the acceleration of the putter head 14. Specifically, the pressure of the end 16*b* of the shaft 16 against the golfer's arm remains essentially constant as long as the acceleration is constant. The golfer can detect any change in pressure during the forward and follow-through stroke. This creates within the golfer's tactile sensory capacities of the right arm an Acceleration gauge, so to speak, by which the golfer can feel, monitor and judge the acceleration of the putter head 14 during the most important part of the stroke to sense acceleration, i.e. the forward stroke. Therefore, the golfer can better know and control the velocity of the putter head 14, to cause the ball 20 to tend to roll the desired distance on the green 21.

The golfer creates and uses this Acceleration gauge within his right arm, as follows.

First, after the backstroke is completed, as described herein, the golfer contracts the anterior deltoid muscles of the right arm to swing the humerus bone forward on a line about parallel to the target line 24*a* at an acceleration rate that the golfer believes will cause the putter head 14 to move forward so that the putter head will reach the desired velocity just when the putter face 18 strikes the ball 20. The anterior deltoid muscles are contracted in a way that the upper portion of the humerus bone swings from the stationary pivot point of the shoulder socket that joins the humerus bone with the shoulder. As a result of the forward swing of the humerus bone, the hand-wrist-arm-elbow configuration, the putter 10 and the putter face 18 are also moved directly forward on a line that is parallel to the target line 24*a*.

Second, when the mass of the putter head 14 begins its forward movement inertia acts upon that mass tending to cause the putter head 14 to remain at rest.

Third, the putter head 14, tending to remain at rest, accelerates forward at a rate slower than the forward movement of the hand-wrist-arm-elbow configuration. Thereby, a lever action is created in which the putter head, lagging behind the faster moving hand, through the use of the middle-ring-little fingers acting as a fulcrum, levers the top of the grip 16*b* into the lower end of the humerus bone or the mid-bicep region. This lever action presses the top end 16*b* of the grip 16 into the arm, establishing a pressure that will change upon a deviation in acceleration. The amount of pressure exerted against the lower underside of the humerus bone or the mid-bicep region of the golfer by this inertia induced lever action is pressure added to the pressure already exerted by the lever action of the index finger pushing backward against the grip 16, as elsewhere described herein.

Fourth, the golfer's tactile sensors in the region where the top of the grip 16*b* contacts the lower humerus or the mid-bicep region register the amount of that levered pressure. That pressure information is transmitted to the brain. The brain translates the pressure information to recognize the rate of acceleration of the putter head.

The golfer can now feel and know whether the putter head 14 is accelerating and whether the acceleration is at a rate that he desires for the putt he is then making. If the acceleration rate is slower than desired, the golfer can increase the rate of acceleration by increasing the rate of contraction of the forward power source muscles until the desired rate of acceleration of the putter head is reached. If the acceleration rate is faster than desired, he can reduce the rate of acceleration by decreasing the rate of contraction of the forward power source muscles until the desired rate of acceleration of the putter head is reached.

Through experience a golfer learns just how fast to contract the forward power source muscles to move the hand-wrist-arm-elbow configuration forward to cause inertia, which tends to hold the putter head 14 at rest, to lever the front side of the top of the grip 16*b* into the lower underside portion of the humerus or the mid-bicep region at a pressure that indicates a rate of acceleration of the putter head 14 that the golfer desires for the particular putt the golfer is making. The golfer then continues to contract the forward power source muscles at a constant rate so that the top end 16*b* of the grip 16 presses against the arm at a constant pressure that assures the golfer that the putter head 14 is accelerating at the desired rate. As a result of the golfer's control of the acceleration of the putter head 14, the golfer can accurately control the velocity of the putter head 14 at the point of impact with the ball 20. Control of the velocity of the putter head in the forward stroke, and in particular at the point of impact with the ball 20, is a major element in controlling the distance a ball 20 will travel over the surface of a green 21.

Most golfers with practice can master the use of acceleration and the acceleration gauge of this invention.

CONTROL OVER DISTANCE. Putter head velocity at the point when the putter face impacts the ball is the single most important factor, under control of the golfer, to determine the distance a ball will roll on a green. This invention uses the acceleration gauge to control and monitor the velocity of the putter.

The main component, under control of the golfer, to cause a putted ball 20 will roll over the surface of a green 21 to a desired distance is control over the velocity of the putter head 14 at the point when the putter head 14 impacts the ball 20. The acceleration gauge monitors the putter head 14 velocity during the forward putting stroke, so that the golfer may adjust the acceleration rate and cause the ball to roll over the surface of a green to the distance desired by the golfer. The simplicity of the mechanics of this putting method and the ease with which this method can be performed also adds to the control of the distance a putted ball 20 will roll.

SEPARATION OF POWER AND CONTROL This invention achieves better management of the distance a putted ball travels and better control of the direction of a putted ball by separating the energy sources that supply the power from the energy forces that control the direction of the movement of the putter head path and the orientation of the putter face.

It is important to distinguish between the force and forces that produce the power for the putting stroke and the force or forces that provide the control of the orientation of the putter face 18 and control the direction of the path the putter head 14 during the putting stroke.

Generally, the power source (the muscles providing the energy) for the putting stroke determines the distance a putted ball 20 will roll over the surface of a green 21*a*. The control source of the putter 10 (the muscles of the hand-wrist-arm-elbow configuration in this invention) determines the direction of the stroke path of the putter head 14 and orientation of the putter face 18 during the putting stroke.

A unique aspect of this invention is the source of the force that provides power for the backstroke (lats muscle) and the forward stroke (anterior deltoid muscles) is separated from the source of the force that controls the orientation of the putter face 18 and the direction of the path of the putter head 14 during the swing (the hand-wrist-arm-elbow holding configuration). Thus, the power function and the control function are fulfilled separately and do not interfere with the function of each other. The result is improved putting accuracy and consistency.

This invention controls the stroke path of the putter 10 and the orientation of the putter face 18 through the use of multiple pressure contacts with the grip 16, through the unique hand-wrist-arm-elbow configuration employed in this invention. These contacts are positioned along about 16 to about 22 linear inches of the grip 16, depending on the golfer's hand size and forearm length. These contacts create many forces compatibly and harmoniously working together, and not conflicting or hindering one another. These forces are created to be about parallel to the target line 24*a*, which tends to cause the putter and the right arm to more easily move parallel to the target line 24*a* during the putting stroke. This method of holding the grip provides superior control of the putter than the grip holding methods of traditional two-handed putting.

This invention obtains the power for the putting stroke from one source, the muscles surrounding the right shoulder, i.e., the lats and anterior deltoid muscles. The power from these shoulder muscles is transferred to the putter through the hand-wrist-arm-elbow configuration. The putting stroke of this invention is simple, uncomplicated and repeatable. The muscles that control the hand-wrist-arm-elbow configuration supply no energy or movement for the power to perform the putting stroke movement.

Traditional two-handed putting methods have several sources for putting power. Some are: (1) the rotation of the upper back around the axis of the spine, (2) the swinging of the arms, in unison or with one arm or the other in control, and (3) the flex and extension (hinging) of the wrists. The power created by the rotation of the back is transferred to the putter through both shoulders, the two arms, both hands and the fingers of both hands. The power of the swinging arms is transferred to the putter through the two arms, both hands and the fingers of both hands. The power of the wrists is transferred to the putter through both hands and the fingers of both hands. All of these two-handed power-providing methods require the movement, timing and coordination of many body parts, which makes accurate and consistent putting difficult.

Traditional two-handed putting uses the grasp of a second hand opposing the first hand in an attempt to provide putter control. The use of the second hand does establish some power and control of the putter, however two hands on the grip also creates control difficulties as the energy sources for power and control frequently interfere and conflict with the movement and purposes of each other, as discussed below.

One of the main reasons for the inaccuracies and inconsistencies of traditional two-handed putting is that those methods tend to mix or combine the sources of force to provide both the power and control together. Two joined hands, arms and shoulders frequently compete for control and power and/or oppose one another. The movement by one part of the body B for one purpose, for instance, to power the stroke, may oppose and frustrate the purpose of another body B part, for instance, to control the direction of the putter head 14 path and orientation of the putter face 18. The sources for power over the putting stroke (the right or left hand, wrists, arms or shoulders) may conflict and compete to dominate. Also, those same sources may conflict and compete to control the direction of the putter head 14 path and/or the orientation of the putter face 18. One purpose frequently conflicts with another. These are some of the reasons that tend to cause two-handed putting to be difficult, inaccurate and inconsistent.

DIRECT FORWARD SPIN. Through the use of this invention, the putter face gives the ball direct forward spin when it is strikes the ball. Such direct forward spin tends to aid the ball to roll over small obstacles it may hit on the surface of the green and stay more true to its initial path and roll to a longer and more consistent distance on a green.

A ball 20 putted by use of the method of this invention receives direct forward spin. A ball 20 putted by the use of traditional two-handed putting methods is given no immediate spin or it may be given some backs pin. Therefore, a ball 20 struck using two-handed putting methods will immediately skid and slip over the surface of a green 21*a* until friction with the green causes the ball 20 to roll with out skidding and slipping.

A ball 20 that has direct forward spin when struck, as in this invention, will deviate less from its initial path. Also, with direct forward spin, the ball 20 will roll a longer and more consistent distance on a green even if it should hit small obstacles, pebbles, or irregularities on the surface of a green. This is especially true for a short distance when the ball first leaves the putter face.

A golfer using this invention:

(1) addresses the ball 20 with the putter shaft 12 inclined at about 2 to 12 degrees in relation to the surface of a green 21*a* as shown in FIGS. 9, 10 and 12, (2) the putter face 18 is declined at about the same degrees as the shaft is inclined to the surface of the green 21*a*, so that the face 18 is vertical to the surface of the green 21*a* at the address and when it strikes the ball 20 as shown in FIGS. 3 and 3A, (3) the backstroke is relatively short and close to the surface of the green 21*a*, as shown in FIGS. 3B, 12F, 12J and 12N, the forward path of the putter head 14 is inclining at about 4 degrees in relation to the surface of the green 21*a* when it strikes the ball 20, FIGS. 3C, 12C, 12G, 12K and 12O, and (5) the path of the putter head 14 continues to incline at about 4 degrees or more during the follow-through stroke as shown in FIGS. 12D, 12H, 12L, 12P and 12Q.

The inclined path of the putter head 14 and the vertical putter face when it strikes the ball 20 causes the surface of the ball 20, at the point of impact, to rotate forward. The vertical putter face 18 when it strikes the ball 20 causes the ball 20 to immediately move directly forward over the surface of the green 21*a*. The circumference of the ball 20 immediately rotates forward at about the same rate as the linear forward movement of the ball. Therefore, the ball 20 begins its movement without skidding and slipping. The initial rotation of the ball 20 tends to aid the ball 20 to roll over obstacles that it may hit on the surface of the green 21*a* and be less affected than if the ball 20 was given no direct forward spin.

In contrast, no spin is generally initially given a ball 20 using traditional two-handed putting methods. Using traditional two-handed putting:

(1) the ball 20 is addressed with the shaft about vertical to the surface of a green 21*a*, and (2) the putter has a face that is inclined from about 2 to 5 degrees in relation to the extension of the putter shaft and is inclined at about 2 to 5 degrees at the address, and (3) the backstroke relatively short and close to the surface of the green 21*a*, and (4) the forward path of the putter head is about parallel to the surface of the green 21*a* and the putter face is inclined 2 to 5 degrees when it strikes the ball, and (5) The weight of the ball is wholly or partially lifted above the surface of the green 21*a*, and (6) the path of the putter head continues forward about parallel to the surface of the green 21*a* for a short distance and then inclines toward the end of the follow-through stroke.

When a lofted putter face having from 2 to 5 degrees inclination strikes the ball 20, all or some of the weight of the ball 20 is lifted off the surface of the green 21*a*. The ball's initial forward movement is without direct forward spin, i.e. it moves forward without rotating. When the weight of the ball returns to the surface of the green 21*a*, the friction between the surface of the ball and the surface of the green 21*a* causes the ball to skid and slip until the friction causes the ball to roll forward without skidding and slipping. The distance a ball 20 skids or slips depends on a number of factors, but generally it lasts from about one or two inches for short putts (2 to 4 feet); from about three to five inches for intermediate length putts (5 to 12 feet); and from about six to twelve inches for longer putts (15 feet and over).

During the period the ball is skidding and slipping, it has no direct forward spin to aid it in rolling over pebbles, protrusions, indentations and small obstructions it may hit on the surface of the green 21*a*. The ball is unstable and vulnerable to be moved off it's the line of the putt and subject to be slowed down more than if the ball had been given direct forward spin. Therefore, a ball given no direct forward spin and is wholly or partially lifted above the surface of the green 21*a*, may hit an object or indentation while skidding and slipping that changes the course of its direction. This is a source for inaccurate and inconsistent putting.

In summary, the use of this invention causes a putted ball 20 to begin its initial movement rolling without skidding and slipping. Small bumps, pebbles, indentations, irregularities and obstacles encountered by the ball 20 on the surface of the green 21*a* during the initial forward movement will have less effect on the forward projection of the ball 20 than a ball 20 given no direct forward spin or given Backspin. Also, the ball 20 will roll in a direction more true to the line of the putt as compared to a ball 20 given no direct forward spin and to a longer and more consistent distance.

FOUR PUTTING STROKES Four distinct, yet similar, putting strokes are used in this invention.

The second embodiment of this invention provides four distinct, yet similar, putting strokes. The first stroke is called the "Pendulum-Pendulum Stroke" and is the preferred stroke of this invention. Three other strokes are described and show some of the variation strokes that may be used. The first stroke is depicted by FIGS. 12A, 12B, 12C and 12D. The second stroke is called the "Pendulum-Scapular Stroke" and is depicted by FIGS. 12E, 12F, 12G and 12H. The third stroke is called the "Linear-Scapular Stroke" and is depicted by FIGS. 12L, 12J, 12 K and 12L. The fourth stroke is called the "Linear-Pendulum Stroke" and is depicted by FIGS. 12M, 12N, 12O and 12P. The "scapular" portion of the "Pendulum-Scapular stroke" and "Linear-Scapular stroke" refers here to the follow-through stroke of the putter of said stroke where the scapular muscles move the pivot point of the right shoulder forward. The "Linear" portion of the "Linear-Scapular Stroke" and "Linear-Pendulum Stroke" refer herein to the backstroke and forward stroke (up to the point where the putter strikes the ball) where in the elbow moves laterally back in the backstroke and laterally forward in the forward stroke while the angle at the elbow formed by the forearm and upper arm remains essentially the same as at the address.

Each of these putting strokes incorporates the principles of this invention. There are two variations of the backstroke and forward stroke; they are the Pendulum Stroke and the Linear stroke. There are two variations of the follow-through stroke; they are the Pendulum Stroke and the Scapular stroke.

The four putting strokes are similar to each other, yet are distinct from one another, as follows:

1. In the preferred Pendulum-Pendulum Stroke the parts of the hand-wrist-arm-elbow configuration are kept in their same relative positions as they were at the address shown in FIG. 12A and the shoulder pivot point (marked on the shoulder with a black dot D) stays in the same location throughout the stroke, FIGS. 12A, 12B, 12C and 12D.
2. In the Pendulum-Scapular Stroke the parts of the hand-wrist-arm-elbow configuration are kept in the same relative positions as they were at the address, and the shoulder pivot point (marked on the shoulder with the black dot D) stays in the same location during the address as shown in FIG. 12E, the backstroke as shown in FIG. 12F and the forward stroke as shown in FIG. 12G, however during the follow-through stroke the shoulder pivot point moves forward to the point marked by the black dot D1 as shown in FIG. 12H.
3. In the Linear-Scapular Stroke, at the address the parts of the hand-wrist-arm-elbow configuration are in the same positions as shown in FIGS. 12A and 12E; during the backstroke the elbow moves backward in a linear fashion and during the forward stroke the elbow moves forward in a linear fashion, as opposed to keeping the hand-wrist-arm-elbow configuration in tact, as in the backstroke depicted in FIGS. 12B and 12F; and the forward stroke depicted in FIGS. 12C and 12G. The shoulder pivot point (marked on the shoulder with a black dot) stays in the same location during the address as shown FIG. 12I, the backstroke as shown in FIG. 12J and the forward stroke as shown in FIG. 12K, however during the follow-through stroke the shoulder pivot point moves forward, FIG. 12L (marked on the shoulder by two black dots D and D1) from its position at the end of the forward stroke shown in FIG. 12K. The back black dot D refers to the position of the shoulder pivot point at the end of the forward stroke and the forward black dot D1 refers to the position of the shoulder pivot point at the end of the follow-through stroke.
4. In the Linear-Pendulum stroke, at the address the parts of the hand-wrist-arm-elbow configuration shown in FIG. 12M are in the same positions as they are in FIGS. 12A, 12E and 12I. During the backstroke, the elbow moves backward in a linear fashion as shown in FIG. 12N and during the forward stroke the elbow moves forward in a linear fashion as shown FIG. 12O, as opposed to keeping the hand-wrist-arm-elbow configuration in tact, as in the backstroke depicted in FIGS. 12B and 12F; and the forward stroke depicted in FIGS. 12C and 12G. The shoulder pivot point (marked on the shoulder with a black dot D) stays in the same location throughout the stroke as depicted in FIGS. 12M, 12N, 12O and 12P.

BACKSTROKE. The use of this invention permits a golfer to properly execute the backstroke, (using two backstroke-putting styles), to monitor and make adjustments to the putter face and putter head during the backstroke and any pause at the end of the backstroke, so that the golfer can accurately execute the forward stroke.

Two backstroke-putting styles may be used in this invention. In the first and preferred backstroke style, called the Pendulum backstroke, the lats muscles slowly and smoothly swing the lower portion of the humerus bone backward along a path that is parallel to the rearward extension of the target line 24*b*. The backward movement of the humerus bone moves the hand-wrist-arm-elbow configuration and the putter head 14 backward along and over the rearward extension 24*b* of the target line 24*a* as shown in FIGS. 12B, 12F and 9B. The shoulder pivot point remains in its address location as shown in FIGS. 12B and 12F.

In the second backstroke style, called the linear backstroke, the muscles of the right arm, as the primary moving muscles, contract to move the elbow backward in a linear fashion as shown in FIGS. 12J and 12N.

During the backstroke, and during any pause at the end of the backstroke, the golfer may watch and monitor the two alignment lines 14*a* and 14*b* and/or may watch and monitor the top edge 5*a* of the faceplate 5 to see whether:

1. the center of the putter face 18 moves over the rearward extension 24*b* of the target line 24*a*, 2. the putter head 14 continues to be square to the rearward extension 24*b* of the target line 24*a*, by either, looking to see whether the two alignment lines 14*a* and 14*b* appear to form one straight, continuous line and are pointing toward and along the rearward extension 24*b* of the target line 24*a* and/or the top edge 5*a* of the face plate 5 is perpendicular to the rearward extension 24*b* of the target line 24*a*.
3. the length of the backstroke is correct as determined by the golfer, and
4. the hand-wrist-arm-elbow configuration is the same as it was at the address, including the pressure of the fingers, hand, forearm and lower underside humerus area against the grip 16.

In the event any of the above movements, positions or pressures deviates from the desired positions, movements or pressures, the golfer can make the appropriate correcting adjustments during the backstroke and/or any pause at the end of the backstroke.

After the golfer makes any position and/or pressure adjustments during the backstroke and/or during any pause at the end of the backstroke, the putter 10 is in the proper position to execute the forward stroke and move the putter head 14 and propel the ball 20 down the target line 24*a*. This procedure, to make adjustments during the backstroke and/or any pause at the end of the backstroke, with practice may be mastered by most golfers and will establish habits that make those adjustments relatively easy.

Using traditional two-hand putting methods, frequently the face of the putter 18 is not square with the target line 24*a* at the end of the backstroke, and/or the golfer frequently begins the forward stroke before the backstroke is ended, i.e. the putter head is still moving backwards when the forward movement begins. Golfers using these two-handed putting methods generally do not and are unable to monitor and/or adjust the putter head or monitor and/or adjust the hand pressure holding the grip 16 during or at the end of the backstroke. Also, frequently the path of the putter head 14 in the backstroke deviates from the rearward extension 24*b* of the target line 24*a* and/or the holding pressure has changed from the amount of pressure at the address. However, these conditions usually go unnoticed using two-handed putting methods because they are not or cannot be monitored.

Visually monitoring the putter head 14 when using traditional two-handed putting methods is difficult because the golfer's two eyes are in a position that is about parallel to the target line 24*a*. Human eyes are better able to judge direction and the movement of an object in relation to a real or imaged straight line better when the eyes are over and perpendicular to the target line 24*a*, as they are in this invention.

FORWARD STROKE. The methods of this invention permit the golfer to accelerate the putter head forward to a velocity desired by the golfer at the point of impact between the ball and the putter face aimed at and traveling over the target line during the forward stroke using either of two forward stroke putting styles.

The preferred forward stroke putting style, using this invention is called the Pendulum forward stroke style. The golfer contracts the anterior deltoid muscles of his right arm and supportive muscles, as the primary moving muscles, to swing the lower portion of the humerus bone forward a short distance in order to cause inertia acting on the mass of the putter head 14 to lever and press the top end 16*b* of the grip 16 into the soft tissues adjacent to the lower underside portion of the humerus bone or the mid-bicep region. The top of the humerus bone rotates in the stationary socket of the right shoulder causing the forward stroke of the putter head 14 to be a pendulum arc swinging along a path that is along and over the rearward extension 24*b* of the target line 24*a* as shown in FIGS. 12C, 12G and 9C. Once the golfer feels this levered pressure against the lower underside portion of the humerus bone or the mid-bicep region, the golfer continues to contract these muscles to create the exact constant acceleration of the hand-wrist-arm-elbow configuration that the golfer judges to be necessary to create the desired putter head 14 velocity when the putter head 14 strikes the ball 20. He monitors the acceleration by feeling the pressure of the top end 16*b* of the grip 16 against the soft tissues adjacent to the lower underside portion of his humerus bone or mid-bicep region. The proper acceleration can be accomplished with a relaxed, evenly paced, smooth stroke. The putter face 18 is kept square to the target line 24*a* as described herein. (The control over putter acceleration is discussed in the Putter Head Acceleration section herein.) During the forward stroke as shown in FIGS. 12C and 12G the shoulder pivot point remains stationary in its address location shown in FIGS. 12A and 12E.

In a second forward stroke putting style, called the Linear forward stroke, the anterior deltoid muscles of the right arm, as the primary moving muscles, contract to move the elbow forward in a linear fashion as shown in FIGS. 12K and 12O. At the point where the putter head 14 contacts the ball 20, the hand-wrist-arm-elbow configuration is reestablished as depicted in FIGS. 12K and 12O, to a position that is similar to that at the address shown in FIGS. 12I and 12M. During the forward stroke the shoulder pivot point remains in its address location shown in FIGS. 12I and 12M.

FOLLOW-THROUGH STROKE. The follow-through stroke is a continuation of the forward stroke after the putter head has struck the ball using two follow-through stroke putting styles. The hand-wrist-arm-elbow configuration is kept intact during the follow-through stroke. The path of the putter head is over the target Line. When the putter head comes to a stop at the end of the follow-through stroke, the two alignment lines 14*a* and 14*b* appear to point down the target line and the putter face is perpendicular to the target line The first and preferred follow-through stroke putting style used in this invention is called the pendulum follow-through stroke style. The anterior deltoid muscles, as the primary moving muscles and supporting muscles, contract and cause the lower portion of the humerus bone to swing forward along a path that is parallel to target line 24*a*. The forward movement of the humerus bone moves the hand-wrist-arm-elbow configuration and the putter head 14 forward along and over the target line 24*a* as shown in FIGS. 12D, 12P, and 9D. The shoulder pivot point remains stationary as in its address location shown in FIGS. 12A and 12M.

A second follow-through stroke putting-style is called the scapular follow-through putting style. The golfer contracts the scapular muscles of the right shoulder during this follow-through stroke putting stroke style, which moves the pivot point of the shoulder forward as shown in FIGS. 12H and 12L. This forward movement of the pivot point provides force for the scapular follow-through putting stroke style and direction for the path of the putter head 14 and the angle of the putter face 18.

After the putter face, 5*a*, strikes the ball 20, the golfer continues to move the hand-wrist-arm-elbow configuration parallel to target line 24*a* and move the putter head 14 over the target line 24*a* at a constant acceleration. He keeps the putter head following the target line 24*a* and keeps the putter face 18 square to the target line 24*a*. The body B is kept still.

The golfer stops the follow-through stroke when he determines that the follow-through stroke is the proper length for the putt being executed. During, and at the end of the follow-through stroke, the hand-wrist-arm-elbow configuration is kept in tact as shown in FIGS. 12D, 12H, 12L, and 12P.

At the end of the follow-through stroke (1) the center of the putter face 18 is vertically over the target line 24*a*, (2) the alignment lines 14*a* and 14*b* appear to the golfer's as right eye to be one straight and continuous line overlying the target line 24*a*, (3) the putter face 18 is perpendicular to the target line 24*a*, (4) the hand-wrist-arm-elbow configuration shown in FIGS. 12D, 12H, 12L and 12P is in the same relative position as it was at the address shown in FIGS. 12A, 12E, 12I, and 12M and (5) the elbow is bent to the same degree that it was at the address shown in FIGS. 12A, 12E, 12I and 12M, indicating that the elbow has not additionally flexed or extended. With the putter 10 held in its stopped position, the golfer can visually check and monitor these five positions for the purpose of analyzing the correctness of his follow-through stroke.

A Third Embodiment

A third embodiment of this invention uses the putter 10 shown in FIGS. 1 and 1A. In this third embodiment, the golfer grasps the grip 16 with his right hand and right arm in the same manner as in the second embodiment and swings the putter 10 in the same manner as in the second embodiment, maintaining the positional relationship of the right hand, arm and putter. In this third embodiment, however, the left hand is also used to grasp the putter 10. The use of both hands substantially improves control of the putt.

BOTH HANDS AND ARMS HOLD THE PUTTER. The dominant hand and dominant arm are used to securely hold and control the putter through the use of multiple contacts with the grip, and the non-dominant hand and arm provide additional control and power. The mechanics of the putting stroke are thereby simplified, more easily performed and result in more accurate and consistent putting.

Using for example the putter 10 shown in FIG. 1, the golfer first grasps the grip 16 with his right hand as depicted in FIGS. 5 through 6G. Next, the golfer grasps the grip 16 with his left hand. There are several different ways the golfer may grasp the grip 16 with his left hand as illustrated in FIGS. 14A through 14E. The right hand and right arm hold the putter grip 16 during the putting stroke as described above in connection with the second embodiment, and the left hand and arm provide additional control and power. This simplifies the mechanics of the putting stroke used in the method of this invention.

A simple grasp of a putter grip 16 by only the right hand as discussed above in connection with the first and second embodiments of this invention, through an improvement over conventional putting methods, lacks the control over the path of the putter head 14 or control over the orientation of the putter face 18 as is achieved using both hands according to the third embodiment of this invention.

BODY POSITION WITH RESPECT TO THE TARGET LINE The golfer's body faces in the same general direction as the target line. The forward facing body position provides the golfer with a direct, forward and natural view along the target line and permits the golfer to consistently swing the putter back and forward over the rearward extension of the target line and forward over the target line in the follow-through stroke, (rather than from side to side as in traditional two-handed putting).

As shown in FIGS. 15 through 18, the golfer stands with his body B positioned so that the front of his body B is approximately perpendicular to the target line 24*a* and its rearward extension 24*b*. He stands to the right of the target line 24*a* with both feet on the same side of the target line. His feet preferably are about even with each other, about 1 to about 2 feet apart. His body B faces the same general direction as the target line 24*a* as shown by the arrow a. As shown in FIGS. 16A through 16C, he bends forward from his hips so his shoulders S are slightly forward and his shoulders are at a right angle to the target line 24*a*. Both arms are in position to swing freely backward and forward parallel to the target line 24*a*. The ball 20 rests on the surface 21*a* of the green 21 located at a distance t of about four to eight inches to the left of the toe of his left shoe and a distance u about even with, or up to 6 inches forward, of the toe of his left shoe according to individual preference.

The forward facing body position provides the golfer with a direct, forward and natural view along the target line 24*a* and permits the golfer to consistently swing the putter 10 back and forward over the rearward extension 24*b* of the target line 24*a* and forward over the target line in the follow-through stroke, rather than from side to side as in traditional two-handed putting.

He grasps the grip 16 with the right hand as discussed above in connection with the second embodiment and brings his right arm across this body B placing the putter head 14 just behind the ball 20 He then grasps the grip 16 with his left hand. The left hand, or a substantial part of the left hand, is placed on the grip 16 immediately below the right hand. FIGS. 14A, 14B, 14C, 14D and 14E illustrate five styles in which the left hand can be placed on the grip 16. The FIG. 14A style is the preferred style of holding the grip with the left hand. The position of both the arms in front of the body B permits the golfer to control the stroke, using both arms and to swing rearward in the backstroke, and forward stroke over the rear extension of the target line 24*b*, away from the body B, over the target line 24*a*, in the follow-through stroke.

As discussed above, greater putting accuracy is achieved when the golfer's body B (excluding the two hands, both arms and rotation of both shoulders) does not move during the putting stroke. Ideally, the center of gravity of the torso of the body B remains in the same place during the entire putting stroke. Keeping the body B still with no movement of the body's center of gravity during the putting stroke will result in greater putting control and consistency.

Using this invention, the torso of the golfer's body B does not move and does not play a significant role in executing the putting stroke. The only shift of body B weight results from the swinging movement of the arms as they move through a short, shallow arc on the left side of the body B as depicted in FIGS. 16A through 16C. Also, the arms swing from two single stationary pivot points, the shoulder sockets X and Y (FIG. 15), which cause the humerus bones to swing in a pendulum movement rotating about the pivot points X and Y.

As shown in FIG. 15, preferably, the right elbow is crooked or bent inward at the address of the ball 20 so that the angle A at the elbow between the forearm and upper arm is from about 120 to about 160 degrees, preferably about 140 degrees. The crooked or bent elbow:

(a) positions the elbow, the right arm and the socket X of the right shoulder at angles to one another (FIG. 15) that tends to cause the putter face 18 to be aimed down the target line 24*a* throughout the movement of the putter 10 in the backstroke, forward stroke and follow-through stroke, and (b) strengthens the hold on the grip 16 with his right hand and creates additional leverage within the hand-wrist-arm-elbow configuration, so that the grasp of the putter 10 is firm and thereby able to control the path of the putter head 14, control the orientation of the putter face 18 during the putting stroke, transfer the force generated by the putting stroke, and withstand the stress of the putting stroke and the putter face 18 striking the ball 20, and (c) places the right arm in a leverage position that permits the golfer's muscles around the right shoulder area to create optimal power to move and control the putting stroke.

The result is that the golfer forms his right hand, right arm and putter 10 with the assistance of the left hand and left arm into a firm and unified putting tool that, during the putting stroke, enables the golfer to exercise considerable control over the orientation of the putter face 18 and the path of the putter head 14.

The shoulder sockets X and Y, respectively of the right and left arms, act as two stationary pivot points around which the top of the humerus bones rotate. The lats muscles swing the humerus bones backward in the backstroke. The anterior deltoid muscles swing the humerus bones forward. The right hand and left hand grasp the grip 16 and act as a conduit to transfer the forward force of the arms to the grip 16 during the forward stroke. Most of the force is provided by the right hand. This separation of the body parts that hold the grip 16 provides control of the direction of the putt (the hands and the arms) from the body parts that provide the power for the forward stroke (the anterior deltoid, scapular and supporting muscles), tends to prevent the power source from interfering and adversely affecting the control source, which might otherwise change the orientation of the putter face 18 and/or the direction of the path of the putter head 14.

As depicted in FIG. 15, he coordinates the lie of the putter 10, the position of his hands on the grip 16, the crook of the right elbow, the left hand and left arm, and the location of the ball 20 to specific distances from the left foot so that during the entire putting stroke the putter face 18 tends to be and remain aimed down the target line 24*a*. Practice and experience will teach golfers the exact location for their optimum lie of the putter 10, hand, right elbow and ball positions to cause the putter face 18 to be and remain aimed down the target line 24*a* during the putting stroke.

SUMMARY

PUTTING METHOD. The putting method of this invention produces accurate and consistent putting. This putting method is unique to the game of golf and is far greater than the sum of its individual steps golfers are able to execute this method quite easily with proper instruction and practice.

The individual steps of this invention interact together; they coordinate and supplement one another; and they function together to create a complete putting method. The result is an accurate, consistent and easy to execute putting method that is new and unique to the game of golf.

The one-handed and the two-handed versions of this invention both create a more accurate and consistent putting through the use of a mechanically simple putting-stroke that is easier to perform consistently than traditional two-handed putting methods. The golfer can visualize the target line 24*a* better when he executes the putt because his body B faces in the same general direction as the target line 24*a*. Using this invention, there is little tendency for the body B to move during the putting stroke. The design, weight and balance of the putter 10 compliments and assists in the execution of the putting stroke. The method of holding the grip 16 of the putter 10 combines the right hand and right arm into a single, firm, efficient and unique configuration with its many hand and arm contacts against the grip 16. This configuration controls the direction of the movement of the path of the putter 10 and the orientation of the putter face 18 in both the one-handed and two-handed version of this invention. This configuration also tends to keep the putter face 18 squared with the target line 24*a* during the putting stroke. The placement of the right arm across the front of the body B, and the use of the left hand in the two-handed version, permits the hand and arm configuration to swing freely and easily back and forward along and over the target line 24*a* and the rearward extension 24*b* of the target line 24*a*. By shifting the body B to the left, the eyes tend to be vertically over the ball 20, enabling the golfer to easily envision the target line 24*a*. By tilting the head and eyes to a horizontal viewing position the golfer's eyes are able to see, judge and function at their best because the eyes are in their optimum viewing position. Accurate squaring of the putter face 18 with the target line 24*a* is accomplished by placing the right eye directly over the target line 24*a*, and pointing the alignment lines 14*a* and 14*b* on top of the putter head 14 along the target line 24*a* and causing the edge 5*a* of the face plate 5 of the putter 10 to be perpendicular to the target line 24*a*, while maintaining the hand and arm configuration and the putter 10 as a single, integrated putting unit. During the putting stroke, the golfer may visually monitor the direction of the lines 14*a* and 14*b* to point along the target line 24*a*. The putter face 18 is kept square with the target line 24*a* by adhering to the principles of this invention, including monitoring the putter head 14 during the putting stroke, and by keeping the hand and arm configuration in tact, and by not additionally flexing or extending the elbow during the putting stroke. The acceleration gauge created within the right arm of the golfer permits the golfer to control and monitor the acceleration of the putter head 14 during the forward and follow-through strokes so that the putter head 14 velocity, as desired by the golfer, is attained when the putter face 18 strikes the ball 20. The golfer is able to control the distance a putted ball 20 rolls by use of the acceleration gauge, the use of the shoulder as a pivot point for a pendulum or linear forward stroke, the direct forward spin of the ball and other principles of this invention. The direct forward spin given the ball 20 when struck by the putter head 14 moving on an inclined path (FIG. 3B) with the vertical putter face 18 tends to cause the ball 20 to have direct forward spin and to roll without skidding or slipping in a direction that is more true to its initial path, and to roll to a longer and more consistent distance. The backstroke places the golfer and the putter 10 in a position to properly execute the forward movement that strikes the ball 20. The ability to adjust the position of the putter head 14, and the pressures of the hand and arm against the grip 16 during the backstroke and during any pause of the putter head 14 at the end of the backstroke permits the forward stroke to begin from a correct, controlled, and stable position. The method of this invention causes the path of the putter head 14 to move forward over the target line 24*a* with the putter face 18 squared with the target line 24*a* during the forward and follow-through strokes. As a result of the steps of this invention interacting together, this putting method is accurate, consistent, simple, and unique.

SCOPE OF THE INVENTION

The above presents a description of the best mode contemplated of carrying out the present invention, and of the manner and process of making and using it, in such full, dear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A method of putting a golf ball over the surface of a green using a putter having a putter head with a putter face, said putter head being attached to a distal end of a shaft having a grip along a proximal end of the shaft, said method comprises a golfer (a) grasping a portion of the grip with the right hand at a location along the grip so that the proximal end of the shaft is at or past the right elbow and bears against the underside of the right arm, (b) crooking the right elbow to configure said right arm and putter in a predetermined positional relationship, and placing the left hand on the putter nearby the right hand to move with said right hand, (c) addressing the ball by standing upright to one side of a target line along the golfer's left side and with the golfer's body facing in the same general direction as the target line and both the golfer's feet on the right side of the target line and positioned nearby the ball so that essentially most of the golfer's body is on the right side of the target line, bringing said right arm across the front of the golfer's body and positioning the putter head adjacent to the ball and the putter face behind and facing the ball, and (d) striking the ball by swinging the putter through a backstroke, forward stroke, and follow-through stroke while substantially maintaining said right arm and putter in said predetermined positional relationship.

2. The method according to claim 1 where the grip has a front side and a backside, and the putter face is along the front side of the grip, and the golfer holds a portion of the grip with the golfer's index finger of the right hand extending lengthwise along the front side of the grip, said portion of the grip laying along the golfer's palm of said right hand and the remaining digits of said right hand wrapped around said portion, and pushes said index finger against the grip to lever the proximal end of the shaft against the underside of said right arm at or past the right elbow.

3. The method according to claim 2 where the golfer's left arm is crooked.

4. The method according to claim 3 where the shaft has a length exceeding 40 inches and a longitudinal axis, said longitudinal axis and putter face forming an angle of from 1° to 15°.

5. A method of putting a golf ball over the surface of a green using a putter having a putter head with a putter face, said putter head being attached to a distal end of a shaft having a grip along a proximal end of the shaft, said method comprises a golfer (a) grasping a portion of the grip with the left hand at a location along the grip so that the proximal end of the shaft is at or past the left elbow and bears against the underside of the left arm, (b) crooking the left elbow to configure said left arm and putter in a predetermined positional relationship, and placing the right hand on the putter nearby the left hand to move with said left hand, (c) addressing the ball by standing upright to one side of a target line along the golfer's right side and with the golfer's body facing in the same general direction as the target line and both the golfer's feet on the left side of the target line and positioned nearby the ball so that essentially most of the golfer's body is on the left side of the target line, bringing said left arm across the front of the golfer's body and positioning the putter head adjacent to the ball and the putter face behind and facing the ball, and (d) striking the ball by swinging the putter through a backstroke, forward stroke, and follow-through stroke while substantially maintaining said left arm and putter in said predetermined positional relationship.

6. The method according to claim 5 where the grip has a front side and a backside, and the putter face is along the front side of the grip, and the golfer holds a portion of the grip with the golfer's index finger of the left hand extending lengthwise along the front side of the grip, said portion of the grip laying along the golfer's palm of said left hand and the remaining digits of said left hand wrapped around said portion, and pushes said index finger against the grip to lever the proximal end of the shaft against the underside of said left arm at or past the left elbow.

7. The method according to claim 6 where the golfer's right arm is crooked.

8. The method according to claim 7 where the shaft has a length exceeding 40 inches and a longitudinal axis, said longitudinal axis and putter face forming an angle of from 1° to 15°.

* * * * *